US011638466B2

(12) United States Patent
Burt et al.

(10) Patent No.: US 11,638,466 B2
(45) Date of Patent: May 2, 2023

(54) SYSTEMS AND METHODS FOR AN IMPROVED ROTARY CLOSURE

(71) Applicant: Pride Manufacturing Company, LLC, Brentwood, TN (US)

(72) Inventors: John Robert Burt, Brentwood, TN (US); Lee Paul Shuttleworth, Brentwood, TN (US)

(73) Assignee: Pride Manufacturing Company, LLC, Brentwood, TN (US)

( * ) Notice: Subject to any disclaimer, the term of this patent is extended or adjusted under 35 U.S.C. 154(b) by 0 days.

(21) Appl. No.: 17/680,968

(22) Filed: Feb. 25, 2022

(65) Prior Publication Data

US 2022/0265001 A1 Aug. 25, 2022

Related U.S. Application Data

(60) Provisional application No. 63/153,486, filed on Feb. 25, 2021.

(51) Int. Cl.
*A43C 11/16* (2006.01)
*A43C 1/00* (2006.01)

(52) U.S. Cl.
CPC ..... *A43C 11/165* (2013.01); *A43C 1/00* (2013.01)

(58) Field of Classification Search
CPC ..... A43C 11/165; A43C 11/22; A43C 11/20; A43C 1/00; A43C 7/00; A43C 17/02; F16G 11/12
See application file for complete search history.

(56) References Cited

U.S. PATENT DOCUMENTS

| | | | | |
|---|---|---|---|---|
| 2010/0257751 | A1 | 10/2010 | Burt et al. | |
| 2011/0303782 | A1* | 12/2011 | Hu | A43C 11/20 242/388 |
| 2012/0174441 | A1 | 7/2012 | Jungkind | |
| 2018/0160775 | A1* | 6/2018 | Pollack | A43C 7/00 |
| 2020/0128919 | A1 | 4/2020 | Burt et al. | |
| 2020/0345107 | A1 | 11/2020 | Burt et al. | |
| 2020/0346888 | A1* | 11/2020 | Kruse | F16G 11/12 |

OTHER PUBLICATIONS

International Search Report and Written Opinion issued in corresponding Applicati n No. PCT/US2022/017908 dated Jun. 30, 2022, 15 pages.

* cited by examiner

*Primary Examiner* — Robert Sandy
*Assistant Examiner* — Rowland Do
(74) *Attorney, Agent, or Firm* — Polsinelli PC

(57) ABSTRACT

Various embodiments of an improved rotary closure to prevent jamming when rotated in a particular direction and allow de-tensioning of the spool are disclosed herein.

21 Claims, 46 Drawing Sheets

SYSTEMS AND METHODS FOR AN IMPROVED ROTARY CLOSURE

CROSS-REFERENCE TO RELATED APPLICATIONS

This is a non-provisional application that claims benefit to U.S. Provisional Patent Application Ser. No. 63/153,486 filed Feb. 25, 2021, which is herein incorporated by reference in its entirety.

FIELD

The present disclosure generally relates to an improved rotary closure for a shoe and a method of assembling the improved rotary closure.

BACKGROUND

Previous efforts in rotary closure systems to lace a shoe, while being securely latched, can have inherent flaws such as the tendency to become locked into a de-tensioning position or become jammed when rotated too far in an incorrect rotational direction. Previous rotary closure designs included housings that fully encapsulate a spool, which can cause tensioning elements to become tangled inside the open housing and can sometimes obstruct rotation of the spool. Further, if a mistake is made during assembly or components are misaligned, one risks damaging the rotary closure by attempting to open and realign components of the rotary closure.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
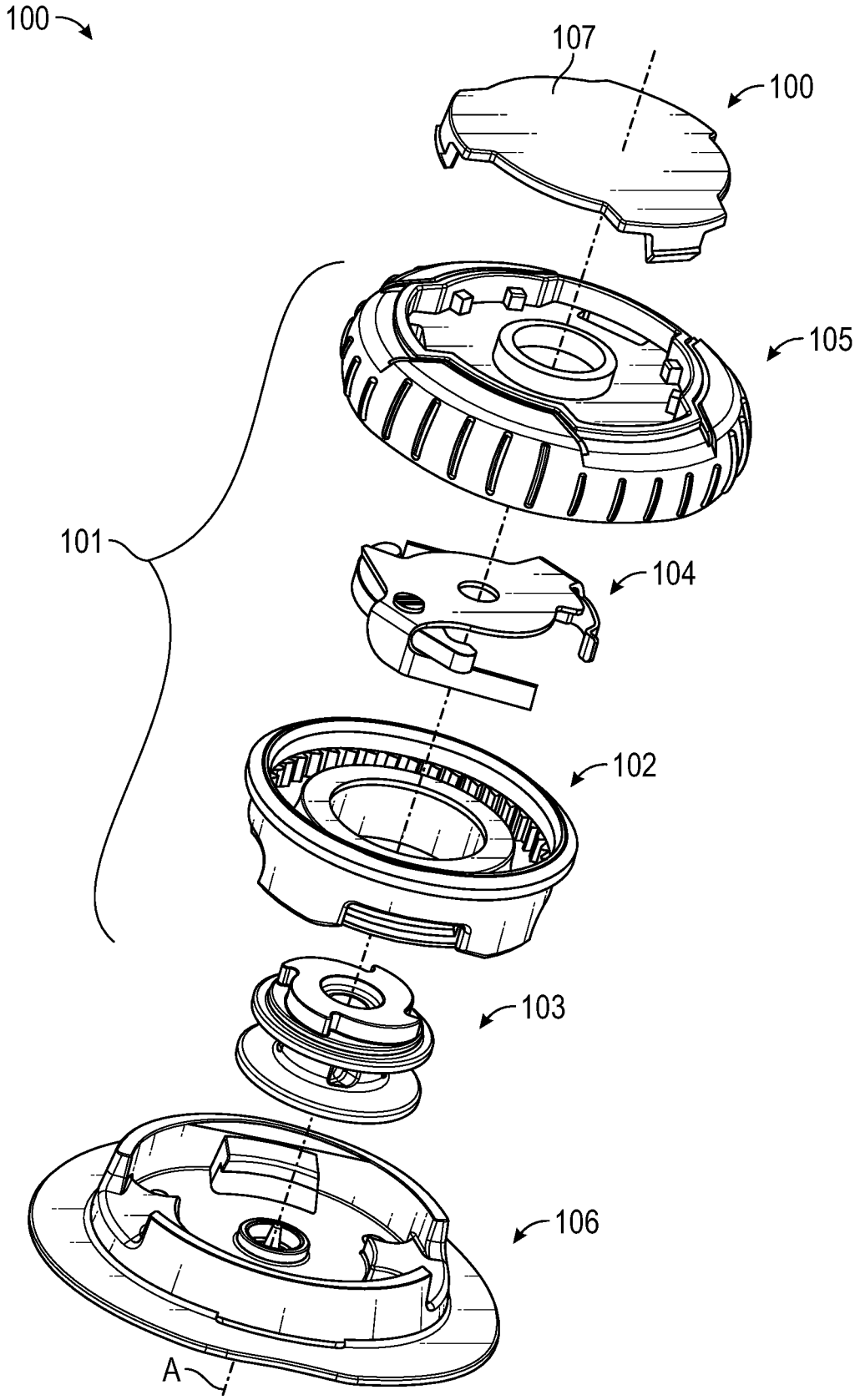
FIG. 1 is an illustration showing an exploded view of various components of a first embodiment of an improved rotary closure featuring an open spool housing and a closed flange.
Figure 2:
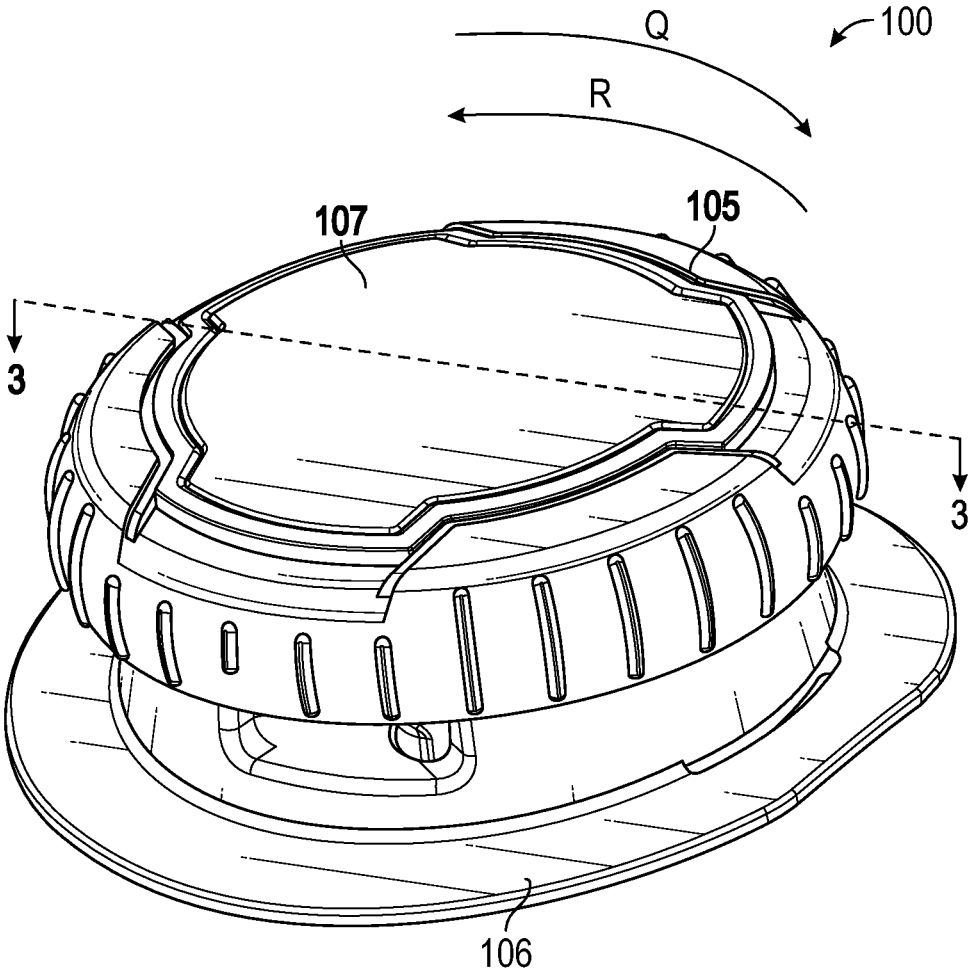
FIG. 2 is an illustration showing an assembled view of the rotary closure of FIG. 1.

Various embodiments of a rotary closure including an open housing that provides an increased spool capacity and reduces jamming of a tensioning element that is to be repeatedly tensioned and de-tensioned around the spool. The open housing defines an open spool passage that engages a dial of the rotary closure and partially encapsulates the spool, thereby allowing the use of a taller spool to increase spool capacity. The open housing enables access to an underside of the spool and defines a pair of open arches that allow passage of the tensioning element outside of the open housing to reduce a chance and severity of jamming of the tensioning element. The open housing further enables manufacturers to assemble the dial, an index spring and the open housing in a snap-fit engagement as a subassembly, thus allowing the manufacturer to ensure that the dial, index spring and the open housing are working properly prior to full assembly of the rotary closure. The spool and associated tensioning element can thereafter be coupled with the subassembly. The spool includes a distal-most keyway to latch the subassembly with the spool in an assembled state through insertion of a latching extension of the dial that engages the distal-most keyway of the spool. The subassembly and spool can then be engaged with a flange, which can in some embodiments be stitched into a shoe or another item. In some embodiments, the rotary closure includes an improved index spring that prevents jamming during counter-rotation of the dial of the rotary closure through inclusion of a "dead-stop" feature integral to a body of the index spring that contacts an island of the dial when the dial is counter-rotated to prevent the dial from being counter-rotated too far, thus preventing unintentional disengagement of the dial from the index spring. The examples shown herein for various embodiments of the rotary closure are suitable for a right-handed wearer or when it is otherwise most convenient to wind the dial in a clockwise direction. However, a rotary closure according to the embodiments herein could also be manufactured in an orientation suitable for a left-handed wearer or when it is otherwise most convenient to wind the dial in a counterclockwise direction. Referring to the drawings, embodiments of a rotary closure for a shoe are illustrated and generally indicated as 100 and 200 in FIGS. 1-27.

Figure 3:
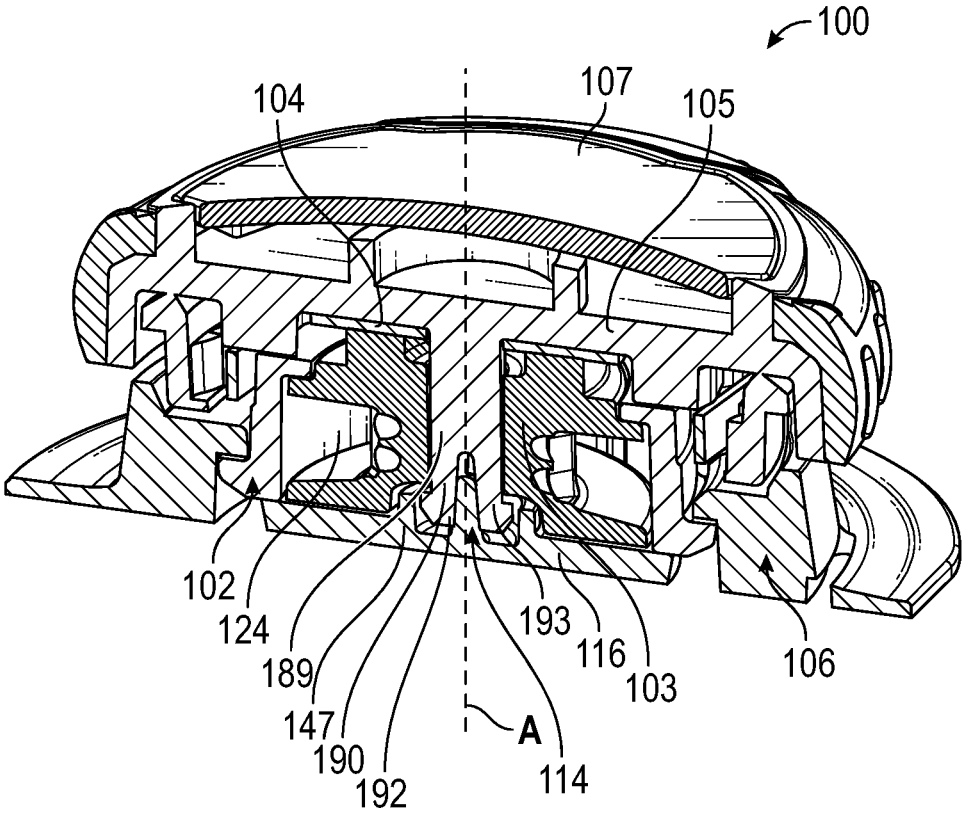
FIG. 3 is an illustration showing a section view of the rotary closure of FIG. 1 taken along line 3-3 of FIG. 2.
Figure 4A:
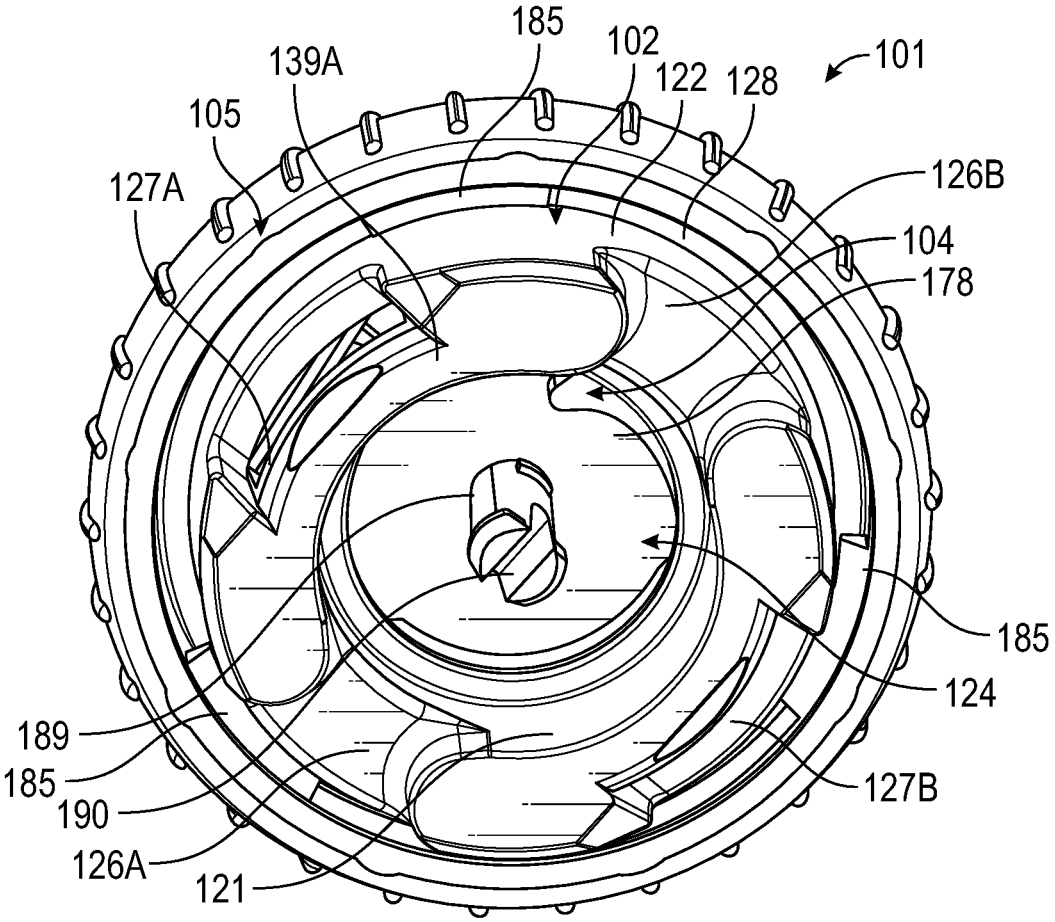
FIGS. 4A and 4B are a series of illustrations showing a bottom perspective view of a subassembly of the rotary closure of FIG. 1 prior to and following engagement of a spool with the subassembly.
Figure 4B:
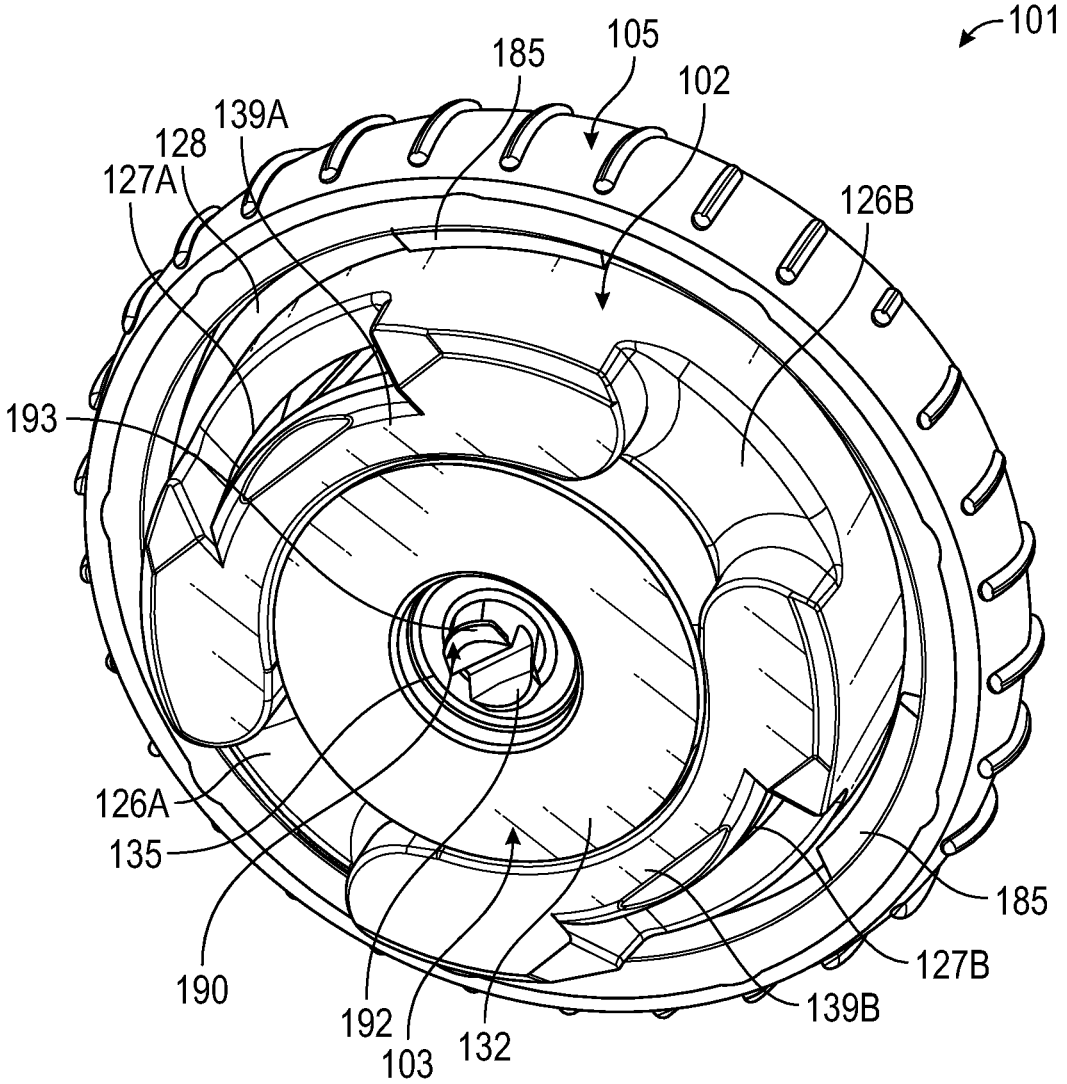

FIGS. 1-4B illustrate a first embodiment of a rotary closure 100. As shown, the rotary closure 100 includes a dial 105 for rotation of a spool 103 and an improved index spring 104 for controlling a direction of rotation of the spool 103, which are latched together by a latching extension 189. The rotary closure 100 includes an open housing 102 that engages the index spring 104 and the dial 105 and further defines an open spool passage 124 in which the spool 103 can be partially encapsulated. To assemble the rotary closure 100, the index spring 104 is first coupled with the dial 105, which are in turn coupled with the open housing 102 in a snap-fit engagement to form a subassembly 101 illustrated in FIG. 4A. The spool 103 can then be disposed within the open spool passage 124 of the open housing 102 and coupled with a latching extension 189 associated with the dial 105, as illustrated in FIG. 4B. When assembled, the dial 105 operatively engages the index spring 104 and the spool 103 to rotate the spool 103 within the open housing 102 in a first rotational direction Q (FIGS. 10B and 10C) to tension the tensioning element around the spool, and a second rotational direction R to de-tension the tensioning element. As shown in FIG. 3, the dial 105 includes or is otherwise directly associated with the latching extension 189 configured for insertion through a distal-most keyway 135 of the spool 103 to engage the spool 103 within the subassembly 101. When assembled, the components of the subassembly 101 and the spool 103 are aligned along a common center axis A. The assembled spool 103 and subassembly 101 including the dial 105, index spring 104, and open housing 102 may then be coupled to a flange 106 (FIGS. 1-3), which is secured along an exterior portion of a shoe (not shown) to complete assembly. In some embodiments, the dial 105 is configured for engagement with a cover 107 that provides a smooth surface to the assembled rotary closure 100. In some embodiments, the cover 107 can include a logo or other indicia.

Figure 5A:
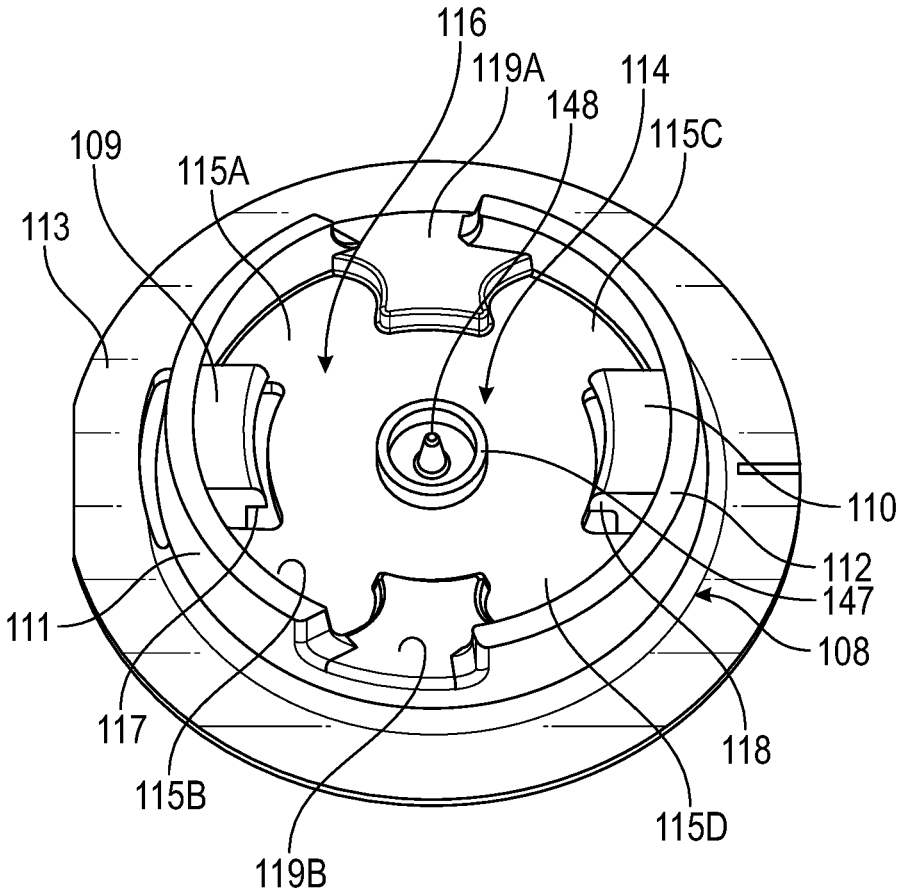
FIGS. 5A-5C are a series of illustrations showing top perspective, bottom perspective, and top plan views of the flange of the rotary closure of FIG. 1 defining a solid flange floor.
Figure 5B:
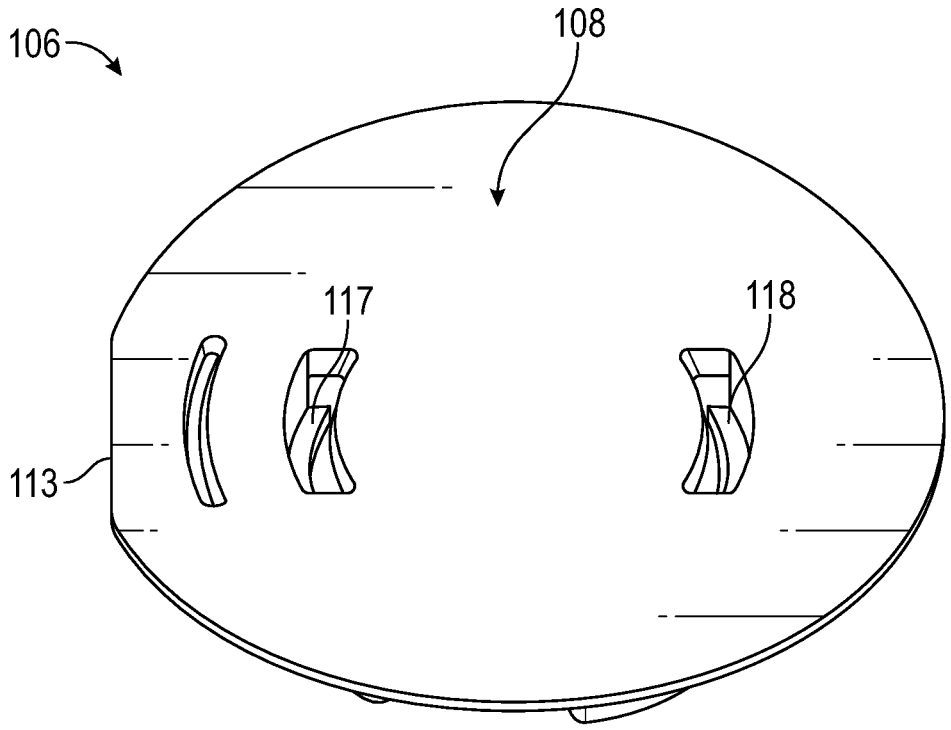
Figure 5C:
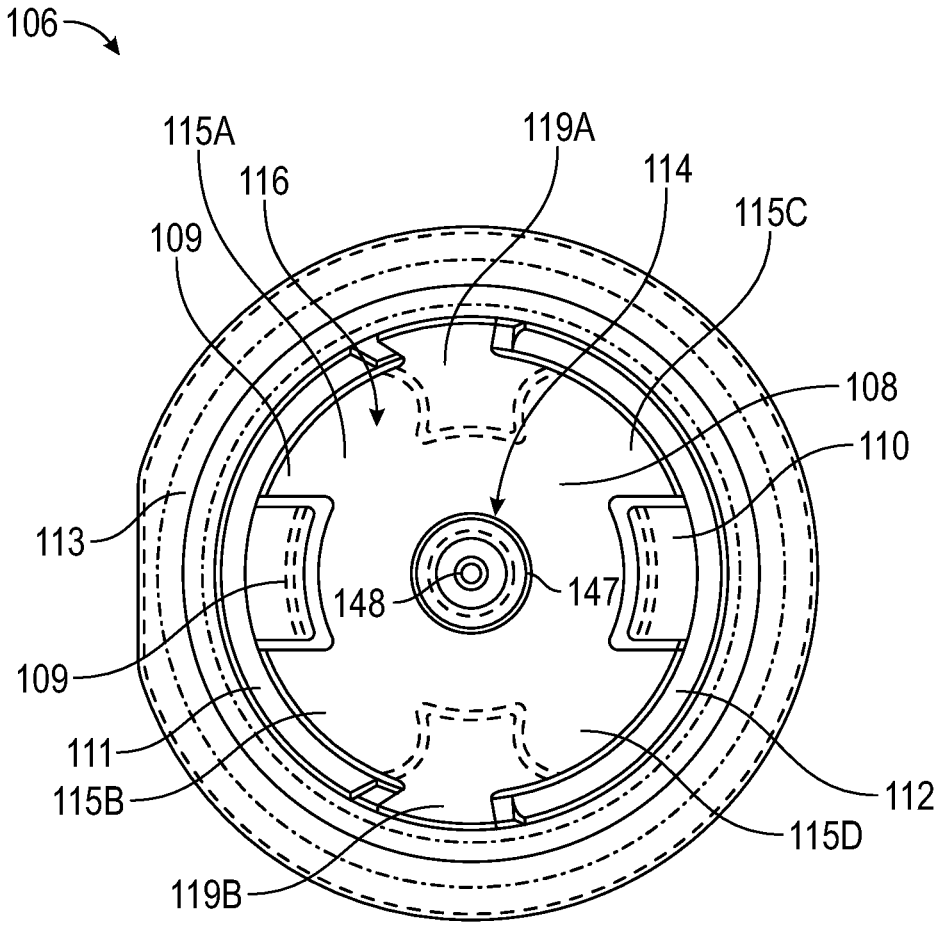

Referring to FIGS. 5A-5C, in some embodiments the flange 106 is configured to couple the assembled components of the rotary closure 100 to a shoe or another item by engagement with the open housing 102 (FIG. 1). In some embodiments, the flange 106 defines a closed body 108 having a circular shape with a bowed cross section forming a flange floor 116 on one side that is configured to engage the open housing 102 during assembly. The closed body 108 of the flange encloses an underside of the spool 103 and couples with the open housing 102 such that the spool 103 is collectively enclosed between the dial 105, the open housing 102 and the flange 106. This is in opposition to previous iterations of a rotary closure that included a closed housing that provided complete separation between the flange and a spool and only encapsulated the spool between the dial and the closed housing. Further, the closed body defines a first flange wall 111 and an opposite second flange wall 112 that envelop the open housing 102, and a rim 113 that extends beyond the first and opposite second flange walls 111 and 112. The first flange wall 111 and the opposite second flange wall 112 collectively define a first flange window 119A and an opposite second flange window 119B for passage of a tensioning element when assembled. The flange floor 116 of the flange 106 forms a plurality of seats 115A-D that accept a plurality of respective shoulders 129A-D (FIG. 6B) of the open housing 102 and a central depression 114 to accommodate a latching element 190 of the bifurcated latching extension 189. In some embodiments, the central depression 114 defines a ring 147 surrounding a central protrusion 148 within the central depression 114. The central protrusion 148 is configured to engage between a first leg 192 and a second leg 193 (FIG. 3) of the latching extension 189 to bias the first and second legs 192 and 193 apart and prevent the latching extension 189 from disengaging from the spool 103. The flange 106 further includes a first retention member 109 formed opposite a second retention member 110 configured to couple opposite sides of the open housing 102 to the flange 106. In some embodiments, the first and second retention members 109 and 110 form first and second tang portions 117 and 118, respectively, at the free ends thereof. The first and second tang portions 117 and 118 are configured to couple with the open housing 102 in a snap fit engagement.

Figure 10A:
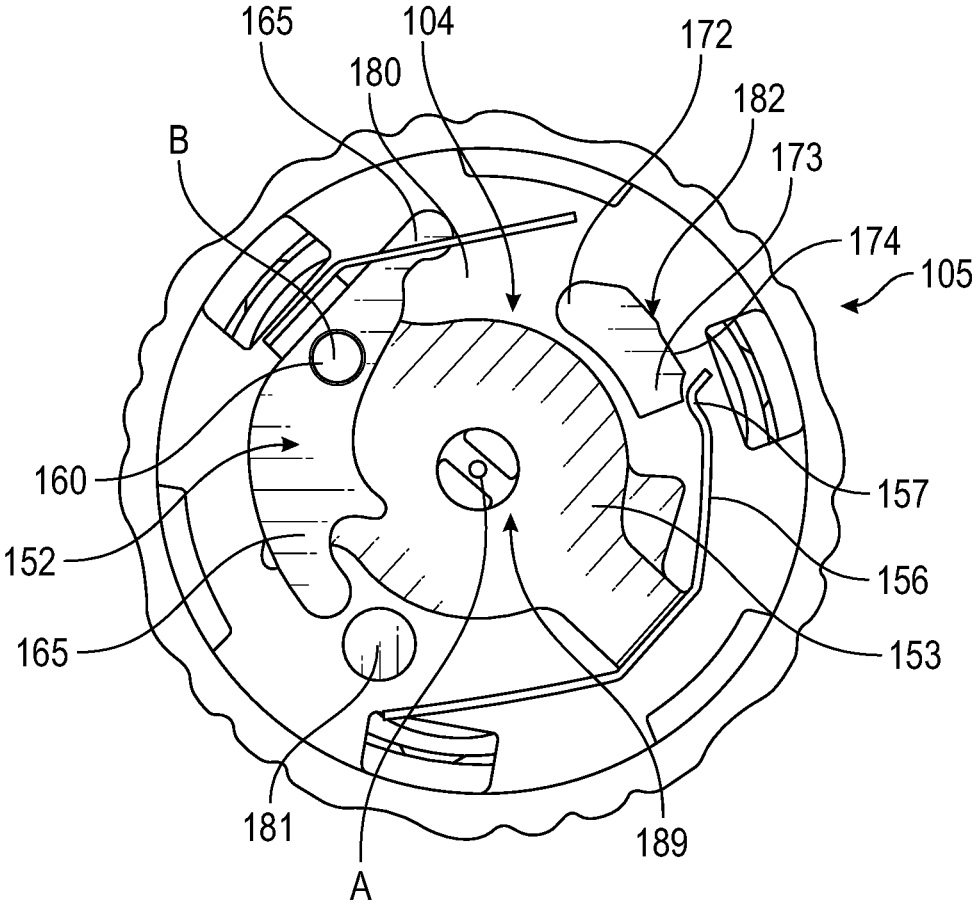
FIG. 10A is an illustration showing a bottom perspective view of an assembled dial of the rotary closure of FIG. 1 in a neutral position.
Figure 10B:
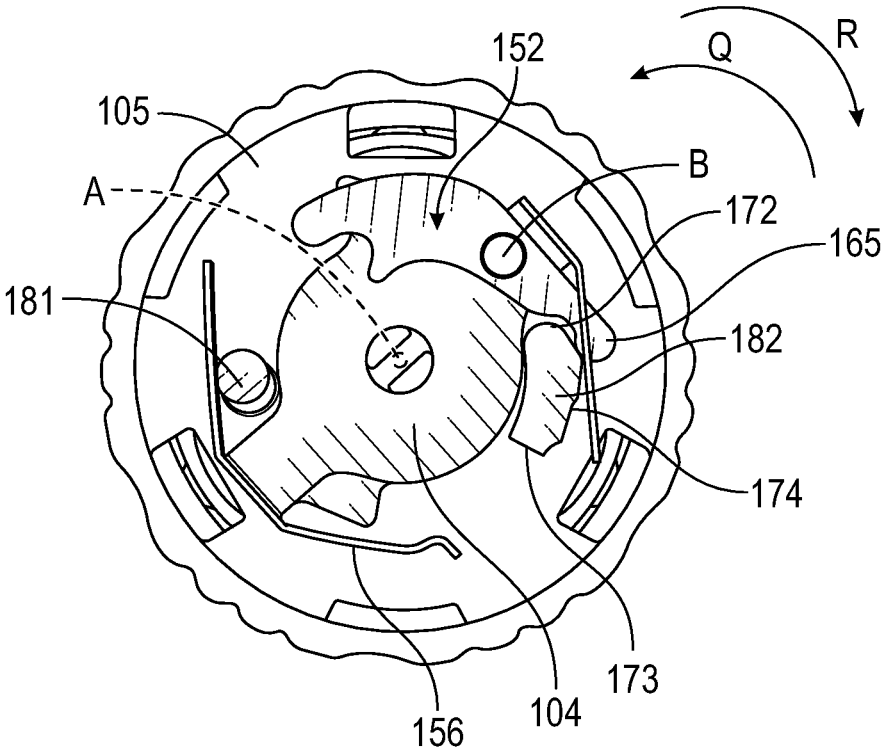
FIGS. 10B and 10C are respective illustrations showing the index spring and dial of FIG. 25 in a first "rotating" position with a pawl of the index spring being rotated forward towards a post of the dial, and a second "stop" position in which the index spring is rotated forward towards a post of the dial until a tension spring of the index spring rides over the island of the dial.

FIGS. 6A-6D illustrate the open housing 102 for the rotary closure 100. In some embodiments, the open housing 102 forms a generally circular body 120 defining the open spool passage 124 for receipt and rotation of the spool 103. The circular body 120 defines a circular inner wall 121 formed coaxially within a circular outer wall 122. As shown, the circular outer wall 122 defines a circumferential flange 128 around an exterior of the circular outer wall 122 which is configured for engagement with the dial 105; such an engagement is illustrated in FIG. 4A. The circular outer wall 122 also defines a plurality of teeth 123 along an interior of the circular outer wall 122 that are configured for engagement with the index spring 104. The circular inner wall 121 forms a channel 125 between the circular outer wall 122 and the circular inner wall 121 for receipt of the index spring 104, an engagement that is illustrated in FIG. 10D. The open spool passage 124 is defined though the center of the open housing 102; a diameter of the open spool passage 124 enables placement and free rotation of the spool 103 within the open spool passage 124. As further shown in FIG. 4B, the open spool passage 124 partially encapsulates the spool 103 and permits access to an underside of the spool 103 while the spool 103 is disposed within the open housing 102. The open spool passage 124 of the open housing 102 allows the use of a taller spool 103 within the rotary closure 100 by eliminating unnecessary volume within the open housing 102. The plurality of teeth 123 of the open housing 102 are configured to operatively engage a first index spring arm 153 and a second index spring arm 154 of the index spring 104 (FIGS. 8A-8E) as the dial 105, index spring 104 and spool 103 are caused to incrementally rotate in a first rotational direction Q while the tensioning elements are being tightened around the spool 103. The plurality of teeth 123 of the open housing 102 are angled to prevent counter-rotation of the index spring 104 in a second rotational direction R within the open housing 102, an operation which will be described in greater detail below.

Figure 6A:
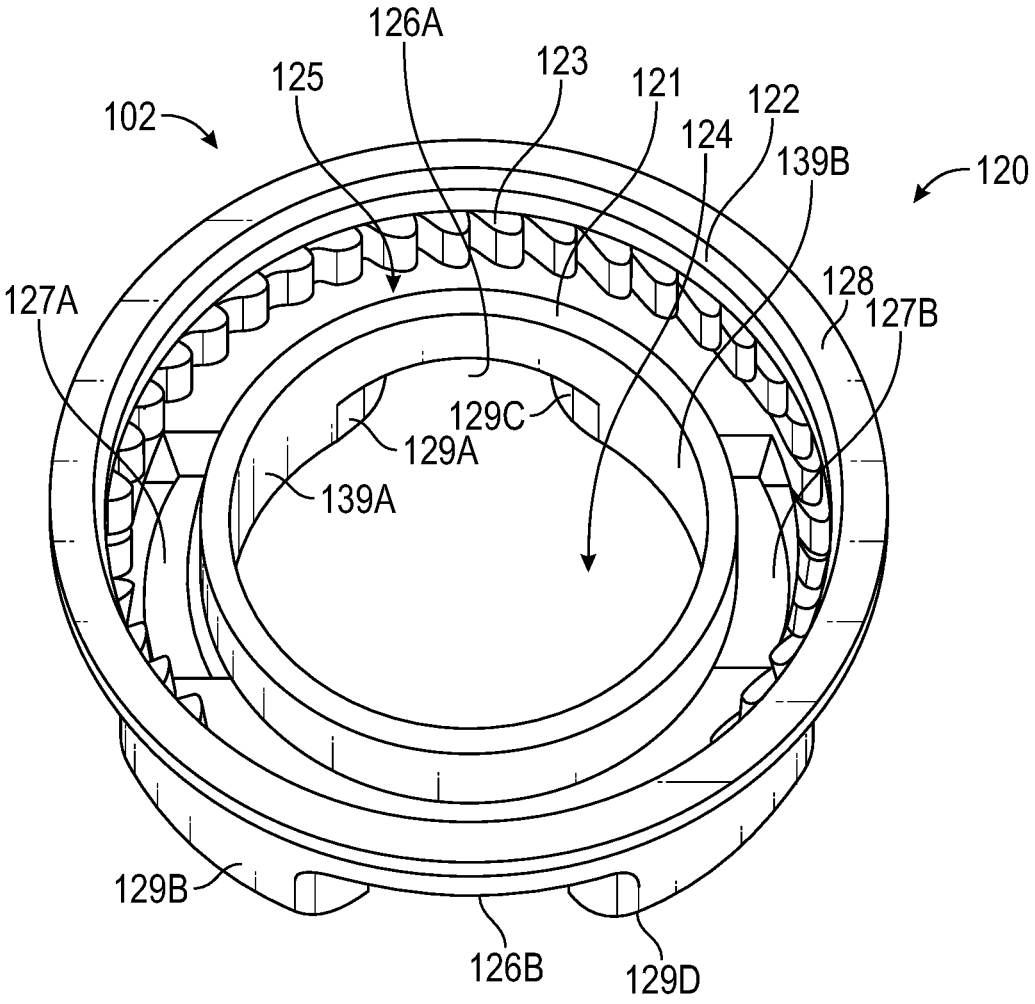
FIGS. 6A-6C are a series of illustrations showing top perspective, bottom perspective, and top plan views of the open spool housing of the rotary closure of FIG. 1 defining an open configuration.
Figure 6B:
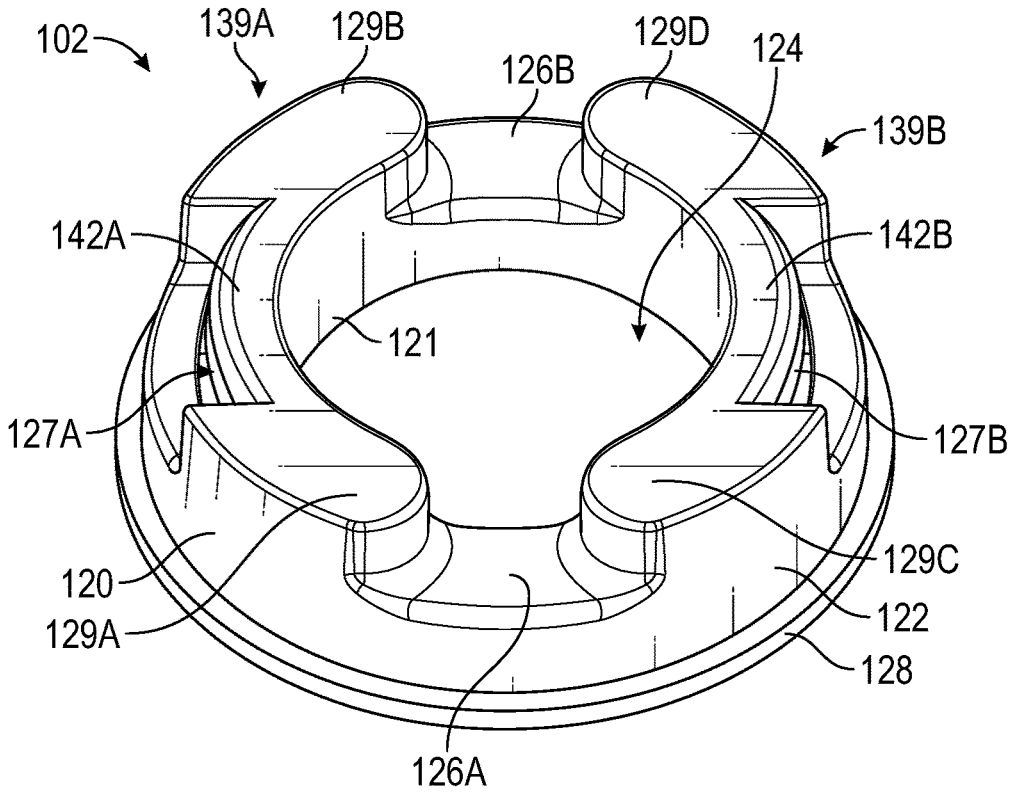
Figure 6C:
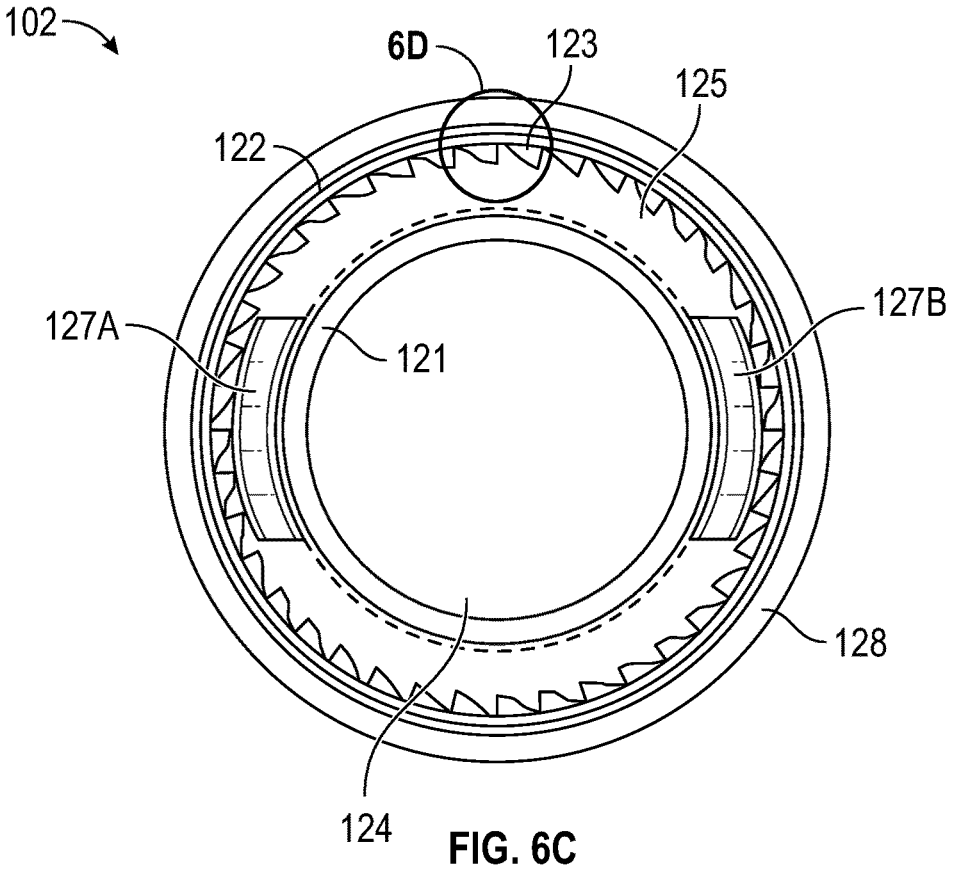
Figure 6D:
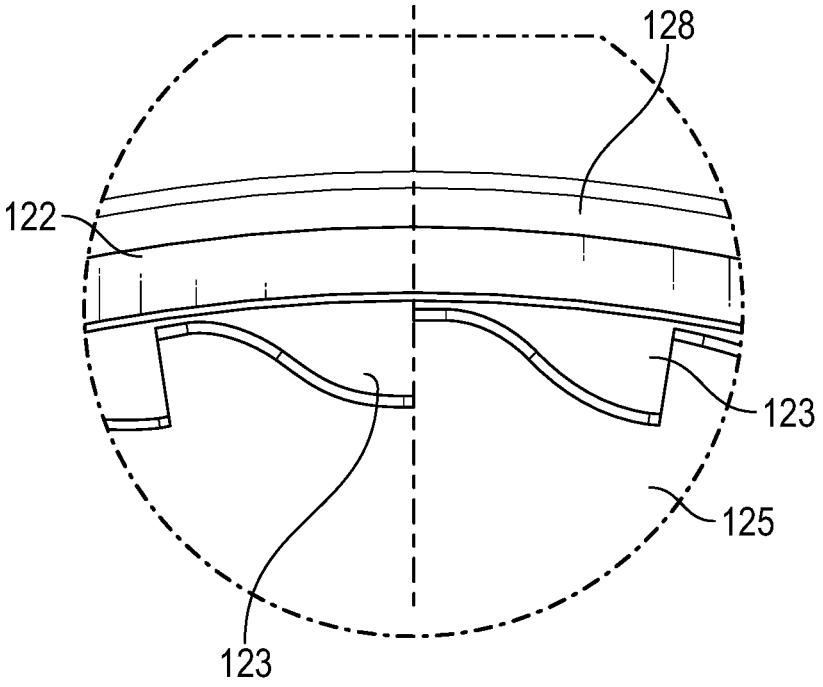
FIG. 6D is an illustration showing an enlarged view showing a plurality of teeth of the open spool housing of FIG. 6A taken along circle 6D-6D of FIG. 6C.

In some embodiments, as shown in FIG. 6B, the open housing 102 defines a pair of opposing arcuate plateaus 139 formed on an underside of the channel 125 that seat within the flange floor 116 of the flange 106 (FIG. 4) and also partially encapsulate the spool 103. The pair of opposing arcuate plateaus 139 include a first arcuate plateau 139A and a second arcuate plateau 139B. The first arcuate plateau 139A defines a first shoulder 129A at a first end of the first arcuate plateau 139A and a second shoulder 129B defined at a second end of the first arcuate plateau 139A. Similarly, the second arcuate plateau 139B defines a third shoulder 129C at a first end of the second arcuate plateau 139B and a fourth shoulder 129D defined at a second end of the second arcuate plateau 139B. As shown, the first arcuate plateau 139A defines a first midsection 142A between the first shoulder 129A and the second shoulder 129B that collectively form a first closed slot 127A configured for engagement with a first retention member 109 of the flange 106 during assembly of the rotary closure 100. Similarly, the second arcuate plateau 139B defines a second midsection 142B between the third shoulder 129C and the fourth shoulder 129D that collectively define a second closed slot 127B configured for engagement with a second retention member 110 of the flange 106 during assembly of the rotary closure 100.

The first and second arcuate plateaus 139A and 139B collectively define a first open arch 126A and a second open arch 126B configured for passage of one or more lacing (tensioning) elements (not shown) between an interior of the open spool passage 124 and an exterior of the open housing 102. Specifically, the first shoulder 129A of the first arcuate plateau 139A and the third shoulder 129C of the second arcuate plateau 139B collectively form the first open arch 126A. Similarly, the second shoulder 129B of the first arcuate plateau 139A and the fourth shoulder 129D of the second arcuate plateau 139B collectively form the second open arch 126B. Referring briefly back to FIG. 4B, when assembled, the first and second open arches 126A and 126B enable access the tensioning element (not shown) and the spool 103 while the spool 103 is coupled within the open housing 102. The first and second open arches 126A and 126B result in a lesser likelihood that the tensioning element will become jammed, especially with both tensioning and de-tensioning functionalities required of the rotary closure 100.

Figure 7A:
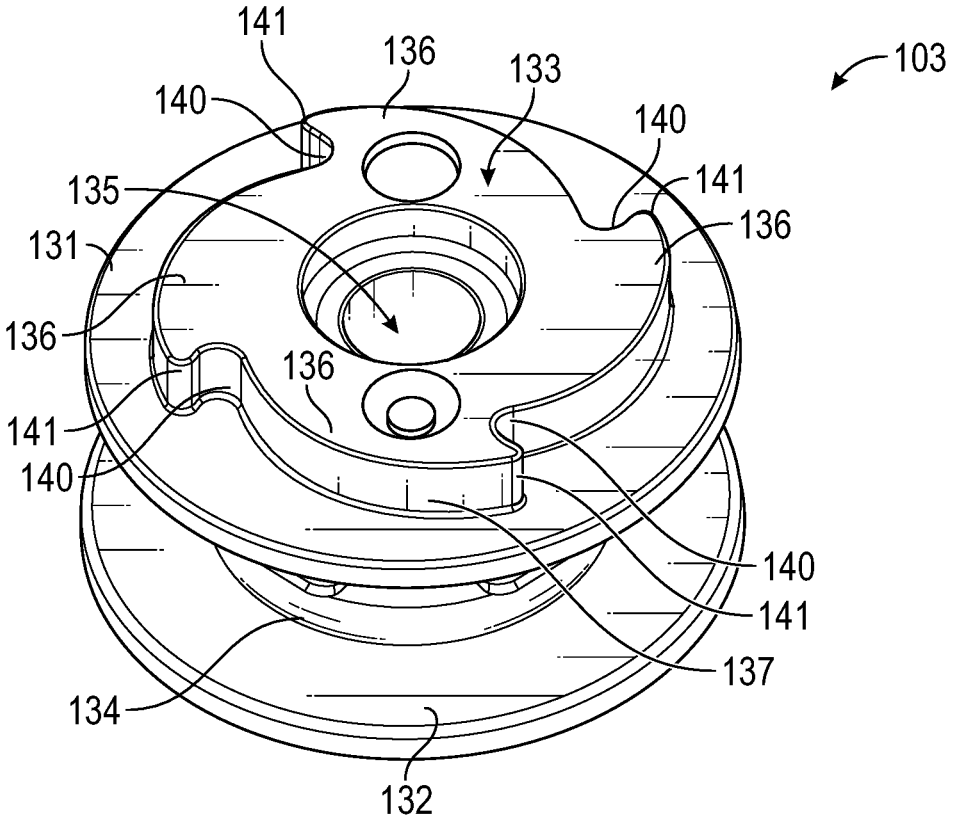
FIGS. 7A-7D are a series of illustrations showing top perspective, bottom perspective, top plan and side views of the spool of the rotary closure of FIG. 1.
Figure 7B:
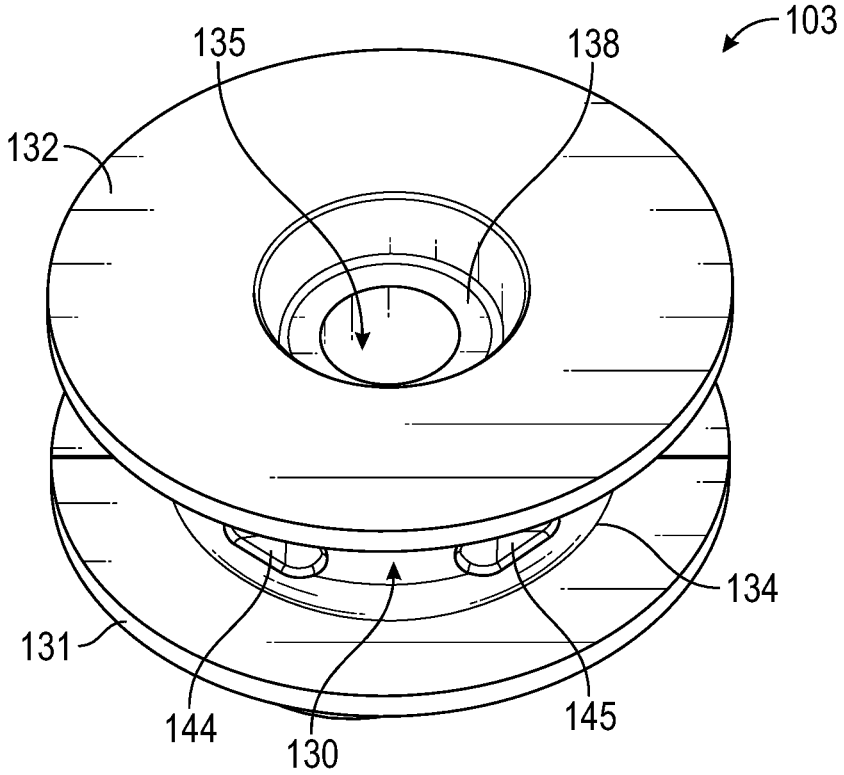
Figure 7C:
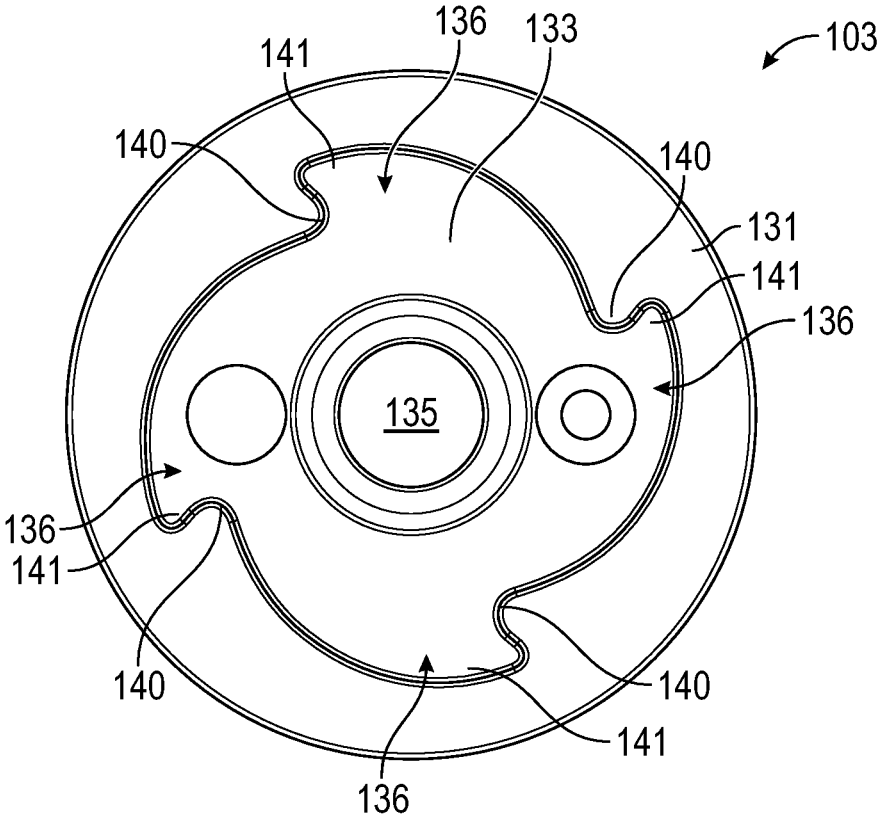
Figure 7D:
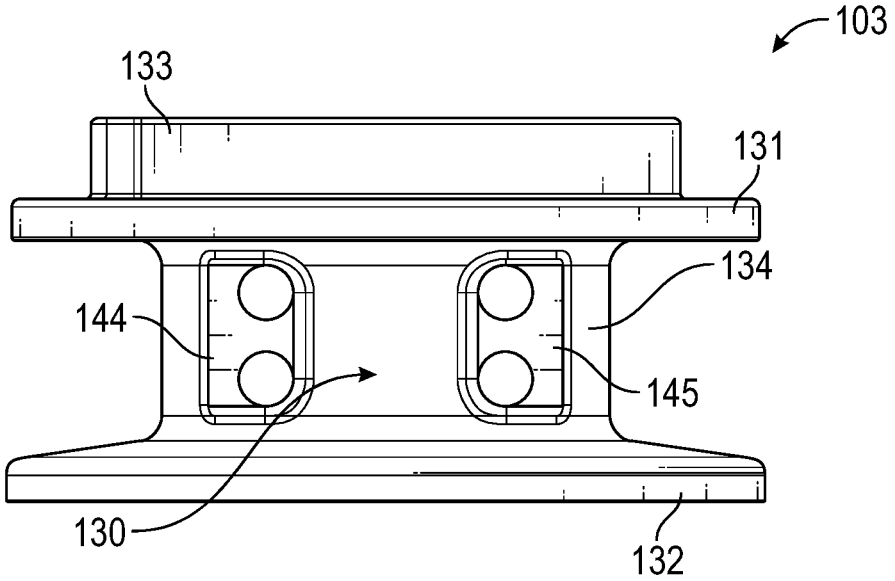

Referring to FIGS. 7A-7D, the spool 103 controls the operation of a tensioning element (not shown) such as a cable or wire, used to lace a shoe (not shown) by operation of the rotary closure 100 which is seated within the open spool passage 124 of housing 102 (as shown in FIG. 4B). In some embodiments, the spool 103 includes a body 130 forming a spool base 132 and a spool flange 131 that collectively define a neck 134 and an extension 133 that extends axially from the spool flange 131. The neck 134 is configured to receive the tensioning element which is to be wound around the neck 134. The extension 133 forms a plurality of curved teeth 136 that collectively form a plurality of recesses 140 in juxtaposition between respective ridges 141 formed circumferentially around the peripheral edge 137 of extension 133 for engagement with the index spring 104 (FIGS. 8A-8E). The curved teeth 136 are configured to operatively engage a pawl member 152 of the index spring 104 for turning the spool 103 in the first rotational direction Q, essentially "catching" the spool 103 and forcing the spool 103 to rotate in the rotational direction Q with the dial 105 and index spring 104. The spool 103 defines a distal-most keyway 135 running axially through the body 130 of the spool 103 configured for engagement with the latching extension 189 of the dial 105; the engagement of which is illustrated in FIG. 4B. As shown in FIGS. 3, 7A and 7B, the distal-most keyway 135 is formed axially through the spool body 130 to permit passage of the latching element 190 of the latching extension 189 through the distal-most keyway 135. The distal-most keyway 135 defines a spool shoulder 138 at the spool base 132 for engagement with the latching element 190 of the latching extension 189 such that as the latching extension 189 is inserted through the distal-most keyway 135, the latching element 190 couples with the spool shoulder 138. In particular, as is further discussed below, the first and second legs 192 and 193 of the latching element 190 are configured for insertion through the distal-most keyway 135 and engagement with the spool shoulder 138 such that the first and second tangs 194 and 195 (FIG. 9B) defined by the first and second legs 192 and 193 are pushed apart, preventing disengagement of the spool 103 from the latching extension 189. As further shown, in some embodiments the body 130 of the spool 103 defines a first window 144 and a second window 145. Structurally, the first and second windows 144 and 145 are configured to allow passage of the tensioning element to secure the tensioning element to the body 130 of the spool 103 while the tensioning element is being wound around the spool 103 during operation of the rotary closure 100.

Referring to FIGS. 8A-8E, the index spring 104 includes a body 150 having a center portion 155 forming a first lateral arm 161 and an opposite second lateral arm 162. The second lateral arm 162 defines a pivot element 160 that couples the pawl member 152 of the index spring 104 to the second lateral arm 162 such that the pawl member 152 pivots or rotates about a pivot axis B defined by pivot element 160. In some embodiments, the pawl member 152 defines a proximal portion 165 and an opposite distal portion 166 in which the distal portion 166 forms a first ridge 167 and a second ridge 168 with a pawl recess 169 defined between the first and second ridges 167 and 168. In operation, the pawl member 152 is operatively engaged with the extension 133 (FIG. 6A) of the spool 103 to control rotation of the spool 103, essentially "catching" the spool 103 and forcing the spool 103 to rotate in the first rotational direction Q with the subassembly 101 when winding the tensioning element around the spool 103. For example, the pawl recess 169 of the pawl member 152 is configured to engage a respective ridge 141 of the extension 133 such that the spool 103 is caught and rotated in the first rotational direction Q of the spool 103 is controlled by the pawl member 152. The index spring 104 includes a first index spring arm 153 and second index spring arm 154 which are each configured to incrementally engage the plurality of teeth 123 (FIGS. 6A and 6D) of the open housing 102 as the dial 105 is rotated in the first rotational direction Q by the user. The first and second index spring arms 153 and 154 allow rotation of the index spring 104 in the first rotational direction Q within the open housing 102, but prevent counter-rotation in the second rotational direction R within the open housing 102. As will be discussed in greater detail below, the index spring 104 further includes a tension spring 156 having a terminal end portion 157 that contacts an island 182 of the dial 105 (FIGS. 9B-10C) and provides tactile feedback to a user to communicate that the index spring 104 is releasing the spool 103. As specifically shown in FIGS. 8A, 10C and 11B, the index spring 104 further includes a dead-stop element 163 protruding from the body 150 and first lateral arm 161 and associated with the tension spring 156 and configured to contact an island 182 of the dial 105 when rotated in the second rotational direction R to prevent over-counterrotation of the dial 105 relative to the index spring 104. The index spring 104 further includes an elongated protrusion 164 associated with the body 150 and the pawl member 152 for engagement with a post 181 of the dial 105, preventing over-counter-rotation of the dial 105 relative to the index spring 104. As further shown, the index spring 104 defines a keyway 158 axially through the central portion of the index spring 104 along the common center axis A that, when assembled, is coaxially aligned with the distal-most keyway 135 of the spool 103.

Referring to FIGS. 9A-11B, the dial 105 provides a means for actuating the rotary closure 100 through manual rotation of the dial 105 indefinitely in the first rotational direction Q and limitedly in the opposite second rotational direction R. In some embodiments, the dial 105 includes a body 176 defining an exterior surface 177 and an interior surface 178. In some embodiments, the exterior surface 177 forms a gripping surface 183 configured for gripping by the hand of the user when rotating the dial 105. As specifically shown in FIG. 9B, the dial 105 includes one or more engagement elements 185 for engagement with the circumferential flange 128 of the open housing 102 to encapsulate the index spring 104 and form the subassembly 101 of FIGS. 4A and 4B. Further, the dial 105 defines the latching extension 189 that enables coupling of the spool 103 to the subassembly 101. In the example of FIG. 1, the dial 105 can be configured for engagement with the cover 107.

In some embodiments, the interior surface 178 of the dial 105 forms the island 182, which is a protrusion from the interior surface 178. The island 182 defines a first rounded end 172, a second squared end 173 and a textured outer edge 174. In the embodiment shown, an inner edge 175 of the island 182 follows an outline of the center portion 155 of the index spring 104. As illustrated in FIGS. 10B and 11A, as the dial 105 is rotated in the first rotational direction Q, the first rounded end 172 of the island 182 contacts the proximal portion 165 of the pawl member 152 of the index spring 104 and rotates the distal portion 166 of the pawl member 152 towards the center of the body 150 of the index spring 104. Conversely, when rotated in the opposite second rotational direction R relative to the index spring 104 as in FIGS. 10C and 11B, the tension spring 156 rides over the textured outer edge 174 until the dead-stop element 163 contacts the second squared end 173 of the island 182 and prevents further rotation of the dial 105 in the second rotational direction R. This communicates to the user when the index spring 104 has released the spool 103 for de-tensioning by providing tactile feedback, also allows the user to know when to stop turning the dial 105 in the second rotational direction R. Once the tension spring 156 has ridden over the textured outer edge 174 of the island 182, further rotation of the dial 105 in the second rotational direction R is prevented when the island 182 contacts the dead-stop element 163 of the index spring 104.

Figure 10C:
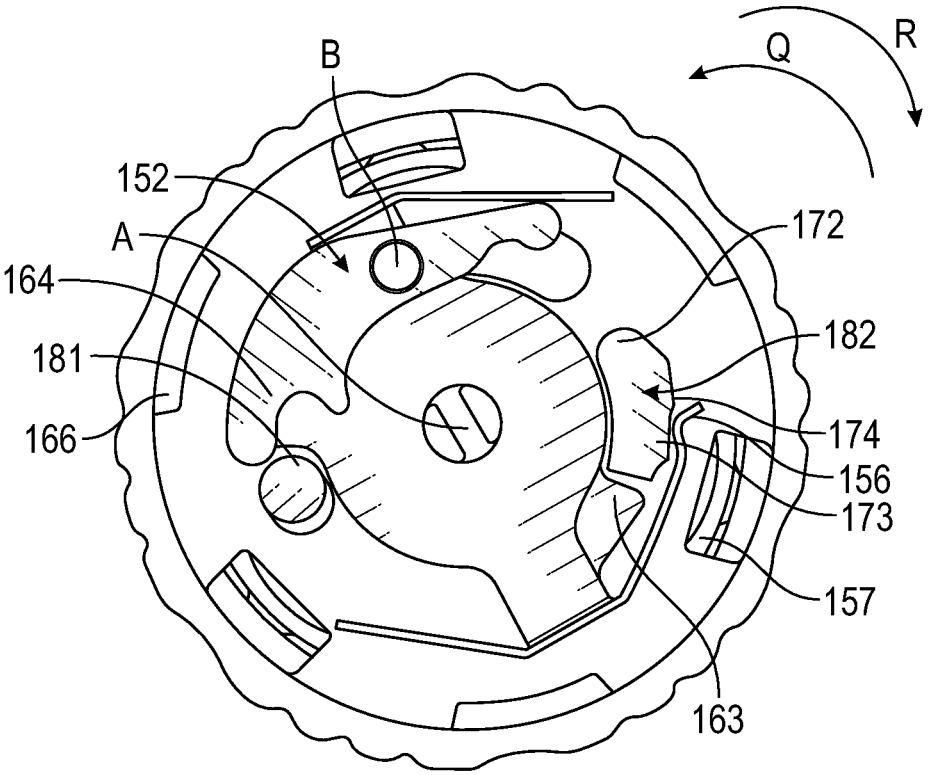
Figure 10D:
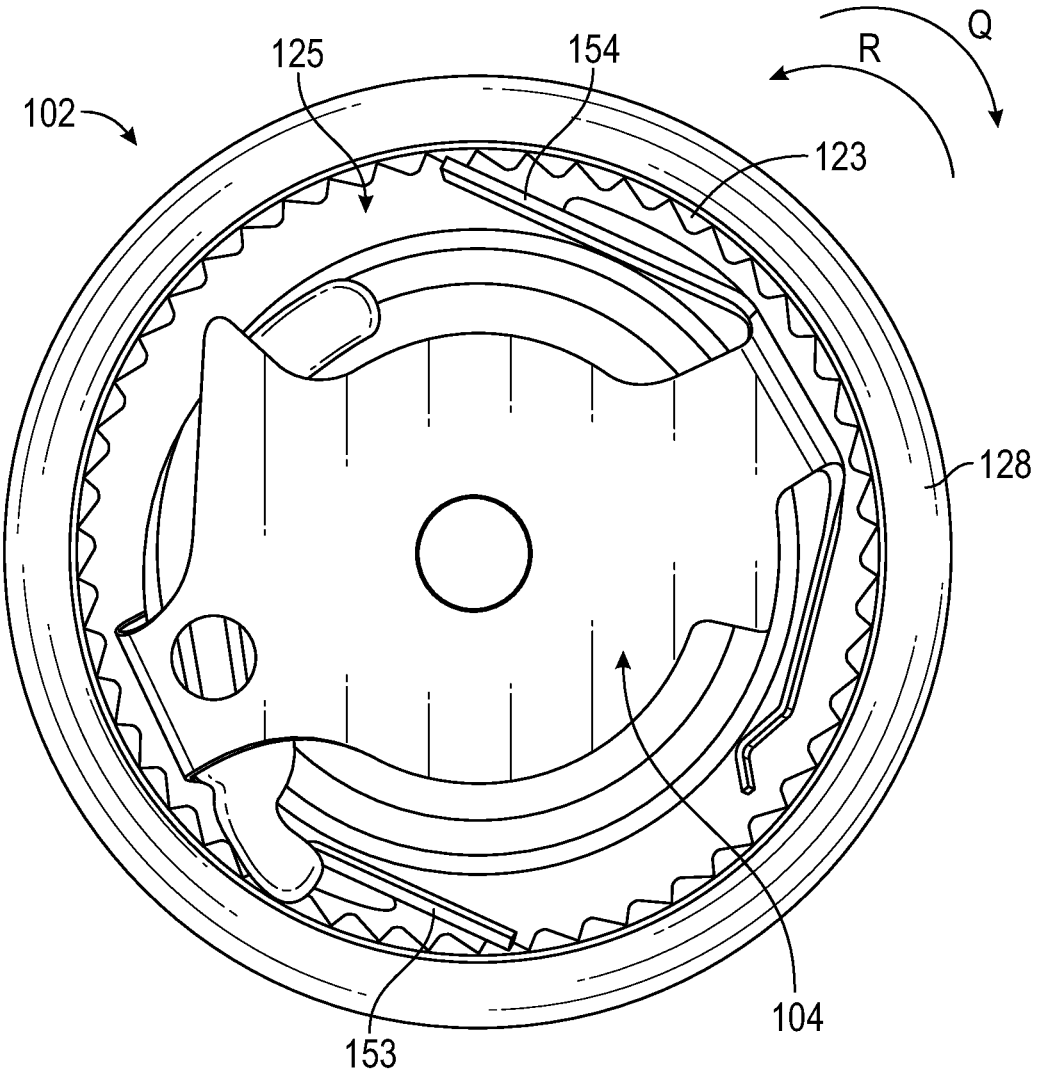
FIG. 10D is an illustration showing the index spring of the rotary closure of FIG. 1 disposed within the open housing of the rotary closure of FIG. 1.
Figure 11A:
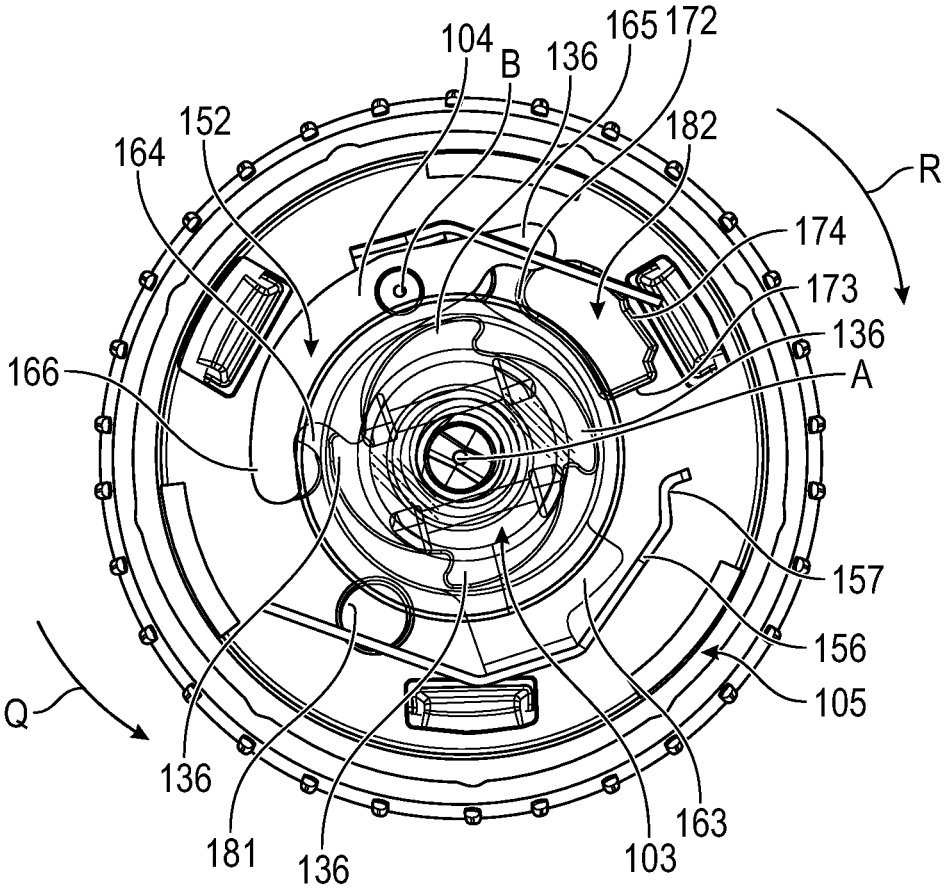
FIGS. 11A and 11B are respective illustrations showing the index spring, spool and dial of FIG. 1 in a first "rotating" position with a pawl of the index spring being rotated forward towards a post of the dial and capturing an extension of the spool, and a second "stop" position in which the index spring is rotated forward towards a post of the dial until a tension spring of the index spring rides over the island of the dial and the pawl spring is released from the extension of the spool.
Figure 11B:
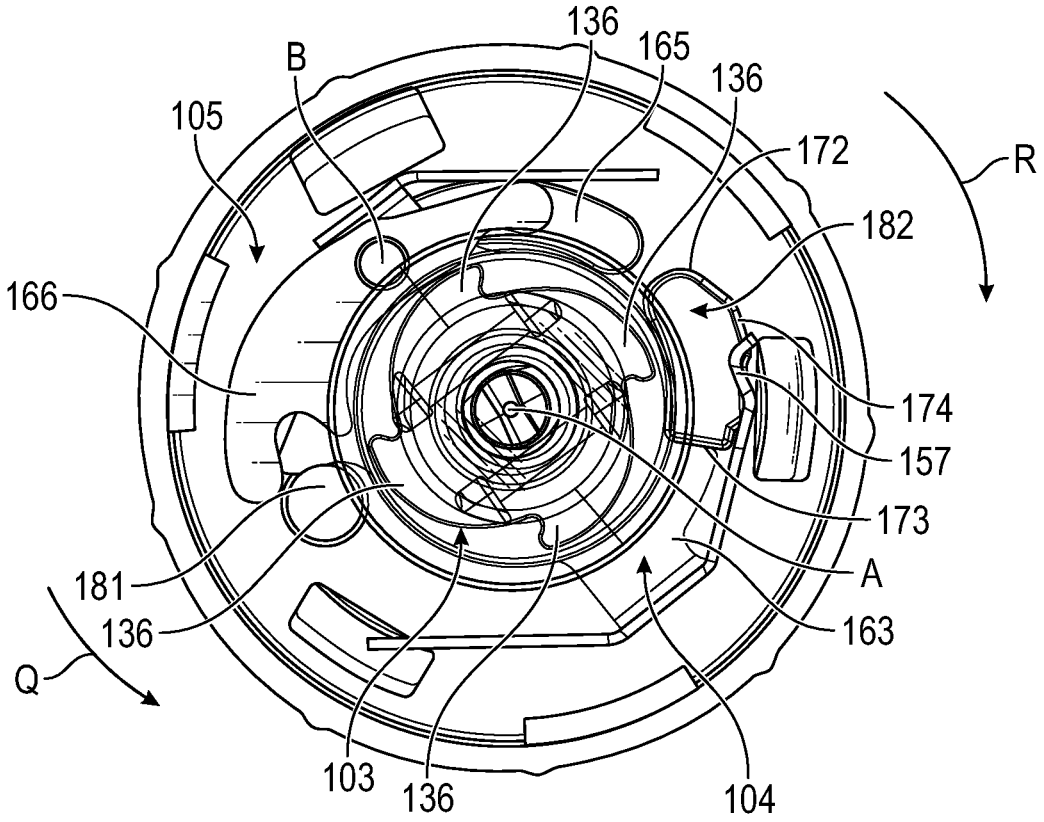

As further shown in FIGS. 10C and 11B, the spool 103 is released and allowed to freely counter-rotate when the dial 105 is rotated in the second rotational direction R. During rotation in the second rotational direction R, the post 181 of the dial 105 contacts the pawl member 152 and causes the pawl member 152 to pivot away from the common center axis A to release the extension 133 of the spool 103 from the pawl member 152. As shown, the elongated protrusion 164 extends from the body 150 of the index spring 104 and contacts the post 181 as the pawl member 152 is rotated away from the extension 133 of the spool 103 by the post 181 of the dial 105. This further prevents excessive counter-rotation of the dial 105 in the second rotational direction R relative to the index spring 104 and housing 102 and prevents the pawl recess 169 of the pawl member 152 from fully engaging the post 181 when in the configuration of FIG. 11B. As further shown, the interior surface 178 of the dial 105 defines a curved recess 180 and provides clearance for the pivot element 160 of the index spring 104.

Figure 8A:
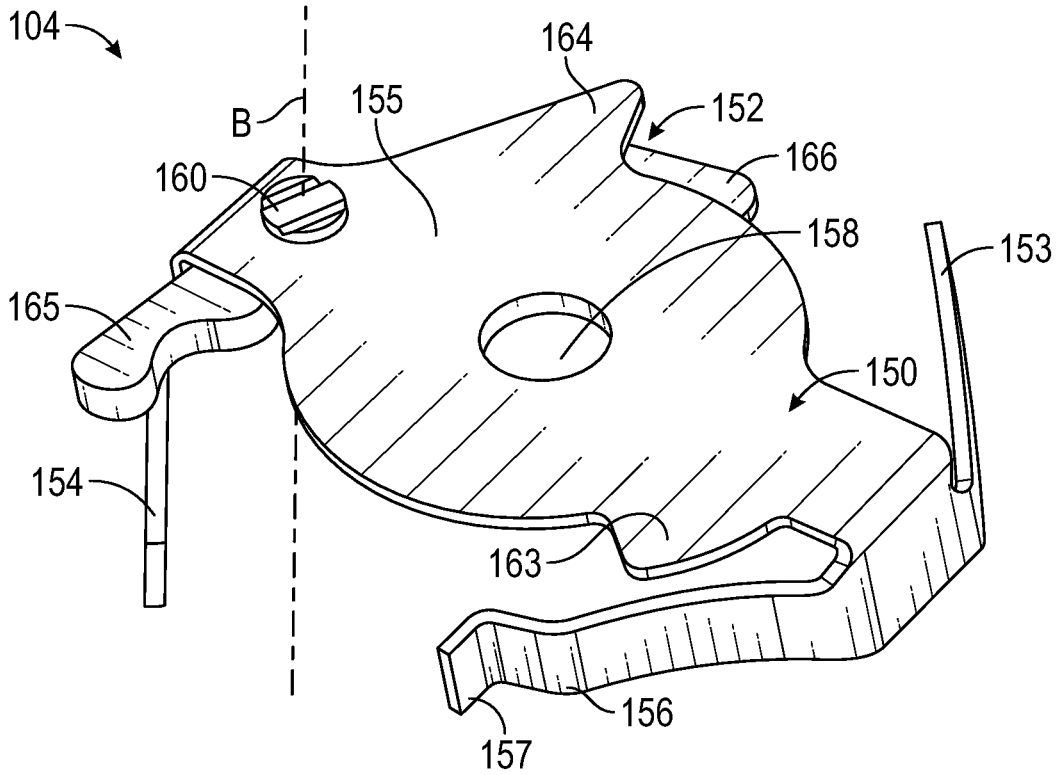
FIGS. 8A-8E are a series of illustrations showing first top perspective, second top perspective, bottom plan, top plan and side views of a first embodiment of an index spring of the rotary closure of FIG. 1 defining a dead-stop element that prevents over-counterrotation of the index spring.
Figure 8B:
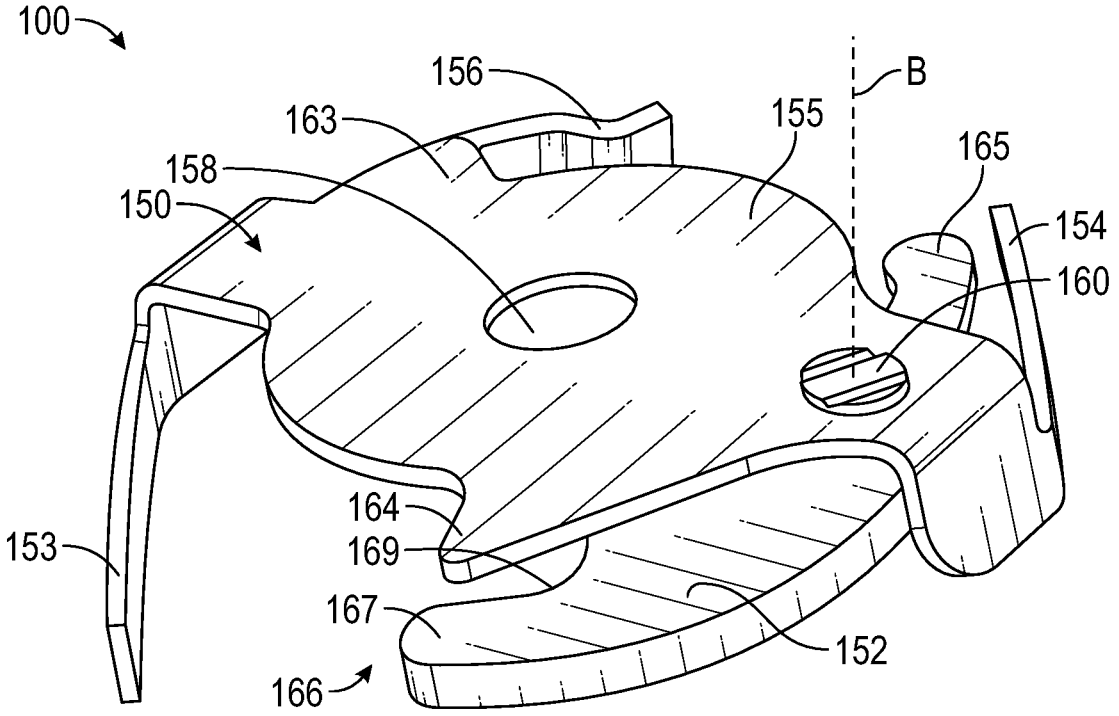
Figure 8C:
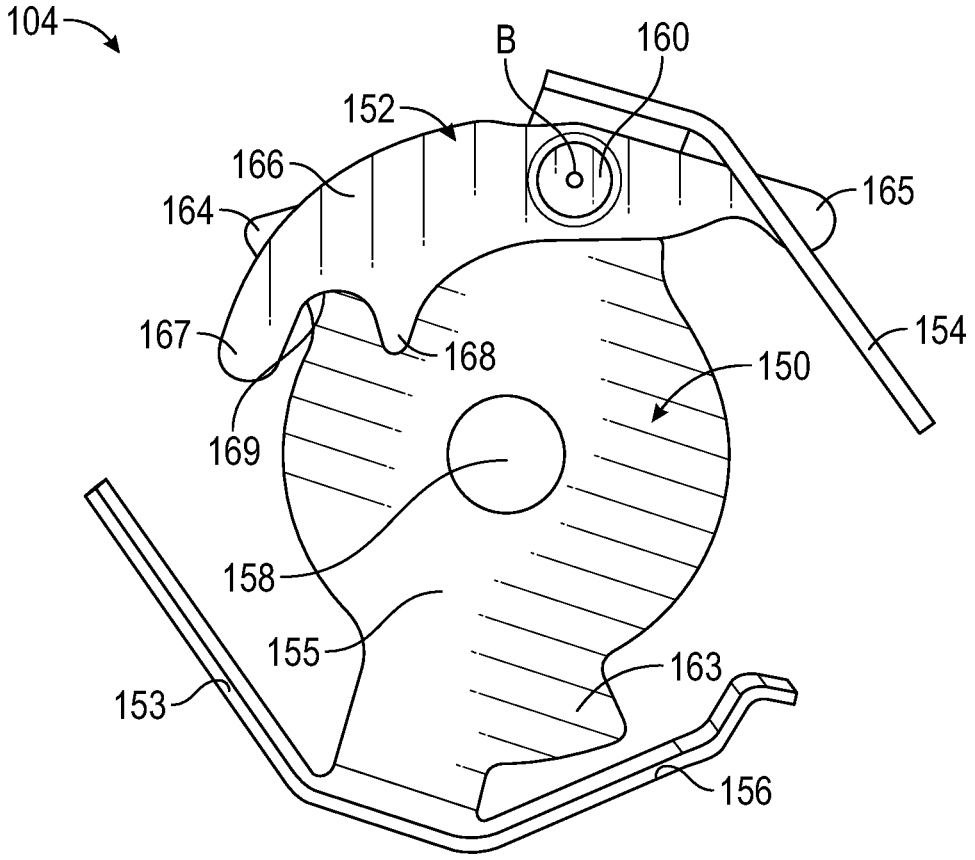
Figure 8D:
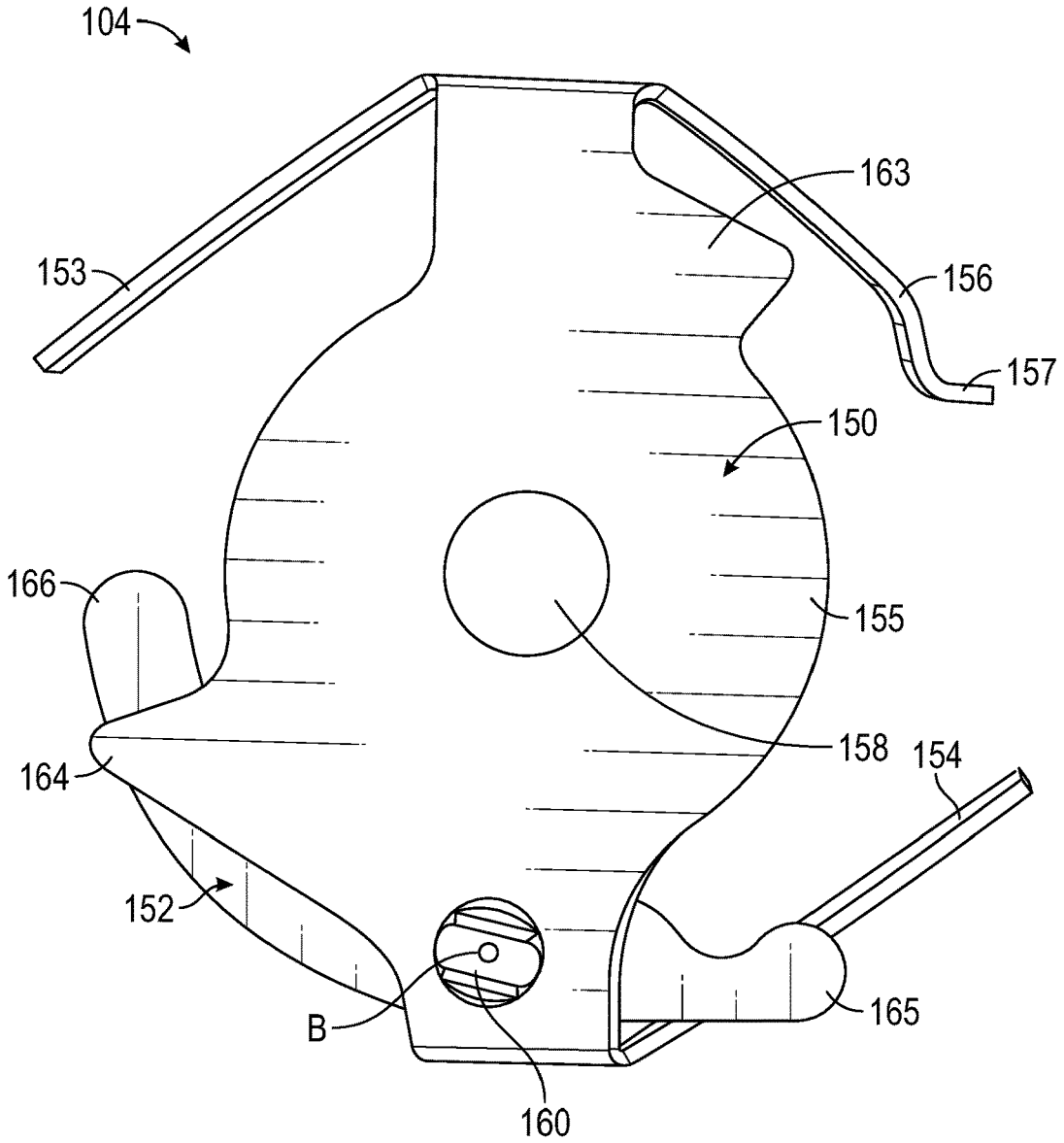
Figure 8E:
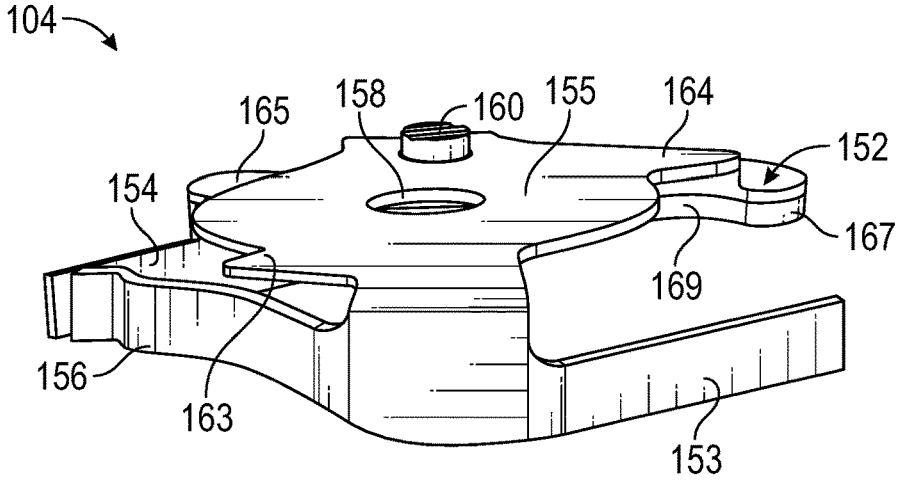
Figure 9A:
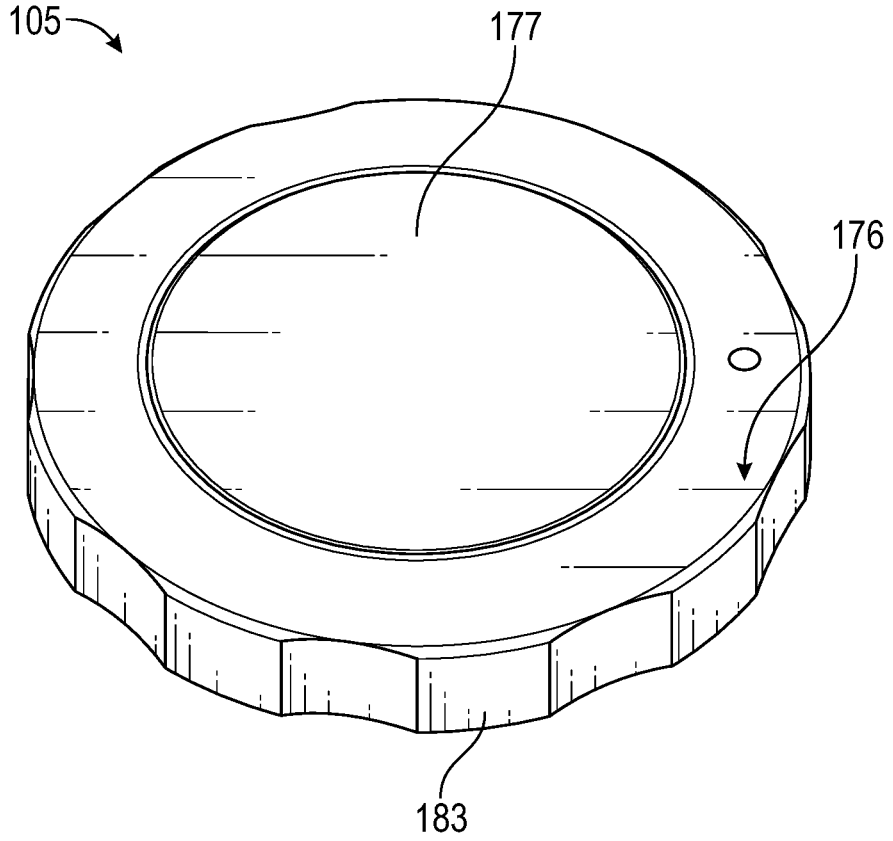
FIGS. 9A and 9B are top and bottom perspective views showing the dial of FIG. 1 having an integral latching extension.
Figure 9B:
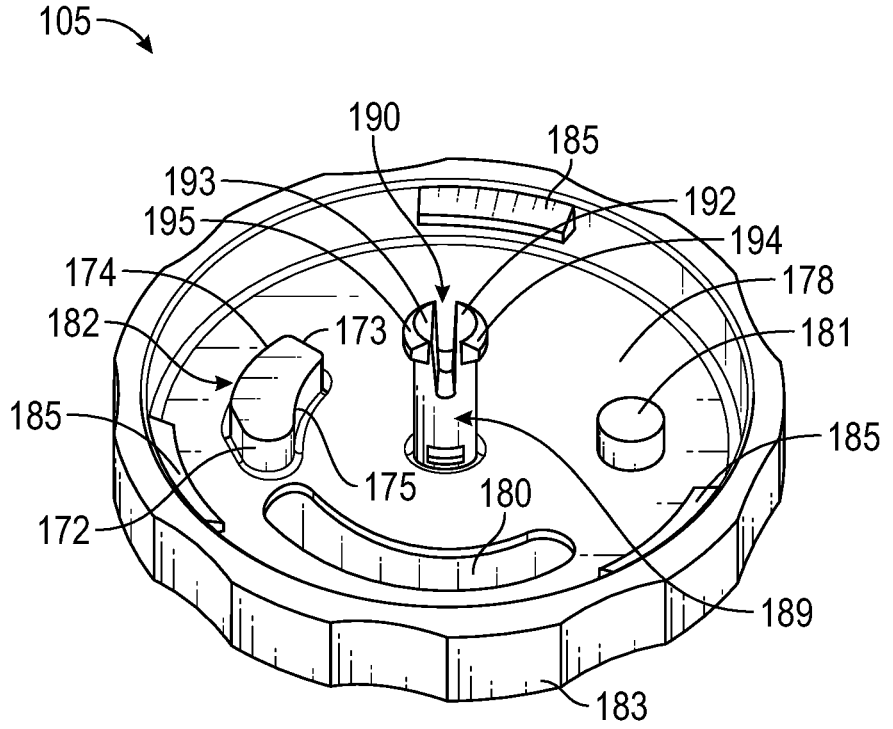

Referring to FIGS. 3 and 9B, the dial 105 includes the latching extension 189 that extends from the interior surface 178. The latching extension 189 is configured for insertion through a coaxial alignment of respective keyways 135 and 158 of the spool 103 and index spring 104. In the embodiments of FIGS. 3, 9A and 8B, the dial 105 and latching extension 189 are integral with one another, however an embodiment featuring an alternative dial 305 with a separate latching extension 389 that is integral with a cover 307 that couples with the dial 305 is further illustrated in FIGS. 25A-26D.

As shown in FIGS. 3, 4B and 9B, the latching extension 189 includes the latching element 190 defined at a distal free end of the latching extension 189. In some embodiments, the latching element 190 is bifurcated; in particular, the latching element 190 defines the first leg 192 and the opposite second leg 193. Each first and second leg 192 and 193 includes a respective first and second tang 194 and 195. The first and second tangs 194 and 195 cause the first and second legs 192 and 193 to be forced together when inserted into the distal-most keyway 135 of the spool 103. The first and second legs 192 and 193 of the latching element 190 are tensioned such that when the latching element 190 is inserted through the distal-most keyway 135, the latching element 190 engages with the spool shoulder 138 such that the first and second tangs 194 and 195 defined by the first and second legs 192 and 193 are pushed apart, preventing disengagement of the spool 103 from the latching extension 189.

Referring to FIGS. 10C and 11B, when the dial 105 is rotated in the second direction R to release the spool 103, the dead-stop element 163 contacts the second squared end 173 of the island 182 of the dial 105 such that further counter rotation of the dial 105 relative to the index spring 104 is prevented. Tactile feedback is provided to the user when counter-rotation of the dial 105 causes the tension spring 156 to ride up over the textured outer edge 174 of the island 182 of the dial 105.

As illustrated in FIGS. 10B and 11A, when the dial 105 is rotated in the first rotational direction Q relative to the index spring 104, the proximal portion 165 of the pawl member 152 contacts the first rounded end 172 of the island 182 of the dial 105 and is consequently rotated about the pivot axis B such that the opposite distal portion 166 of the pawl member 152 is rotated inward towards the common center axis A. This causes the index spring 104 to rotate with the dial 105 in the rotational direction Q about the common center axis A that aligns with the latching extension 189. As rotation in the first rotational direction Q continues, the pawl recess 169 of the pawl member 152 catches a curved tooth 136 of the extension 133 and forces the spool 103 to rotate with the index spring 104 and dial 105 in the rotational direction Q to wind the tensioning element around the spool 103.

The index spring 104 further includes the elongated protrusion 164 associated with the pawl member 152 for preventing over-counter-rotation of the index spring 104 in the rotational direction R relative to the dial. When the index spring 104 is rotated in the rotational direction R and the tension spring 156 rides up over the island of the dial 105, the opposite distal portion 166 of the pawl member 152 contacts the post 181 of the dial 105 and is rotated away from the keyway 158. This "rotating away" action causes the pawl member 152 to fully disengage from the extension 133 of the spool 103 and allows the spool 103 to counter-rotate freely to loosen tensioning elements.

Referring to FIGS. 1-4B, in one method of assembly of the rotary closure 100, the open housing 102 allows manufacturers to assemble the dial 105, the index spring 104 and the open housing 102 together in a snap-fit engagement as the subassembly 101. The subassembly 101 enables a manufacturer to ensure that the dial 105, index spring 104 and the open housing 102 are working properly prior to full assembly of the rotary closure 100. The spool 103 and associated tensioning element (not shown) can thereafter be coupled with the subassembly 101 either by the manufacturer or by a consumer. The formation of the subassembly 101 also enables the consumer to remove and/or replace the spool 103 in case of jamming or to replace the tensioning element without complete disassembly of the open housing 102 from the dial 105 and the index spring 104, thus reducing a likelihood of destruction of the rotary closure 100.

The subassembly 101 is first assembled by coupling the index spring 104 with the dial 105. In one embodiment of the index spring 104, the pivot element 160 of the index spring 104 should align with the curved recess 180 of the dial 105. Inserting the latching extension 189 the keyway 158 of the index spring 104 secures the index spring 104 to the dial 105. The open housing 102 is coupled with the dial 105 by snapping the circumferential flange 128 of the open housing 102 to the interior surface 178 of the dial 105 by the one or more engagement elements 185 of the dial 105 as discussed above and as illustrated in FIG. 4A. Following formation of the subassembly 101, the spool 103 can be coupled with the subassembly 101 by insertion of the latching extension 189 of the dial 105 through the distal-most keyway 135 of the spool 103 until the latching element 190 is secured with the spool shoulder 138 of the spool 103 as shown in FIG. 4B. The subassembly 101 and spool 103 can then be coupled with the flange 106 by snapping the first retention member 109 and opposite second retention member 110 of the flange 106 into the opposing first and second closed slots 127A and 127B of the open housing 102. In some embodiments, the flange 106 can be stitched into a shoe (not shown) or can be present on another device that requires tightening of a tensioning element such as a container.

Some examples shown for rotary closure 100 of FIGS. 1-11B (FIGS. 10A-10C, 11A and 11B in particular), are from an underside perspective of the dial 105 and show the first rotational direction Q indicating a counterclockwise rotational direction and the opposite second rotational direction R indicating a clockwise direction. Note that if the dial 105 shown in FIGS. 10A-10C, 11A and 11B were to be turned with the exterior side 177 facing the viewer as would be the case when being wound by the user, the first rotational direction Q would indicate a clockwise rotational direction and the opposite second rotational direction R would indicate a counterclockwise direction. To wind the rotary closure 100, the user rotates the dial in the first rotational direction Q which is clockwise from the perspective of the assembled rotary closure 100 of FIG. 2. To release the rotary closure 100, the user rotates the dial in the opposite second rotational direction R which is counterclockwise from the perspective of the assembled rotary closure 100 of FIG. 2. In other words, for a right-handed rotary closure such as rotary closure 100 in an assembled position such that the viewer is facing the exterior side 177 of the dial 105, first rotational direction Q=clockwise and opposite second rotational direction R=counterclockwise.

However, it should be noted that the rotary closure 100 of FIGS. 1-11B could also be oriented suitable for a left-handed wearer or when it is otherwise most convenient to wind the dial in a counterclockwise direction. In the case of a "left-handed" orientation, to wind the rotary closure, the user would rotate the dial in the first rotational direction Q which would be counterclockwise from the perspective of the assembled rotary closure. To release the left-handed rotary closure, the user would rotate the dial in the opposite second rotational direction R which would be clockwise from the perspective of the assembled rotary closure. In other words, for a left-handed rotary closure analogous to but mirrored from rotary closure 100 in an assembled position such that the viewer is facing the exterior side of the dial, first rotational direction Q=counterclockwise and opposite second rotational direction R=clockwise.

A left-handed rotary closure following the rotary closure 100 of FIGS. 1-11B would include the same components but completely mirrored across the vertical axis, including a flange analogous to flange 106, a dial analogous to dial 105, an index spring analogous to index spring 104, a spool analogous to spool 103, and a housing analogous to housing 102. However, given that the first and opposite second directions of rotation Q and R for a left-handed rotary closure are reversed relative to their illustrated counterparts, the components of the of the left-handed rotary closure including directions of involved teeth, springs and pawl components of the housing and index spring are mirrored across the vertical axis.

For instance, the plurality of teeth 123 of the housing 102 of the "right-handed" orientation shown in FIG. 10D point in a first direction to "catch" and prevent rotation of the catch spring 154 of the index spring 104 in the opposite second rotational direction R, which is R=counterclockwise in the illustrated example. However, as the rotary closure 100 could hypothetically be manufactured in the opposite orientation, the plurality of teeth of the housing of a "left-handed" orientation would point in an opposite direction from the plurality of teeth 123 of FIG. 10D to "catch" and prevent rotation of a catch spring of the index spring in the opposite second rotational direction R, which would be R=clockwise in the case of the left-handed example. The catch spring of the left-handed rotary closure would also be mirrored such that the catch spring points in the opposite direction relative to the catch spring 154 of the right-handed rotary closure 100.

This "mirrored" orientation would apply to the index spring, the housing, the dial, and the spool of the left-handed rotary closure, to enable a user to wind the left-handed rotary closure through counterclockwise revolution of the dial and to release the spool of the left-handed rotary closure through clockwise revolution of the dial; i.e. where first rotational direction Q=counterclockwise and where opposite second rotational direction R=clockwise.

A second embodiment of the rotary closure 200 is further described herein and illustrated in FIGS. 12-24B that includes an open housing 202 similar to the open housing 102 of the first embodiment of the rotary closure 100. The rotary closure 200 includes an alternate index spring 204 and a corresponding alternate dial 205 that provides an alternative cam-actuated mechanism for tensioning and de-tensioning a spool 203. Similarly, to assemble the rotary closure 200, the index spring 204 is coupled with the dial 205, which is in turn coupled with the open housing 202 in a snap-fit engagement to form a subassembly 201 illustrated in FIG. 15A that is analogous to the subassembly 101 of the first embodiment of the rotary closure 100 shown in FIG. 4A. A spool 203, analogous to and including all components of spool 103 of FIGS. 1, 3 and 4B, can then be disposed within an open spool passage 224 of the open housing 202 and engaged with a latching extension 289 of the dial 205. When assembled, the components of the subassembly 201 and the spool 203 are aligned along a common center axis A. The assembled spool 203 and subassembly 201 including the dial 205, index spring 204, and open housing 202 may then be coupled to a flange 206 (analogous to and including all components of flange 106 of FIG. 1), which is secured along an exterior portion of a shoe (not shown) or another item such as a container that may require tightening of a tensioning element. As shown in FIG. 14, when assembled, the subassembly 201 and flange 206 encapsulate the spool 203 between a flange floor 216 of the flange 206, the open spool passage 224 and the dial 205. The spool 203 includes a distal-most keyway 235 defining a spool shoulder 238 at a spool base 232 for engagement with a latching element 287 of the latching extension 289 such that as the latching extension 289 is inserted through the distal-most keyway 235, the latching element 287 couples with the spool shoulder 238.

The spool 203 is disposed within the open housing 202 and is operatively associated with the dial 205 that includes a cam path 280, and an improved index spring 204 located between the spool 203 and the dial 205 that operates with the cam path 280 of the dial to control a direction of rotation of the spool 203. The dial 205 is operable for rotation in a first rotational direction Q or an opposite second rotational direction R about the common center axis A. The index spring 204, in association with the dial 205, is operable to assume a first "spool winding" state or a second "spool release" state which control the direction of rotation of the spool 203.

Figure 16A:
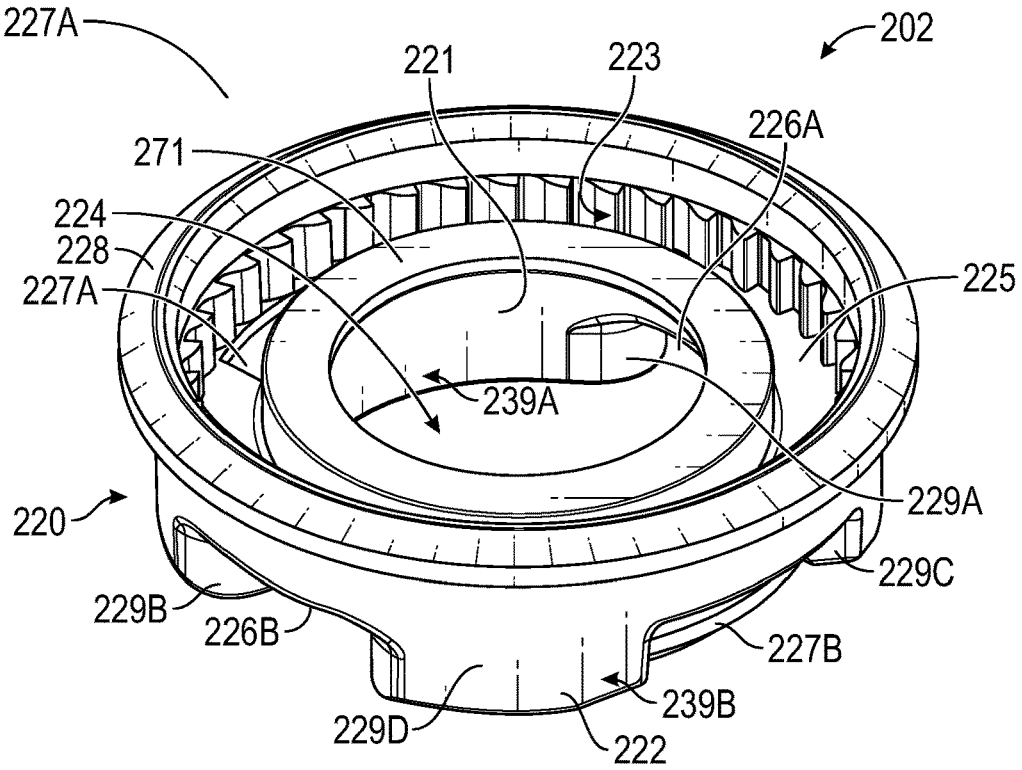
FIGS. 16A and 16B are a series of illustrations showing a top perspective view and a bottom perspective view of an open spool housing of the rotary closure of FIG. 12.
Figure 16B:
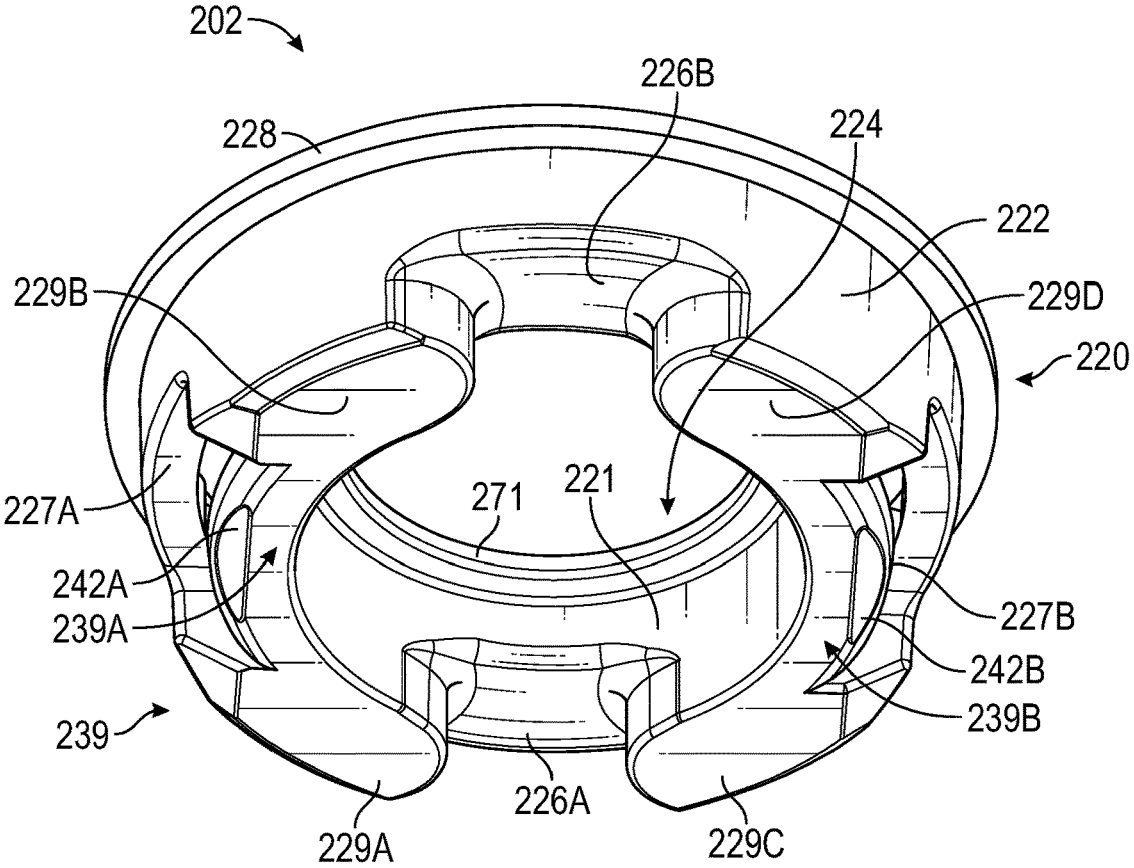
Figure 17A:
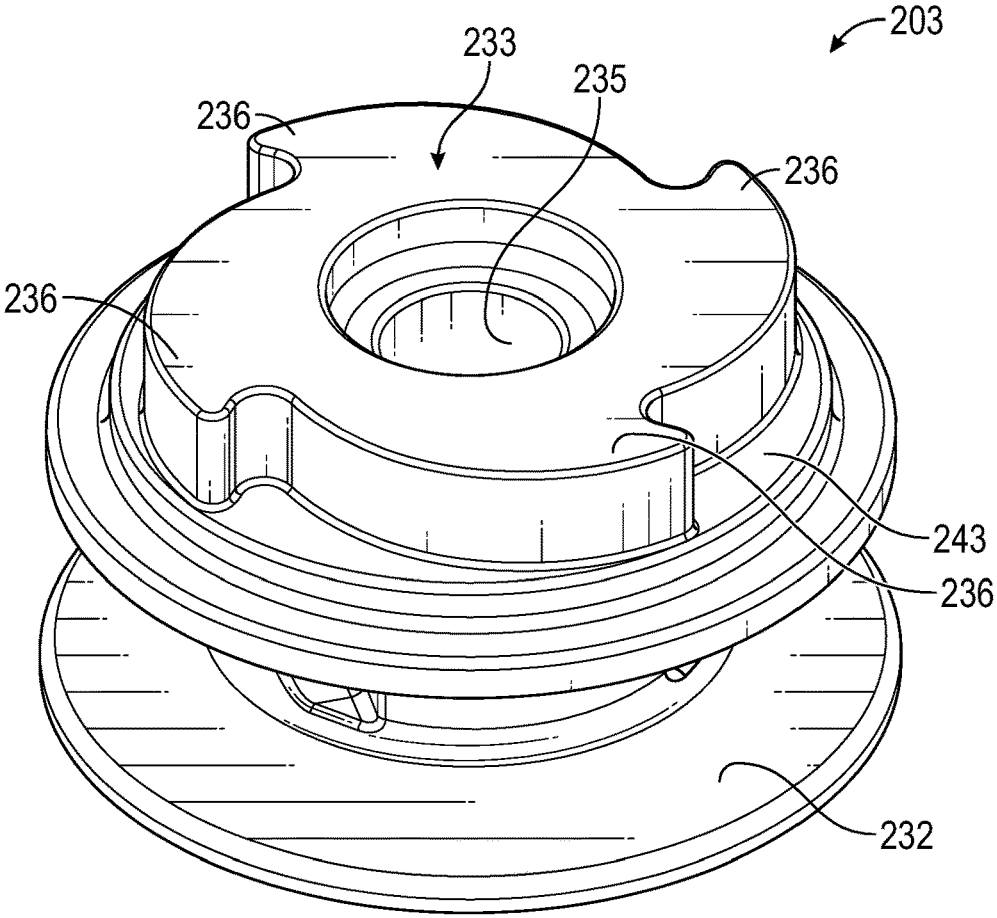
FIGS. 17A and 17B are a series of illustrations showing a top perspective view and a bottom perspective view of a spool of the rotary closure of FIG. 12.
Figure 17B:
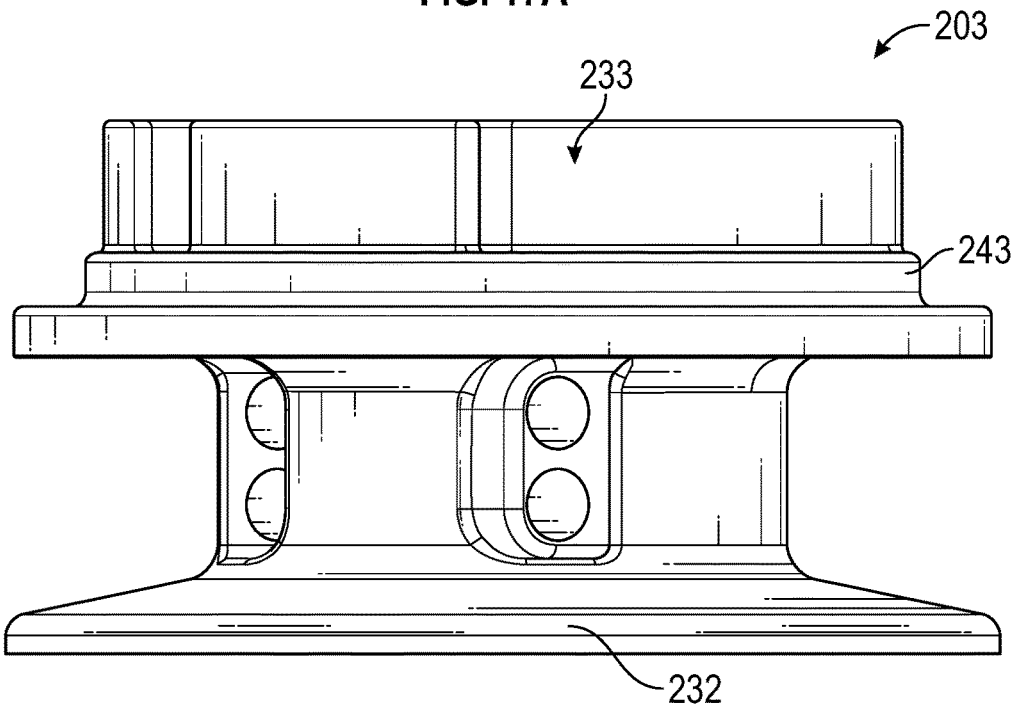

As illustrated, the open housing 202 and spool 203 of the second embodiment of the rotary closure 200 are very similar to their respective counterparts, open housing 102 and spool 103 of the first embodiment of the rotary closure 100. However, notable additions to the open housing 202 and spool 203 that were not shown in the first embodiment of the rotary closure 100 are the inclusion of additional centering features. As shown in FIGS. 17A and 17B, a spool flange 231 of the spool 203 (analogous to spool flange 131 of spool 103 of FIG. 7A) further includes a centering ridge 243 that enables alignment of the spool 202 within the open spool passage 224 of the open housing 204. FIGS. 16A and 16B show a circular inner wall 221 of the open housing 202 (analogous to circular inner wall 121 of the open housing 102 of FIG. 6A) further including an inner centering flange 271 that engages the centering ridge 243 of the spool 203 which enables the spool 203 to reliably seat within the open housing 202. It should be noted that the above centering features (centering ridge 243 and inner centering flange 271) could also be applied to open housing 102 and spool 103 of the first embodiment of the rotary closure 100.

Figure 15A:
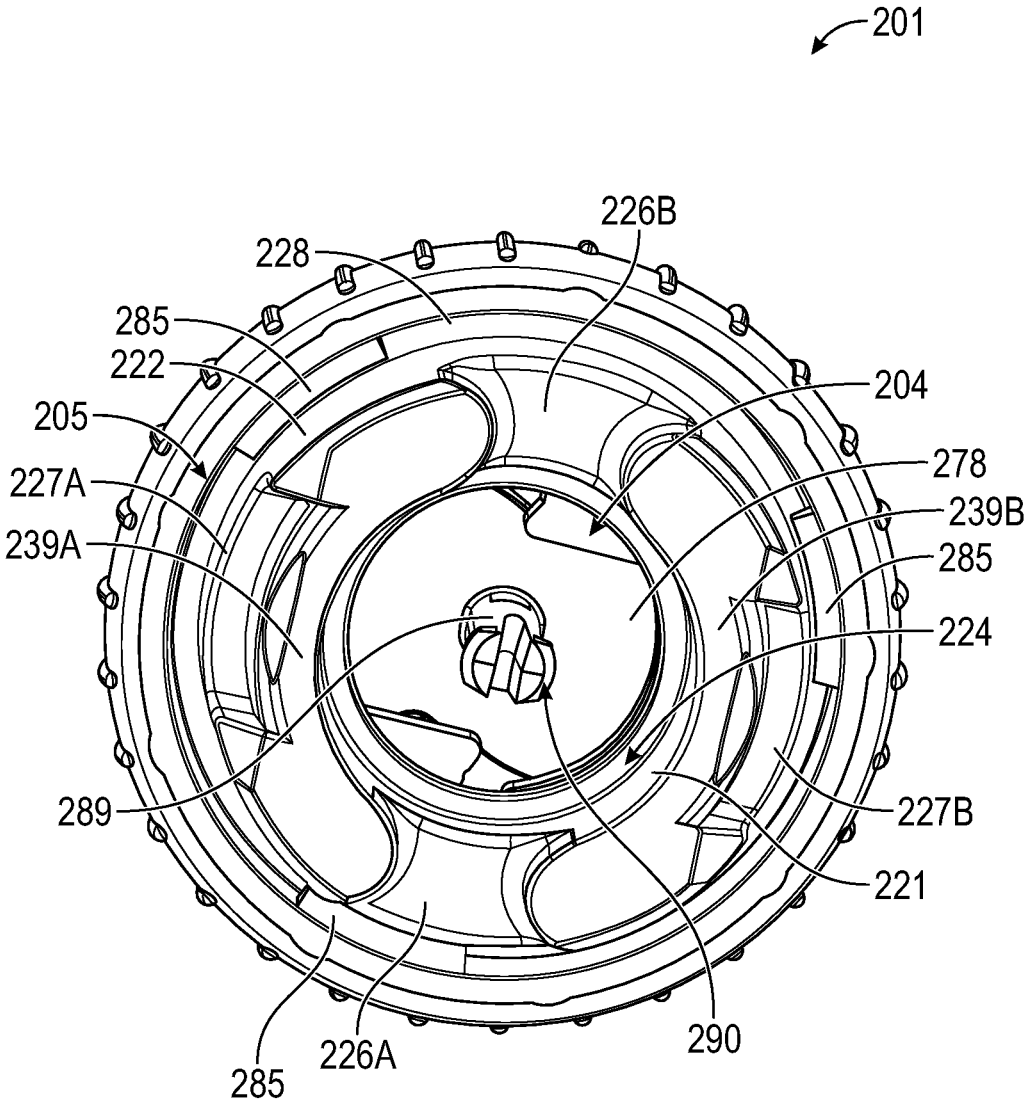
FIGS. 15A and 15B are a series of illustrations showing a bottom perspective view of a subassembly of the rotary closure of FIG. 12 prior to and after engagement of a spool with the subassembly.
Figure 15B:
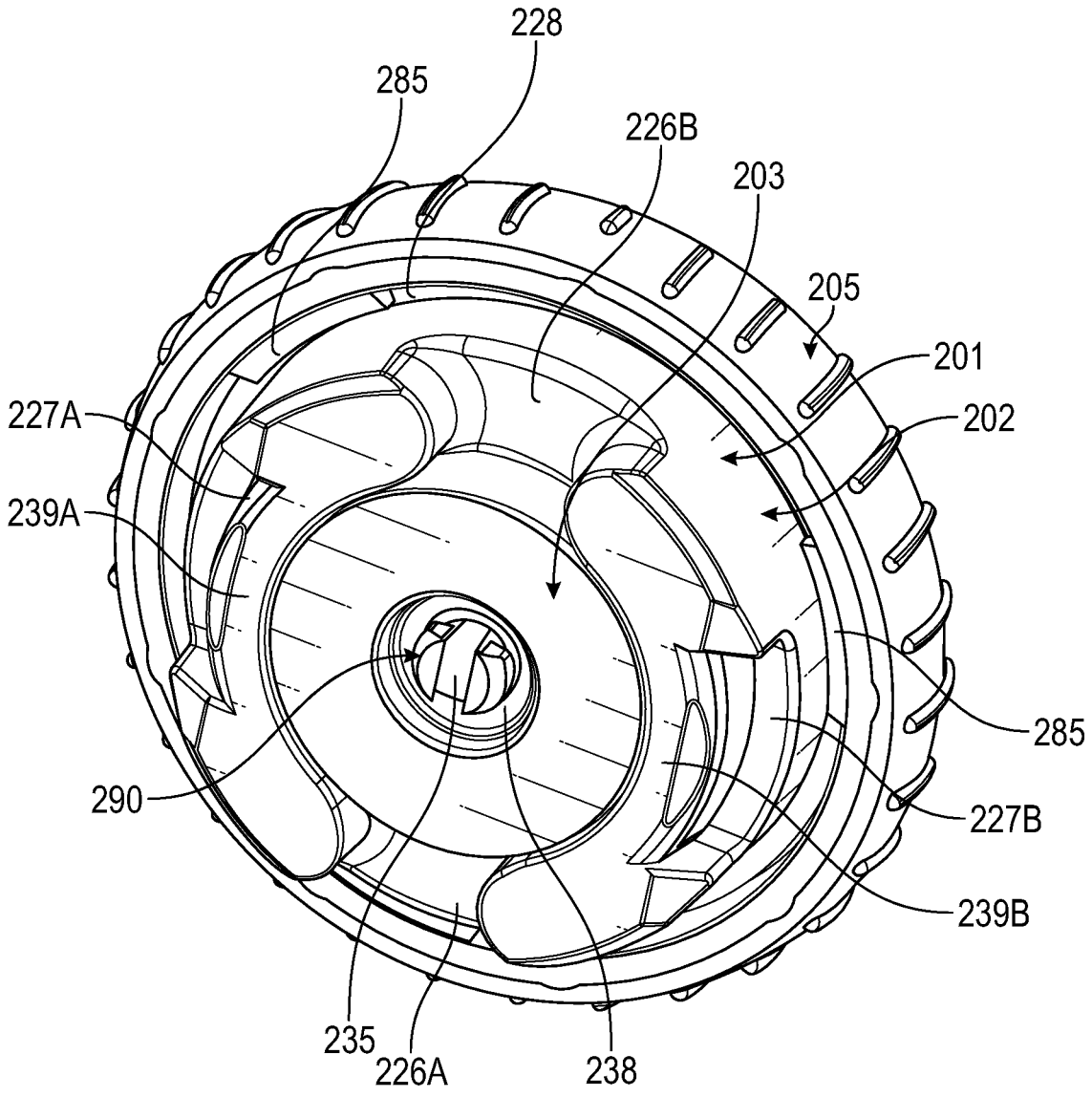

FIGS. 16A and 16B illustrate the open housing 202 for the rotary closure 100. In some embodiments, similar to that of the open housing 102 of FIGS. 6A-6D, the open housing 202 forms a generally circular body 220 defining the open spool passage 224 for receipt and rotation of the spool 203. The circular body 220 defines the circular inner wall 221 formed coaxially within a circular outer wall 222. As shown, the circular outer wall 222 defines the circumferential flange 228 around an exterior of the circular outer wall 222 which is configured for engagement with the dial 205; such an engagement is illustrated in FIG. 15. The circular outer wall 222 also defines a plurality of teeth 223 along an interior of the circular outer wall 222 that are configured for engagement with the index spring 204. The circular inner wall 221 forms a channel 225 between the circular outer wall 222 and the circular inner wall 221 for receipt of the index spring 204 (FIGS. 18A-18D). The open spool passage 224 is defined though the center of the open housing 202; a diameter of the open spool passage 224 enables placement and free rotation of the spool 203 within the open spool passage 224. As further shown in FIG. 15B, the open spool passage 224 partially encapsulates the spool 203 and permits access to an underside of the spool 203 while the spool 203 is disposed within the open housing 202. The open spool passage 224 of the open housing 202 allows the use of a taller spool 203 within the rotary closure 200 by eliminating unnecessary volume within the open housing 202. The plurality of teeth 223 of the open housing 202 are configured to operatively engage catch springs 253 of the index spring 204 as the dial 205, index spring 204 and spool 203 are caused to incrementally rotate in a first rotational direction Q while the tensioning elements are being tightened around the spool 203. The plurality of teeth 223 of the open housing 202 are angled to prevent counter-rotation of the index spring 204 in a second rotational direction R within the open housing 202.

In some embodiments, as shown in FIG. 16B, the open housing 202 defines a pair of opposing arcuate plateaus 239 formed on an underside of the channel 225 that seat within the flange floor 216 of the flange 206 (FIG. 14) and also partially encapsulate the spool 203. The pair of opposing arcuate plateaus 239 include a first arcuate plateau 239A and a second arcuate plateau 239B. The first arcuate plateau 239A defines a first shoulder 229A at a first end of the first arcuate plateau 239A and a second shoulder 229B defined at a second end of the first arcuate plateau 239A. Similarly, the second arcuate plateau 239B defines a third shoulder 229C at a first end of the second arcuate plateau 239B and a fourth shoulder 229D defined at a second end of the second arcuate plateau 239B. As shown, the first arcuate plateau 239A defines a first midsection 242A between the first shoulder 229A and the second shoulder 229B that collectively form a first closed slot 227A configured for engagement with a first retention member 209 (FIG. 14) of the flange 206 during assembly of the rotary closure 200. Similarly, the second arcuate plateau 239B defines a second midsection 242B between the third shoulder 229C and the fourth shoulder 229D that collectively define a second closed slot 227B configured for engagement with a second retention member 210 of the flange 206 during assembly of the rotary closure 100.

The first and second arcuate plateaus 239A and 239B collectively define a first open arch 226A and a second open arch 226B configured for passage of one or more lacing (tensioning) elements (not shown) between an interior of the open spool passage 224 and an exterior of the open housing 202. Specifically, the first shoulder 229A of the first arcuate plateau 239A and the third shoulder 229C of the second arcuate plateau 239B collectively form the first open arch 226A. Similarly, the second shoulder 229B of the first arcuate plateau 239A and the fourth shoulder 229D of the second arcuate plateau 239B collectively form the second open arch 226B. Referring briefly back to FIG. 15B, when assembled, the first and second open arches 226A and 226B enable access the tensioning element (not shown) and the spool 203 while the spool 203 is coupled within the open housing 202. The first and second open arches 226A and 226B result in a lesser likelihood that the tensioning element will become jammed, especially with both tensioning and de-tensioning functionalities required of the rotary closure 200.

FIGS. 18A-18D demonstrate the index spring 204 that engages the cam path 280 of the dial 205 to control rotation of the spool 203. The index spring 204 defines a generally circular spring body 250 defining a keyway 258 for insertion of the latching extension 289 of the dial 205. Further, the index spring 204 defines a pawl spring 251 (in the embodiment shown, a pair of pawl springs 251) located interior to the circular spring body 250. The pawl spring 251 is configurable in two states: (1) a first default state of the pawl spring 251 which engages the spool 203 for rotating the spool 203 in the first direction Q and prevents back-rotation of the spool 203 in the second direction R; and (2) a second tensioned state in which the dial 205 actuates the pawl spring 251 away from the common center axis A and releases the spool 203, allowing the spool 203 to rotate in the second direction R. As illustrated, the pawl spring 251 includes a cam follower 256 that extends from the pawl spring 251 and engages the cam path 280 of the dial 205. The pawl spring 251 includes the pawl member 252 at a distal portion of the pawl spring 251 in association with the cam follower 256. When the pawl spring 251 is in the first default state of FIGS. 23A and 24A, the pawl spring 251 directly engages one or more curved teeth 236 of an extension 233 of the spool 203 to force rotation of the spool 203 in the first rotational direction Q and to prevent back-rotation of the spool 203 in the second rotational direction R. In the first default state, the cam follower 256 of the pawl spring 251 is located at a first "spool winding" portion 281 along the cam path 280 of the dial 205. The pair of pawl springs 251 of the index spring 204 engage the spool 203 at two points rather than a single point (as is the case of index spring 104 of FIG. 1) to increase the strength of engagement when tightening the tensioning element. This also provides a balanced force against the spool 203 and within the rotary closure 200 as a whole instead of driving the spool 203 with only one engagement point.

Figure 23A:
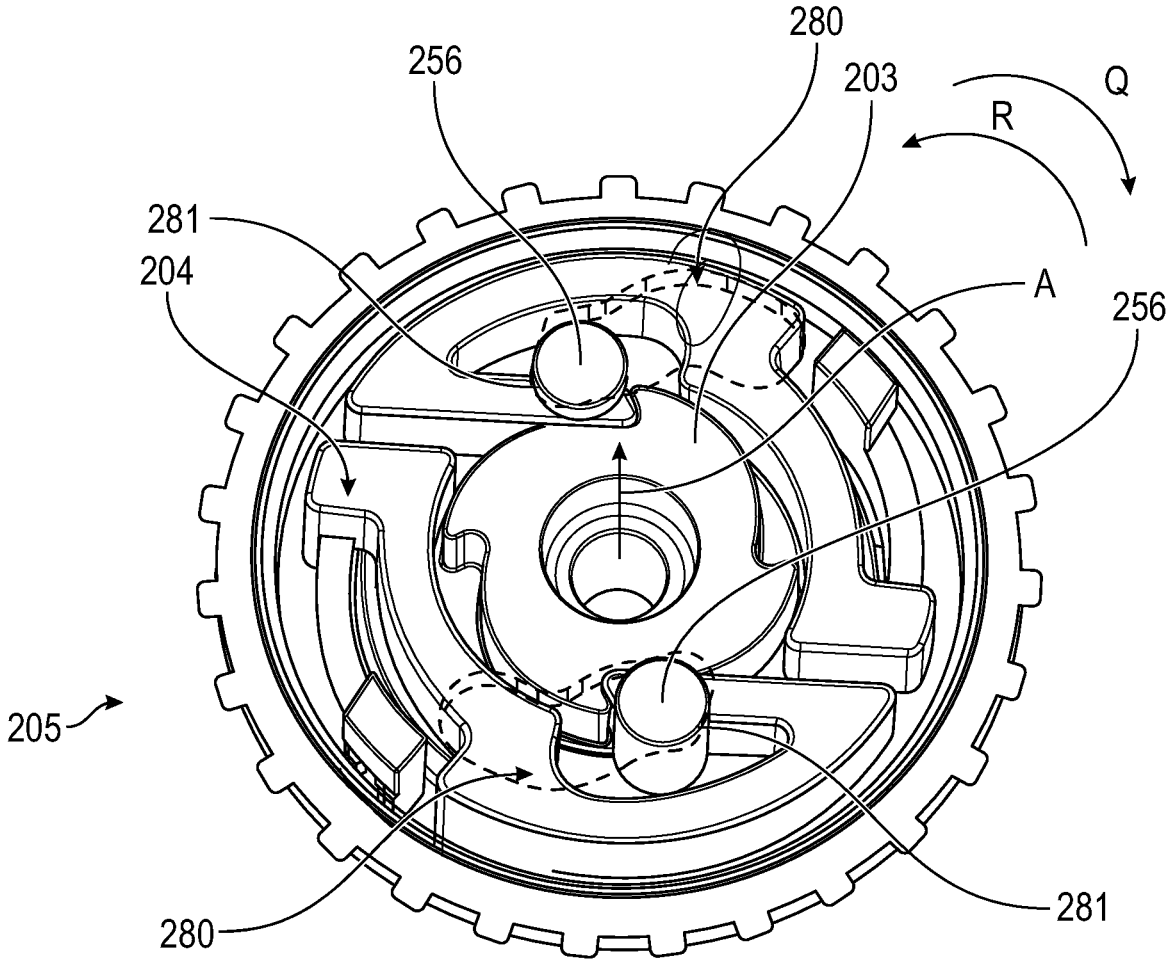
FIGS. 23A and 23B are a series of illustrations showing operation of the second embodiment of the index spring and the second embodiment of the dial of the second embodiment of the rotary closure of FIG. 12 in a first "spool tightening" state and a second "spool release" state.
Figure 23B:
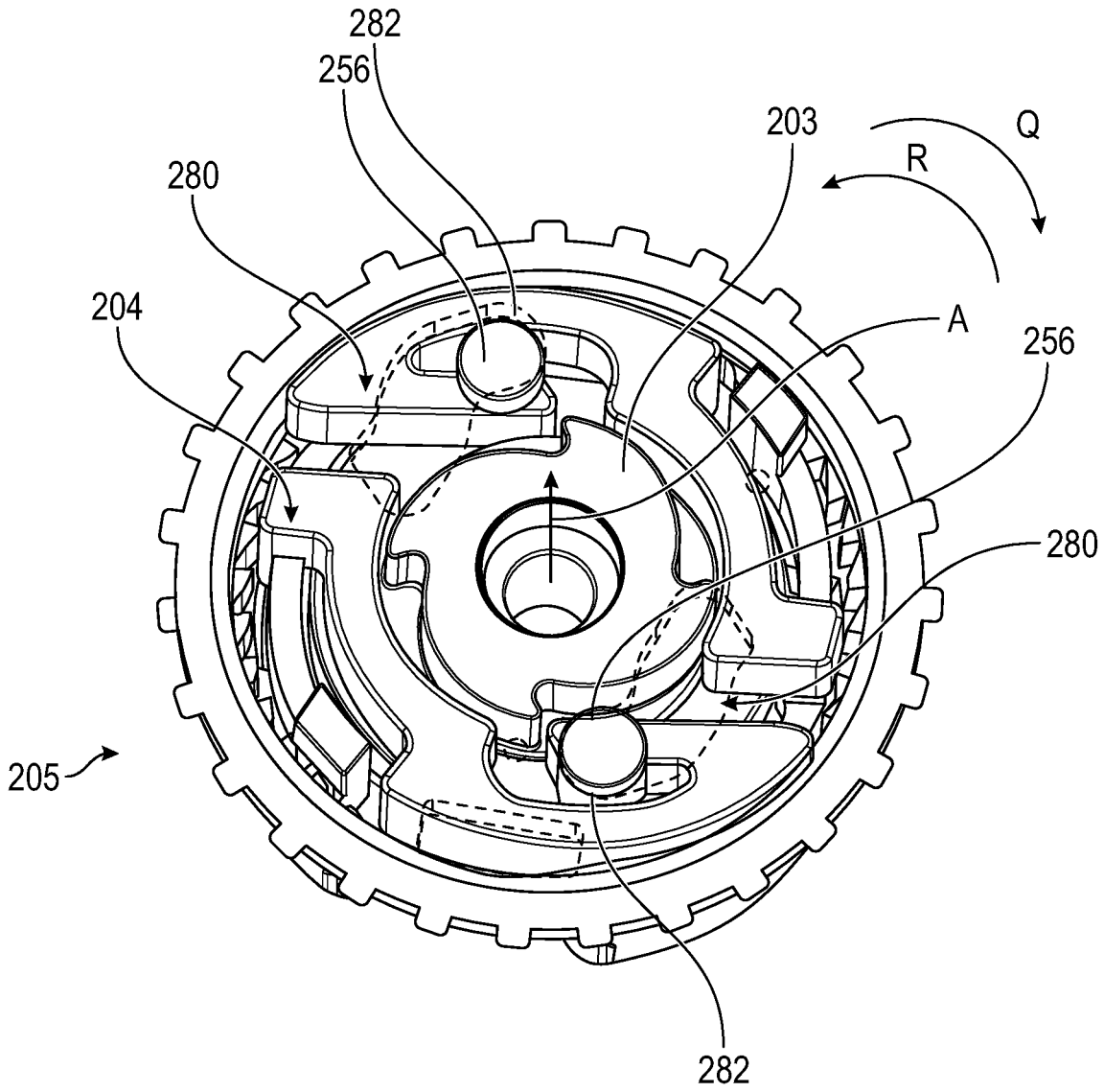
Figure 24A:
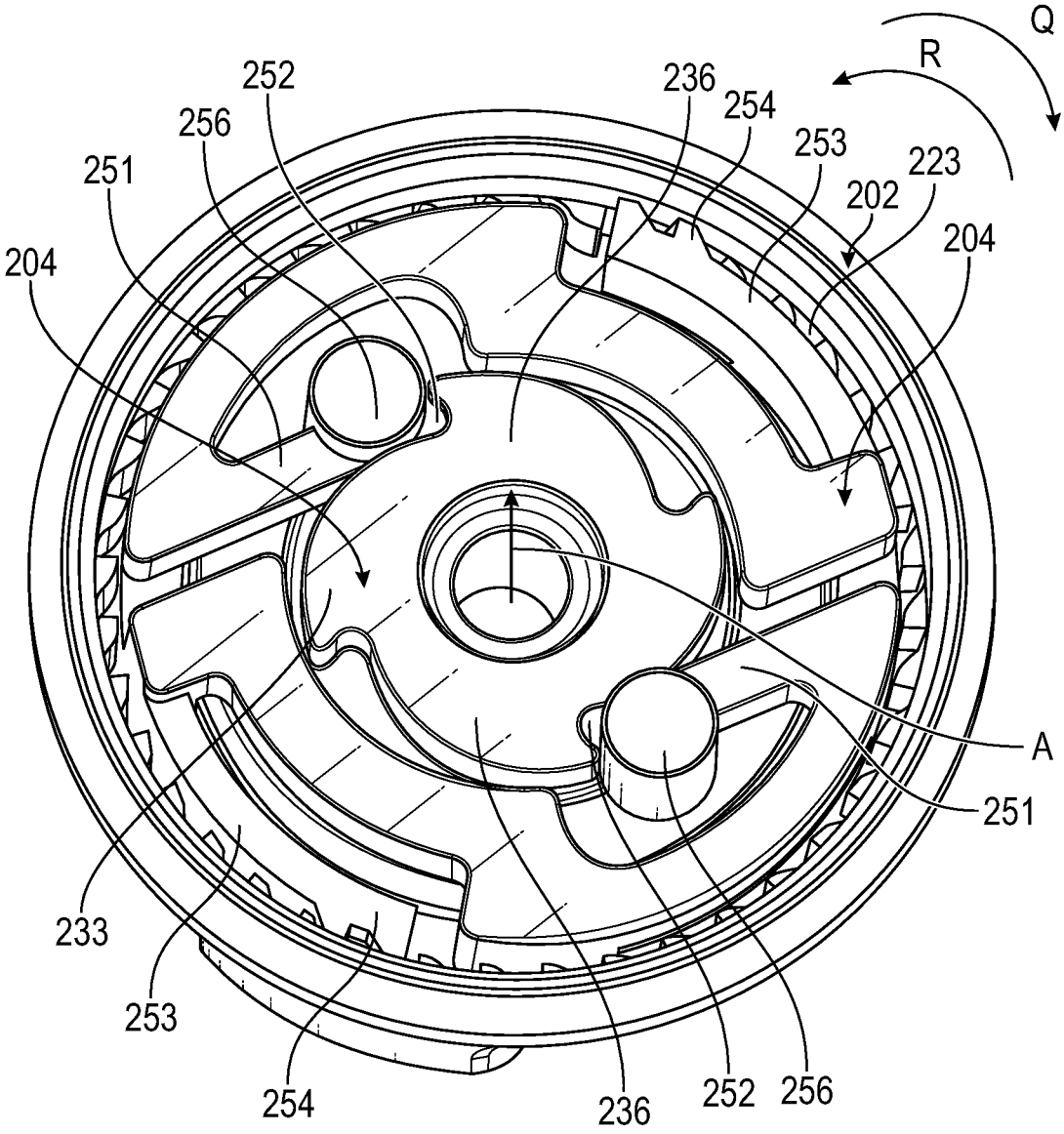
FIGS. 24A and 24B are a series of illustrations showing operation of the spool with the second embodiment of the index spring of the second embodiment of the rotary closure of FIG. 12 in a first "spool tightening" state and a second "spool release" state.
Figure 24B:
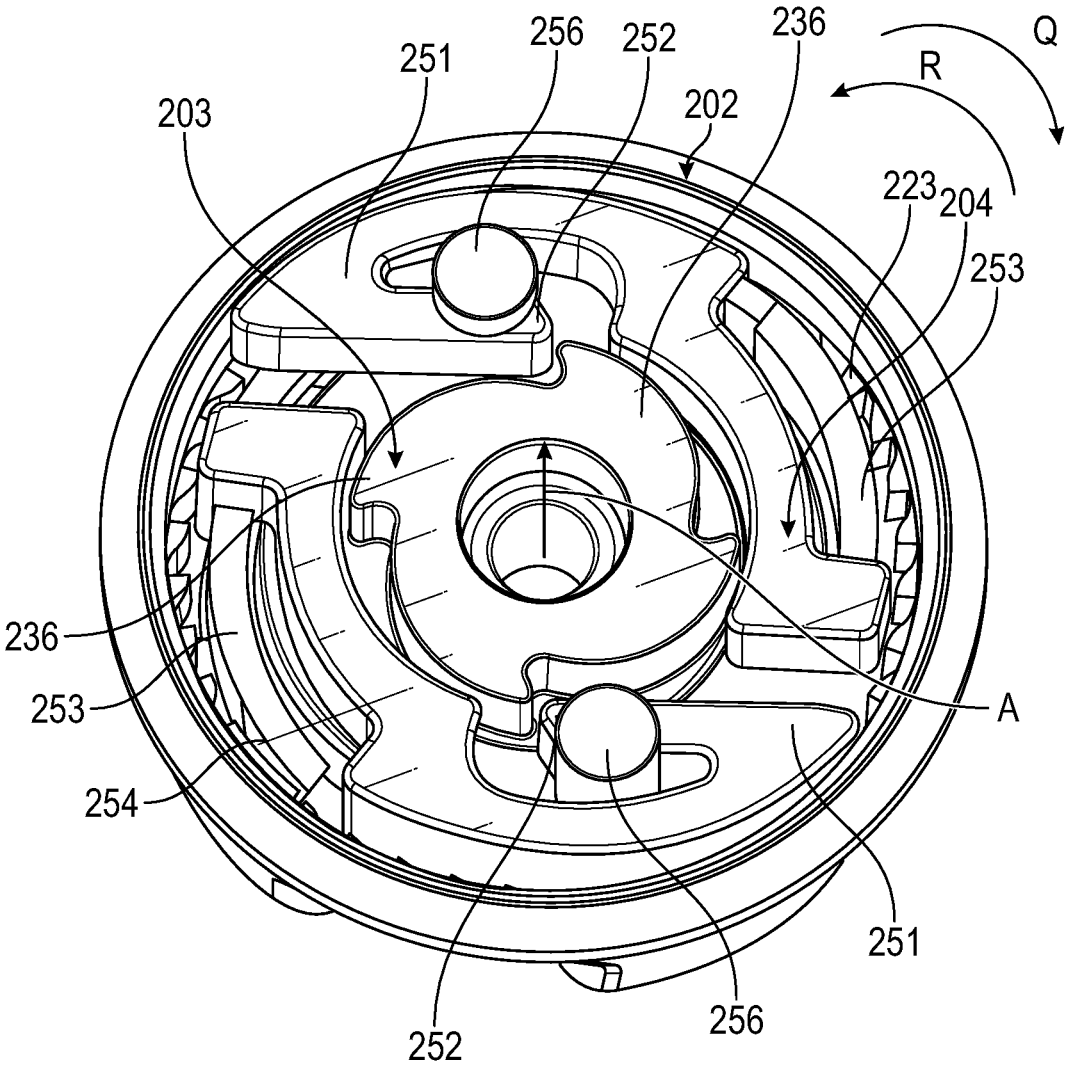
Figure 25A:
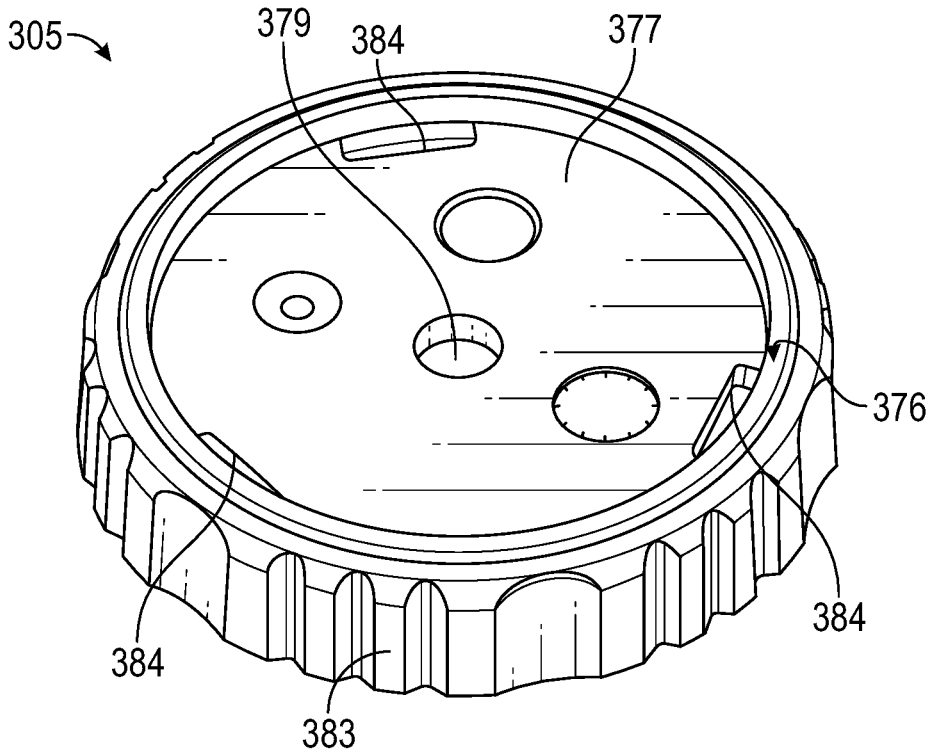
FIGS. 25A-25D are a series of illustrations showing top perspective, bottom perspective, bottom plan and top plan views of an alternate third dial of the rotary closure of FIG. 1.
Figure 25B:
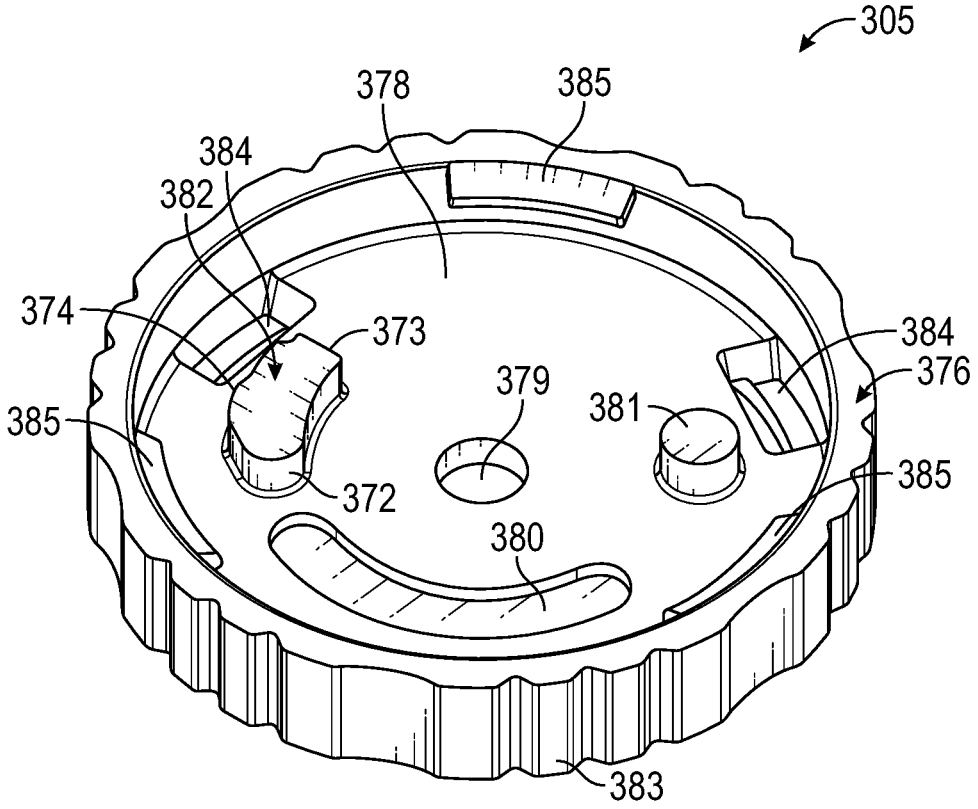
Figure 25C:
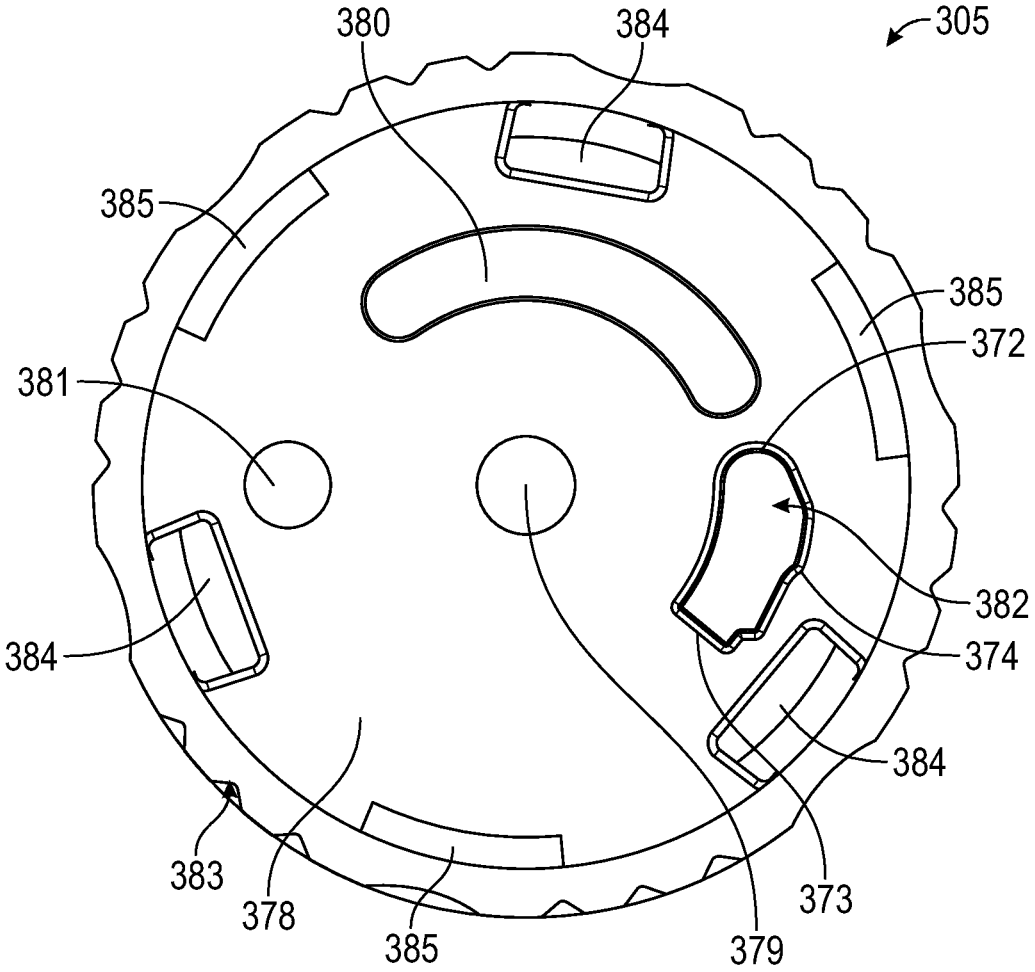
Figure 25D:
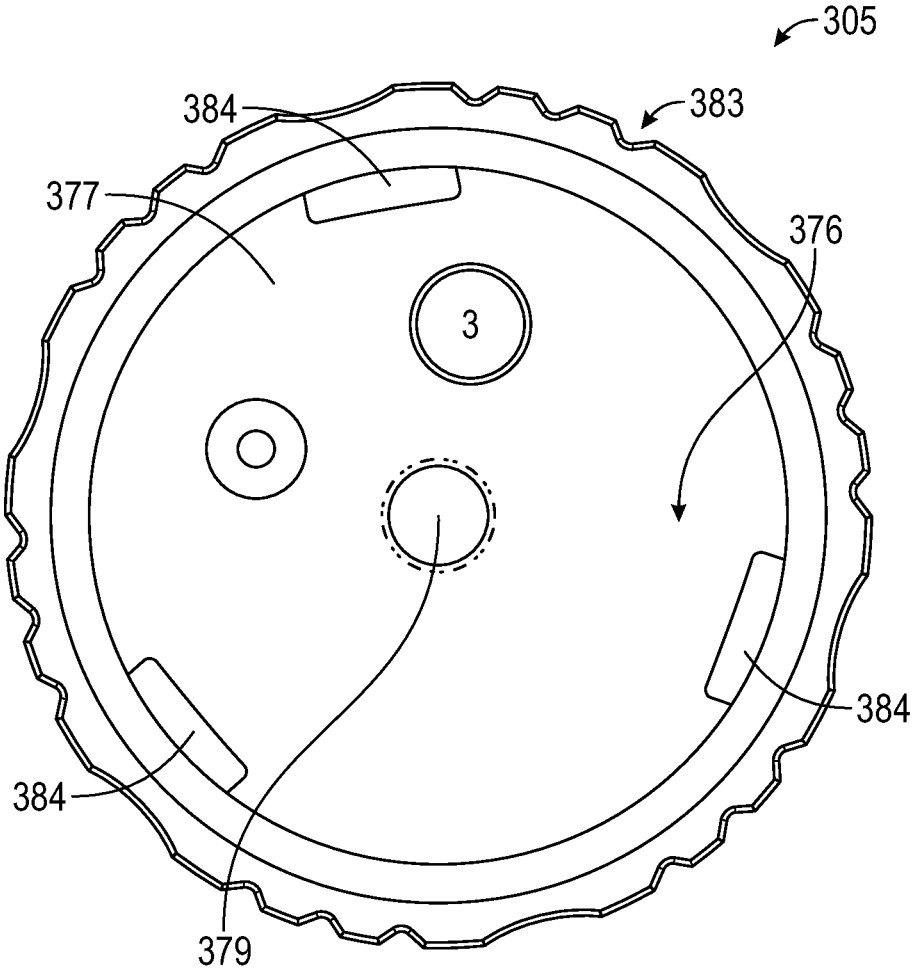
Figure 26A:
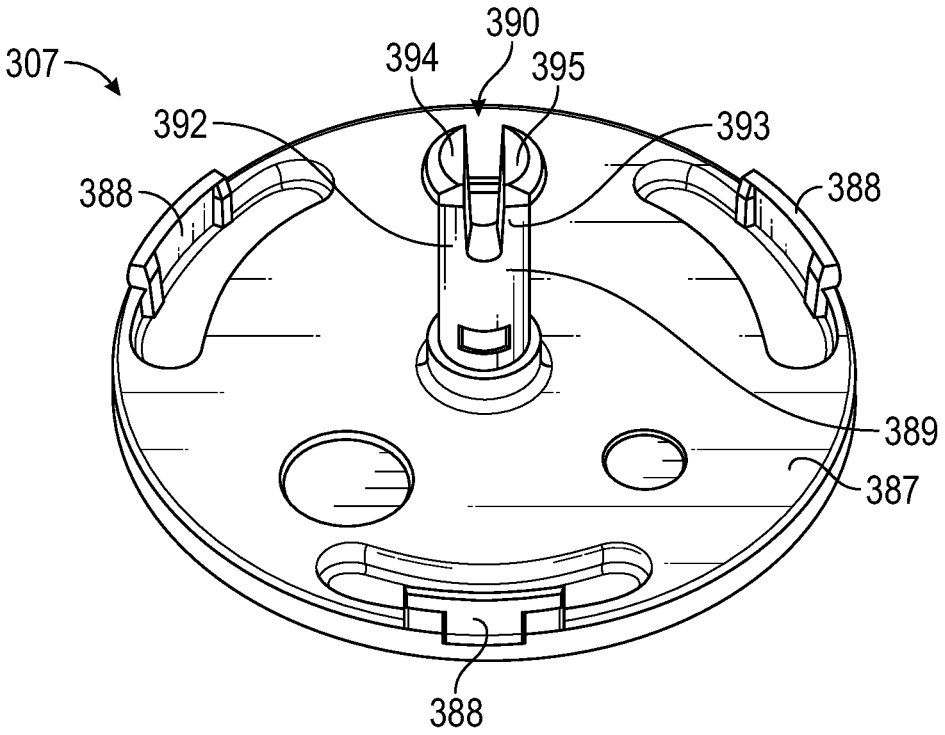
FIGS. 26A-26C are a series of illustrations showing bottom perspective, top perspective, and bottom plan views of a cover element featuring a bifurcated latching extension of the rotary closure of FIG. 1.
Figure 26B:
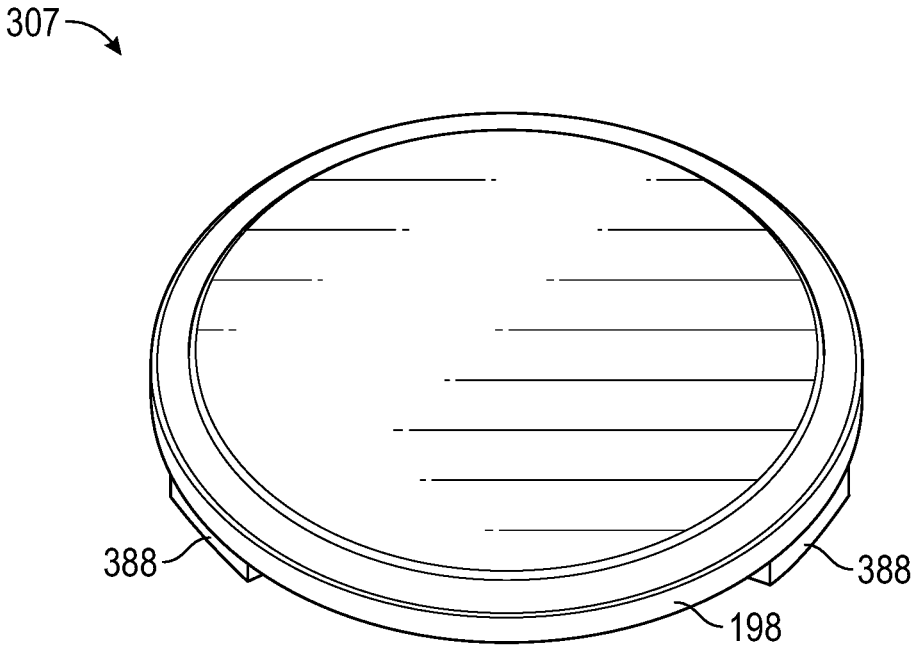
Figure 26C:
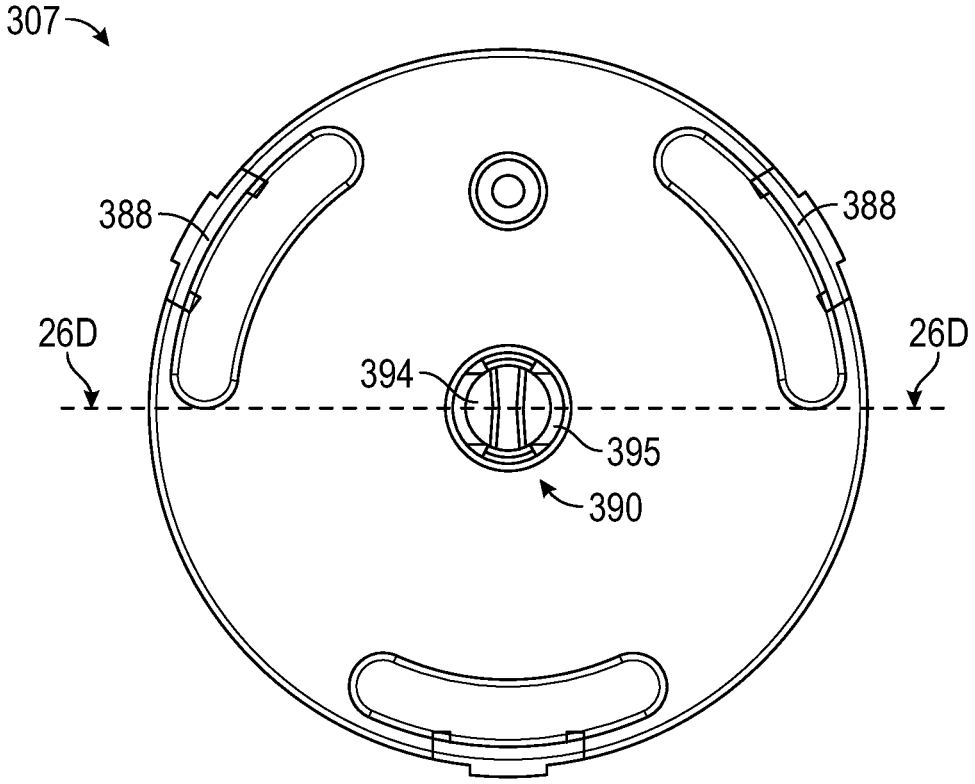
Figure 26D:
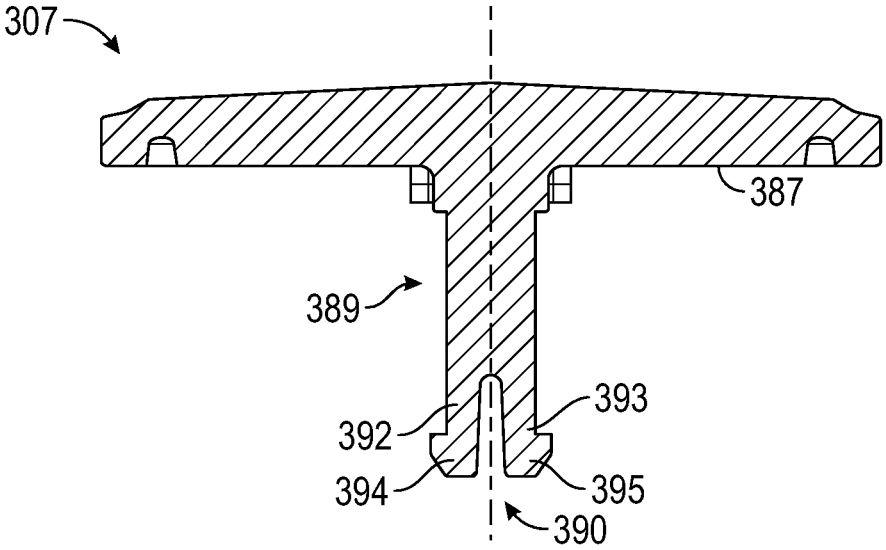
FIG. 26D is an illustration showing a section view of the cover element taken along line 26D-26D of FIG. 26C.
Figure 27:
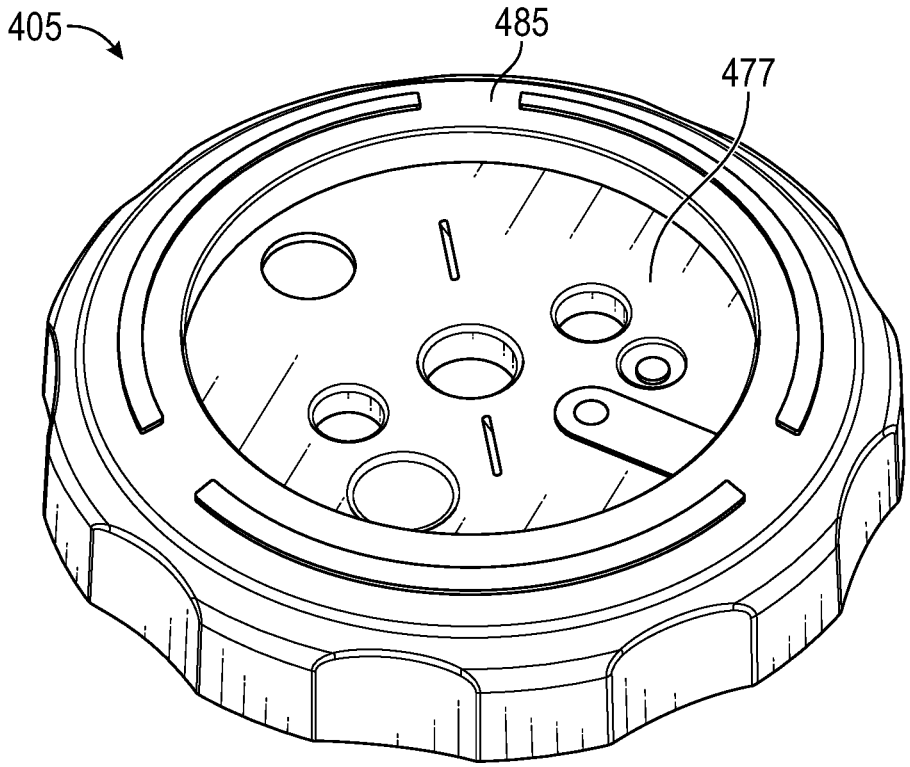
FIG. 27 is an illustration showing a perspective view of a fourth alternative dial for use with the first embodiment of the rotary closure of FIG. 1.

The pawl spring 251 is also operable for disengagement from the extension 233 of the spool 203 in the second tensioned state of FIGS. 23B and 24B. The pawl spring 251 is transitioned into the second tensioned state by counter-rotation of the dial 205 in the second direction R. As the dial 205 is rotated in the second direction R, the cam path 280 forces the cam follower 256 of the pawl spring 251 outward and away from the common center axis A and the spool 203. This action releases the spool 203 and enables the spool 203 to rotate freely within the open spool passage 224 of the open housing 204 without influence from the pawl spring 251. As shown, in the second tensioned state, the cam follower 256 of the pawl spring 251 is located at a second "spool release" portion 282 along the cam path 280 of the dial 205. The circular spring body 250 of the index spring 204 defines a cam follower pocket 257 for each respective pawl spring 251 to tuck into as the pawl spring 251 is actuated away from the common center axis A.

Figure 18A:
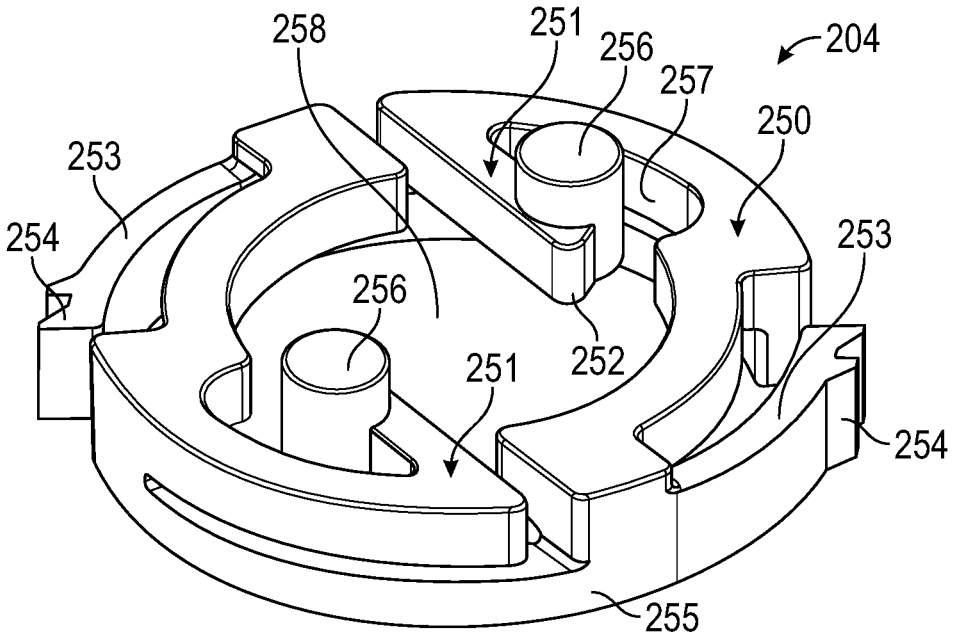
FIGS. 18A-18D are a series of illustrations showing top perspective, side, top plan and bottom plan views of an alternative index spring of the rotary closure of FIG. 12.
Figure 18B:
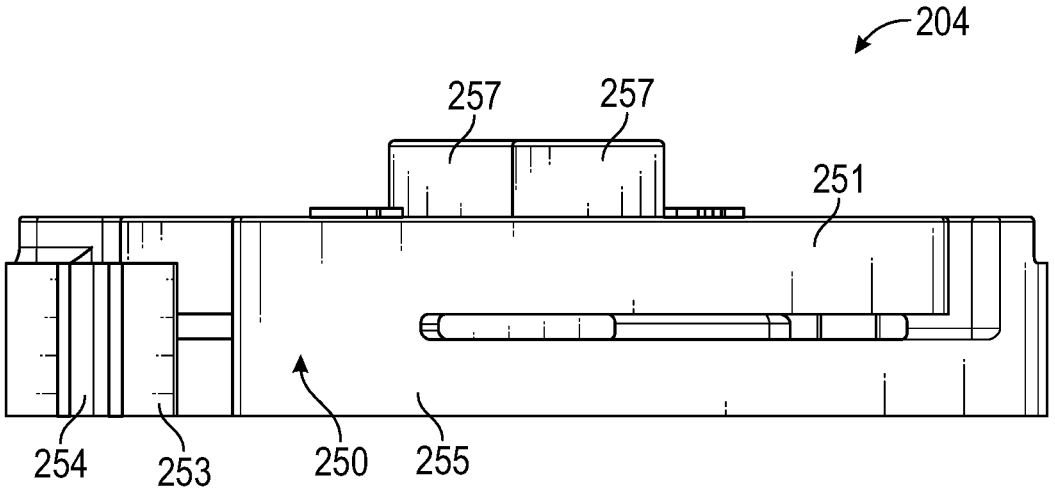
Figure 18C:
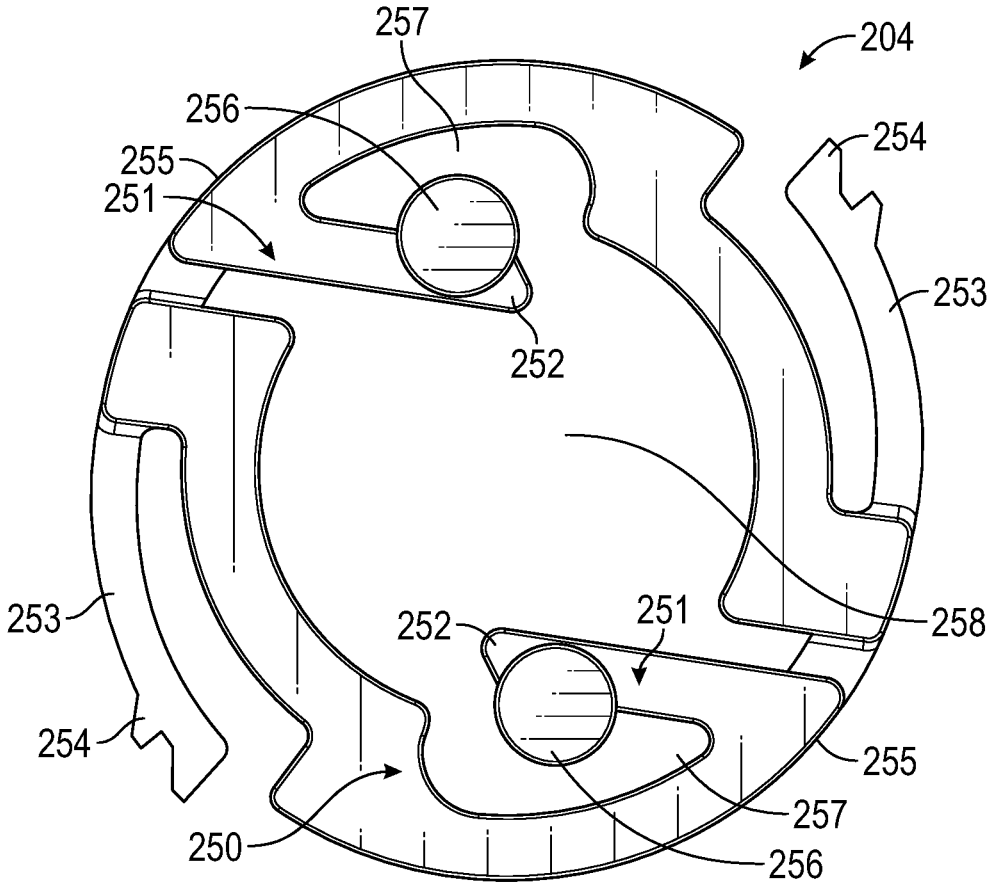
Figure 18D:
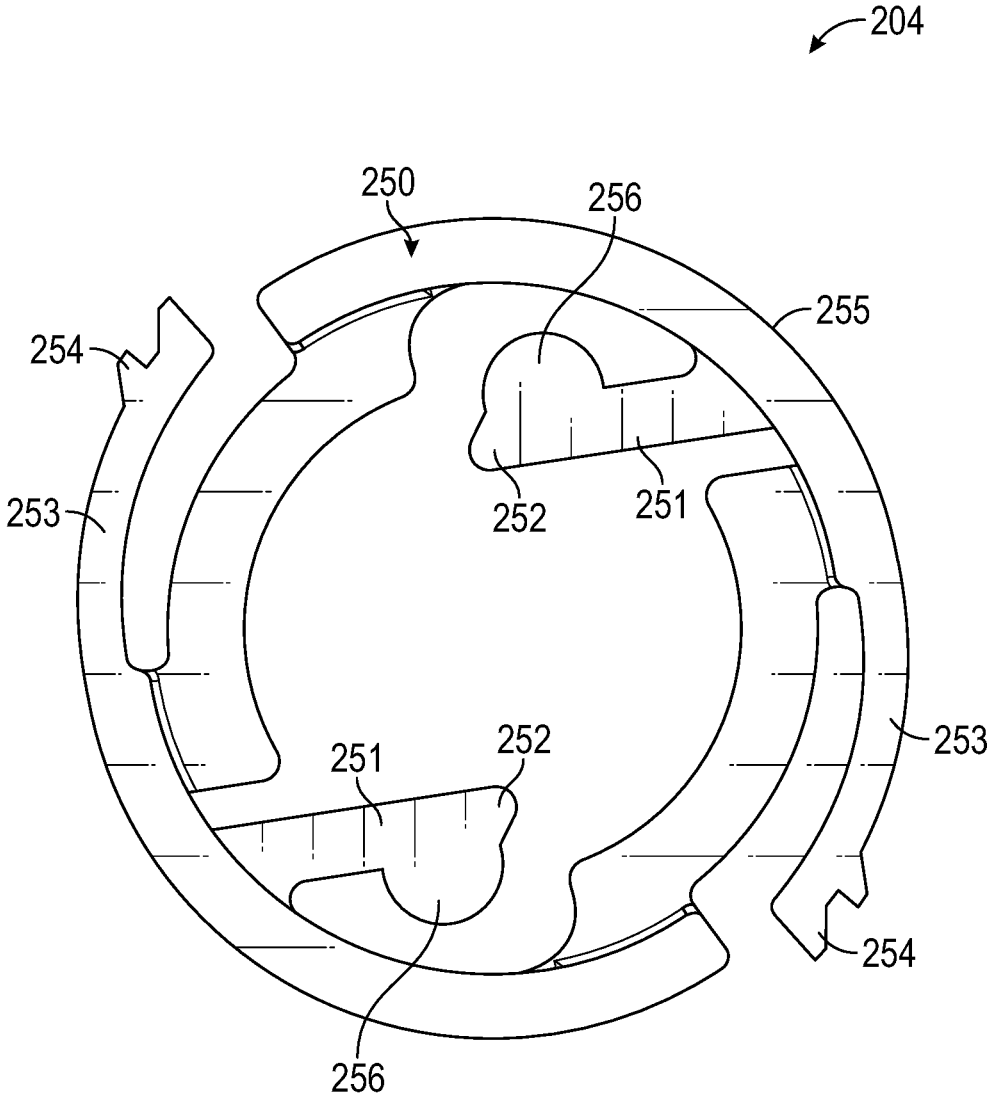
Figure 19A:
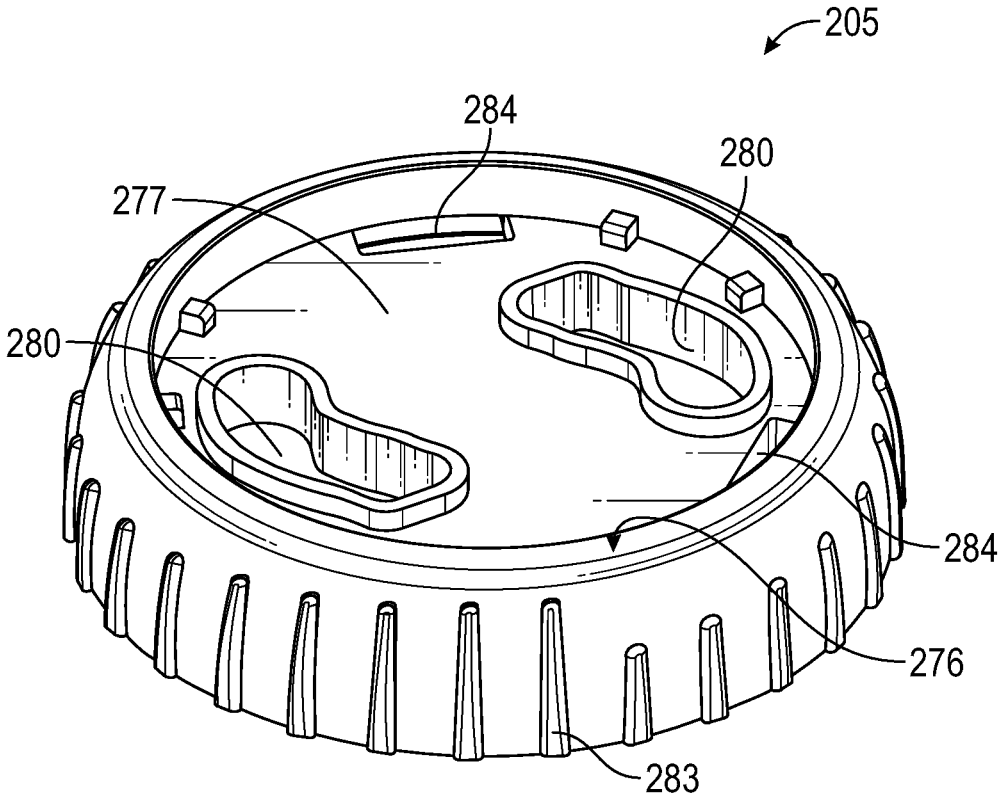
FIGS. 19A-19D are a series of illustrations showing top perspective, top plan, bottom plan and side views of a second alternative dial of the rotary closure of FIG. 12.
Figure 19B:
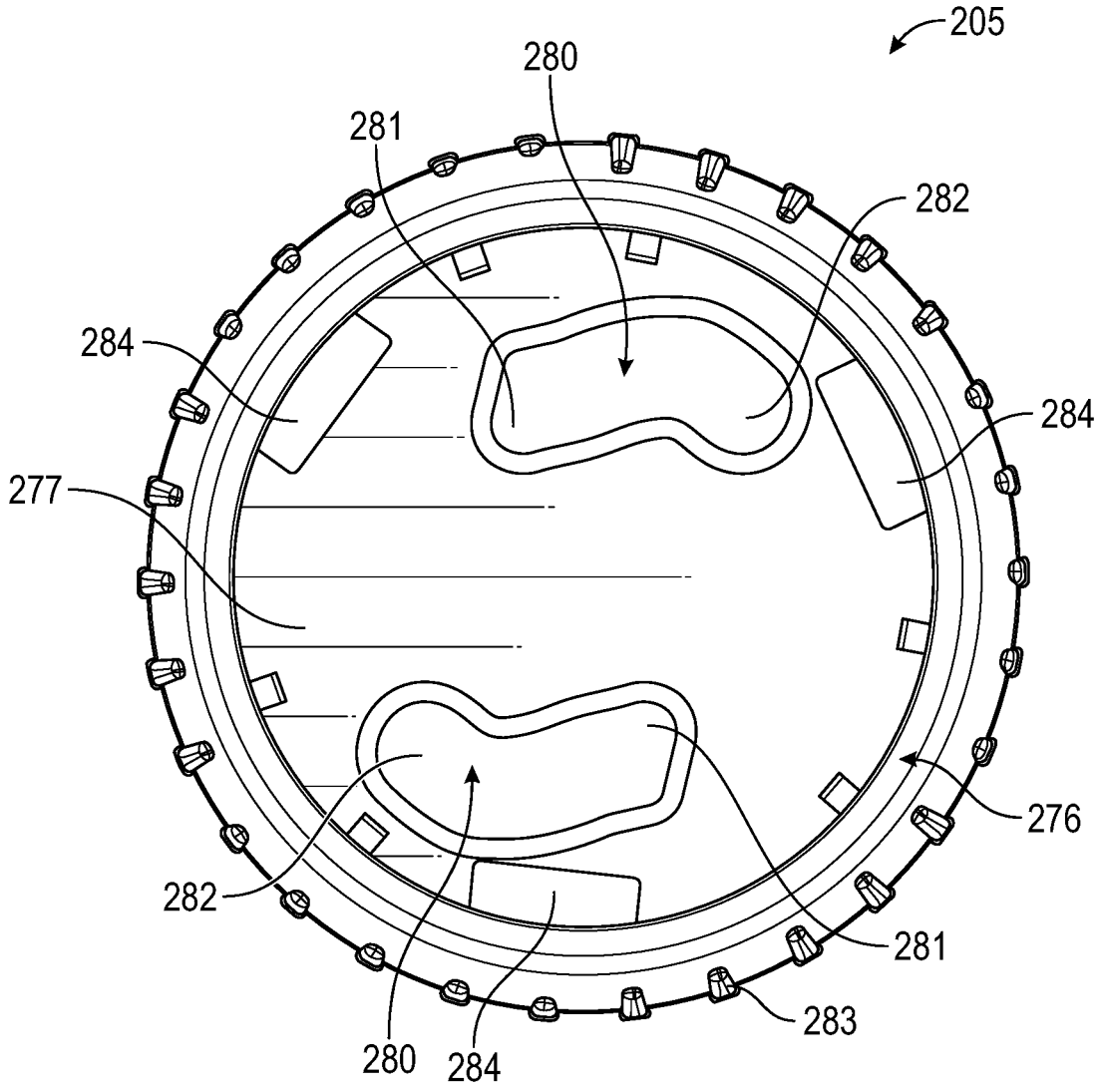
Figure 19C:
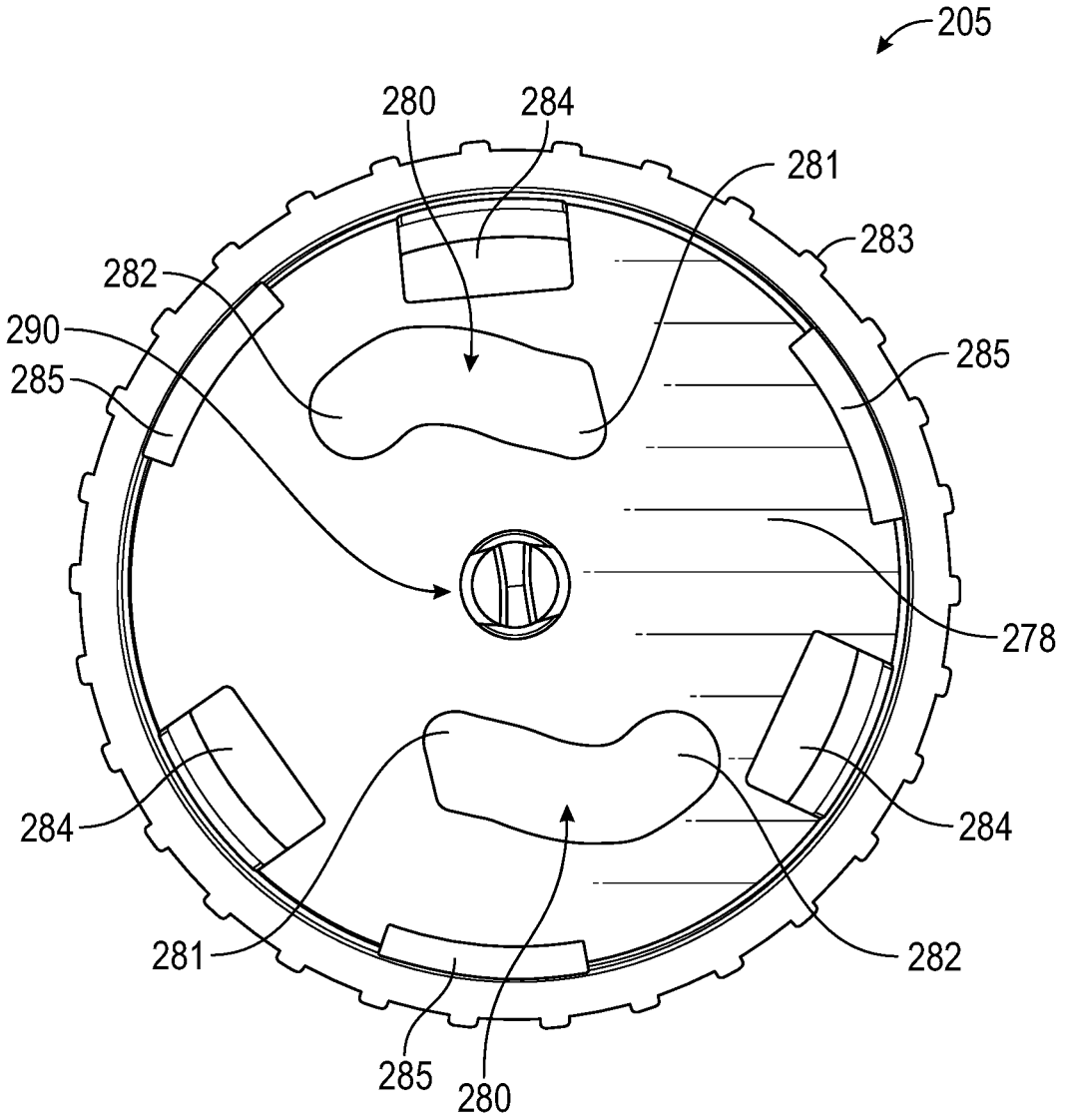
Figure 19D:
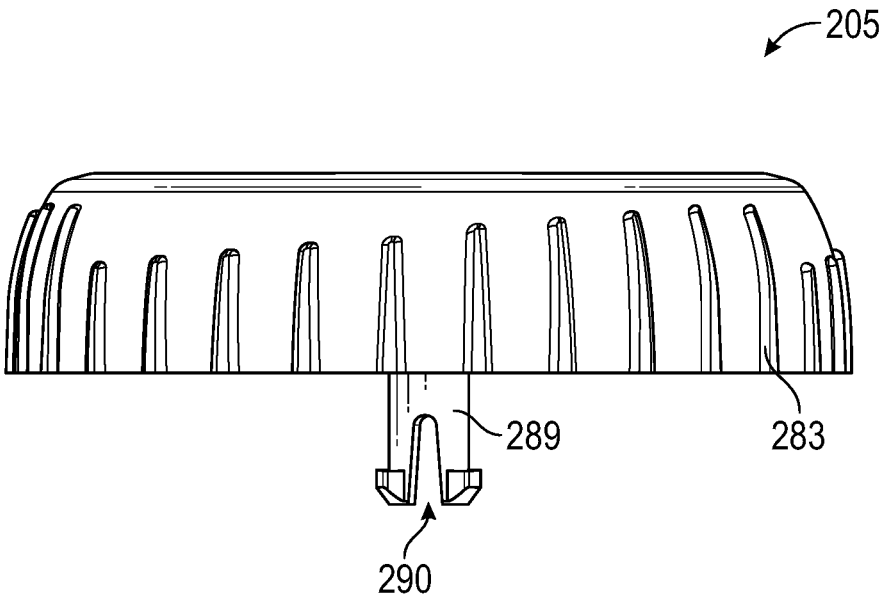
Figure 20:
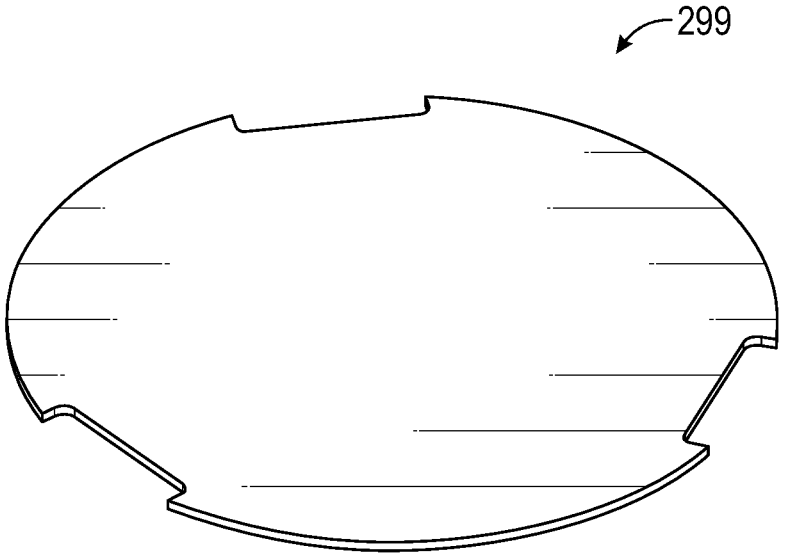
FIG. 20 is an illustration showing a perspective view of a decorative disc of the rotary closure of FIG. 12.
Figure 21A:
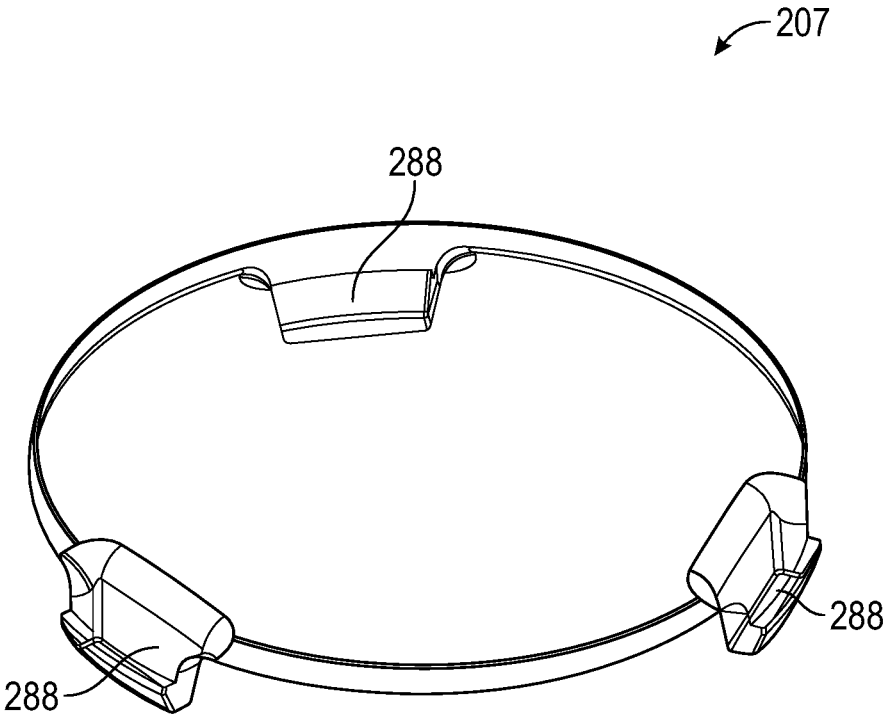
FIGS. 21A and 21B are a series of illustrations showing to perspective and side views of a cover element of the rotary closure of FIG. 12.
Figure 21B:
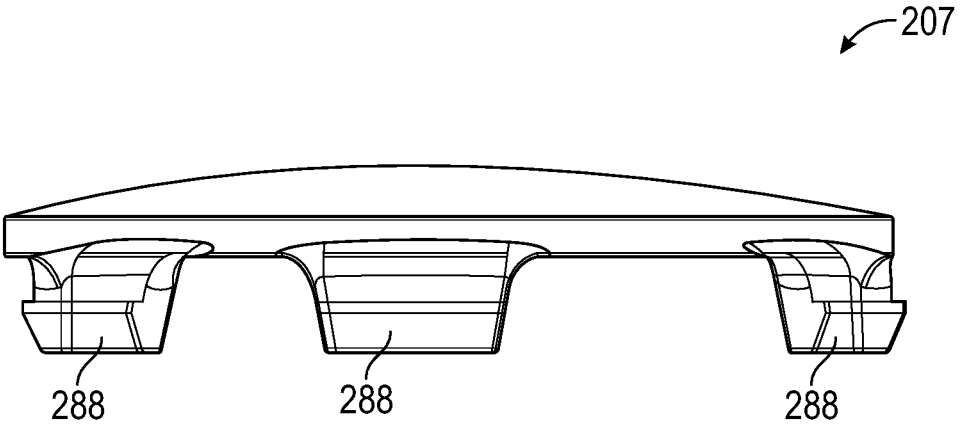
Figure 22:
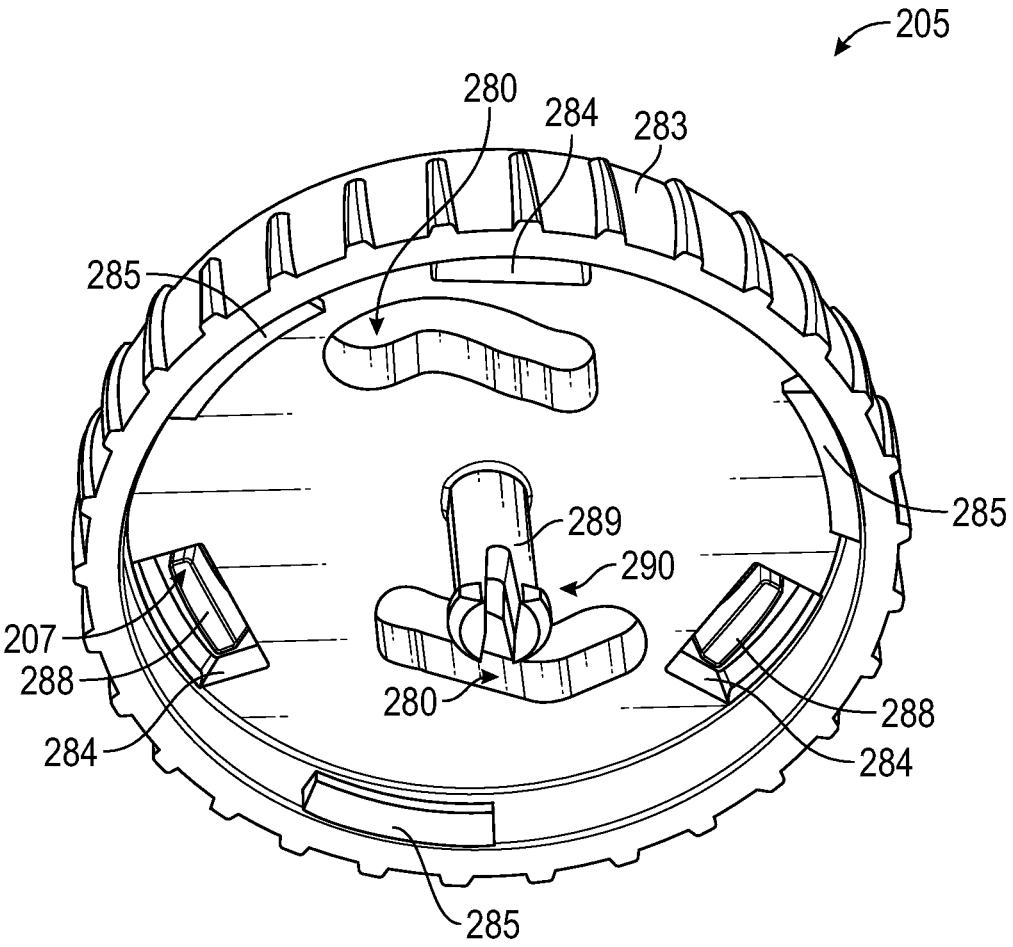
FIG. 22 is an illustration showing a bottom perspective view of an assembled dial of the rotary closure of FIG. 12.

Additionally, the index spring 204 also includes a catch spring 253 (in the embodiment shown, a pair of catch springs 253) oriented along an outer edge 255 of the circular spring body 250 of the index spring 204. The catch spring 253 engages the open housing 202 to prevent back-rotation of the index spring 204 in the second direction R. As shown, the catch spring 253 includes a plurality of tangs 254 that engage a plurality of teeth 223 of the open housing 202 as the index spring 204 is rotated in the first direction Q but prevent counter-rotation in the second direction R. In some embodiments, as shown in FIG. 18C, the catch spring 253 is oriented outward and away from the common center axis A. When engaged within a housing channel 225 of the open housing 202 and when rotated in the first direction Q, the catch spring 253 is forced inward towards the common center axis A by the plurality of teeth 223 of the open housing 202, and then snaps back outward away from the common center axis A to engage the teeth 223 of the open housing 202 at an advanced radial position along the housing channel 225 of the open housing 202. The index spring 204, particularly the pawl spring 251 and the catch spring 253, are comprised of a material that tensions when deformed and returns to its original position when released. In a primary embodiment, the index spring 204 is comprised of a plastic material such as Delrin.

FIGS. 19A-19D illustrate the dial component 205 that provides the cam path 280 for engagement with the second embodiment of the index spring 204. The dial 205 defines a generally circular body 276 having an exterior surface 277 that defines a gripping surface 283 and an opposite interior surface 278 that defines the cam path 280. The cam path 280 engages the cam follower 256 of the index spring 204 and controls the state of the pawl spring 251. The dial 205 is rotatable in the first direction Q or the opposite second direction R. The cam path 280 includes the first "spool winding" portion 281 that positions the cam follower 256 in the first default state (FIG. 23A) of the pawl spring 251 in which the cam follower 256 and pawl spring 251 are positioned inward towards the common center axis A. When the cam follower 256 of the pawl spring 251 is within the first "spool winding" portion 281 of the cam path 280, the pawl spring 251 engages the extension 233 of the spool 203. Rotation of the dial 205 in the first rotational direction Q while the cam follower 256 is within the first "spool winding" portion 281 of the cam path 280 results in rotation of the spool 203 in the first rotational direction Q.

The cam path 280 further includes the second "spool release" portion 282 that positions the cam follower 256 in the second tensioned state (FIG. 23B) of the pawl spring 251 as a result of the dial 205 rotating in the second rotational direction Q. While the cam follower 256 is positioned within the second "spool release" portion 282 of the cam path 280, the cam follower 256 and pawl spring 251 are directed outward and away from the common center axis A. When the cam follower 256 of the pawl spring 251 is positioned within the second "spool release" portion 282 of the cam path 280, the pawl spring 251 releases the extension 233 of the spool 203. The cam follower 256 can be returned to the first "spool winding" portion 281 of the cam path 280 by releasing the dial 205 and allowing the pawl spring 251 to de-tension back into the first default state of FIG. 23A in which the pawl spring 251 contacts the spool 203.

Figure 12:
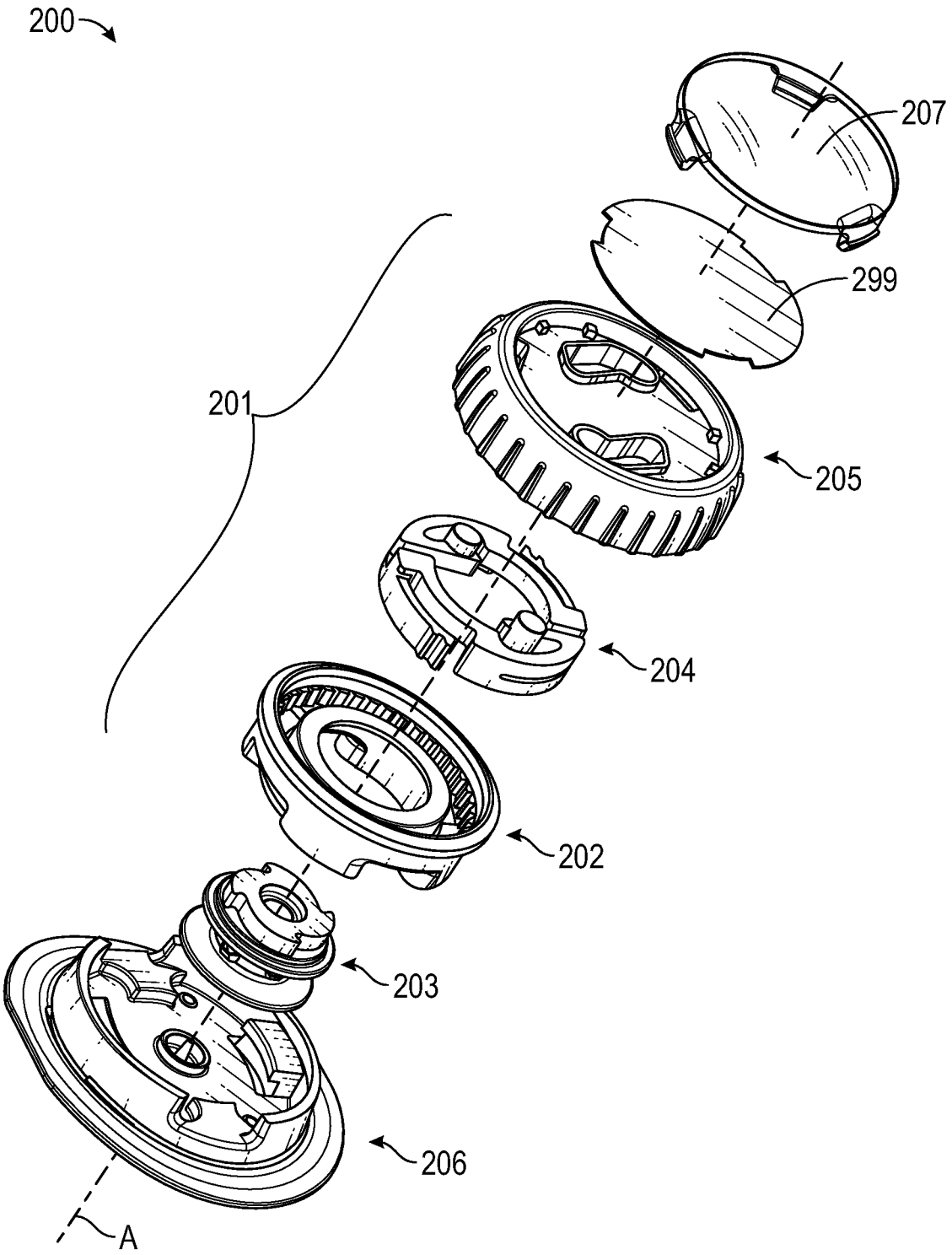
FIG. 12 is an illustration showing an exploded view of various components of a second embodiment of an improved rotary closure featuring an open spool housing and a closed flange.
Figure 13:
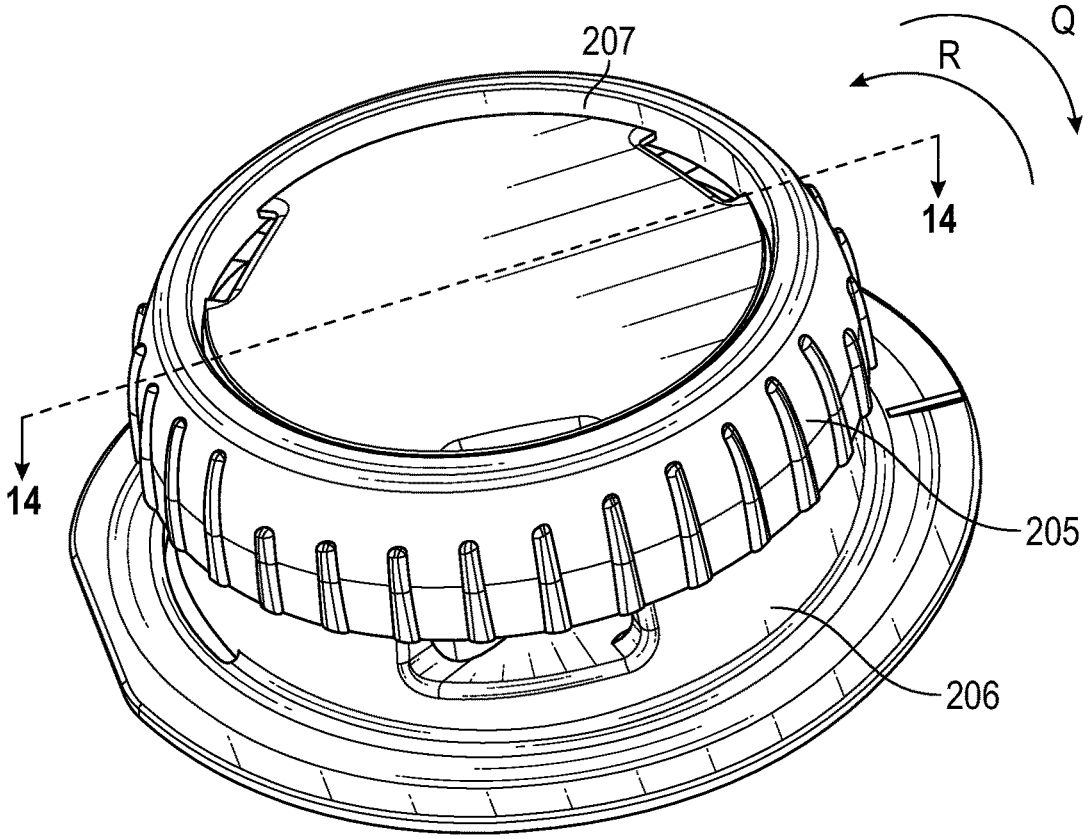
FIG. 13 is an illustration showing an assembled view of the rotary closure of FIG. 12.
Figure 14:
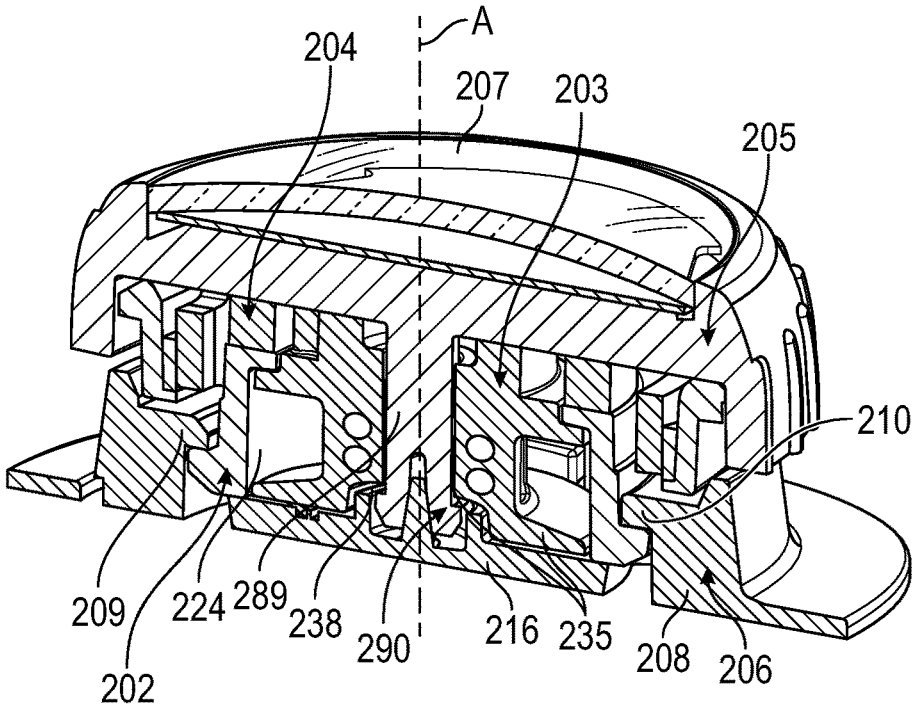
FIG. 14 is an illustration showing a section view of the rotary closure of FIG. 12 taken along line 14-14 of FIG. 13.

Further, in some embodiments as shown in FIGS. 12 and 13, the dial 205 can include or otherwise couple with a cover 207 (FIGS. 21A and 21B) that encapsulates a decorative disc 299 (FIG. 20) against the dial 205. The cover 207 can be comprised of a clear plastic material so as to display the decorative disc 299, which can include printed indicia. With this arrangement, customized dials 205 can be provided that can be decorated with a logo such as for a sports team or company. The cover 207 can include one or more cover tangs 288 for engagement with respective cover engagement points 284 defined by an exterior surface 277 of the dial 205. As shown, the dial 205 can include one or more cover engagement points 284 for coupling with the cover 207.

Referring to FIGS. 12-15B, in one method of assembly of the rotary closure 200, the open housing 202 enables manufacturers to assemble the dial 205, the index spring 204 and the open housing 202 together in a snap-fit engagement as the subassembly 201. The subassembly 201 allows a manufacturer to ensure that the dial 205, index spring 204 and the open housing 202 are working properly prior to full assembly of the rotary closure 200. The spool 203 and associated tensioning element (not shown) can thereafter be coupled with the subassembly 201 either by the manufacturer or by a consumer. The formation of the subassembly 201 also enables the consumer to remove and/or replace the spool 203 in case of jamming or to replace the tensioning element without complete disassembly of the open housing 202 from the dial 205 and the index spring 204, thus reducing a likelihood of destruction of the rotary closure 200.

The subassembly 201 is first assembled by coupling the index spring 204 with the dial 205. In one embodiment of the index spring 204, the cam followers 256 of the index spring 204 should align with the cam paths 280 of the dial 205. Further, the latching extension 289 is inserted through the keyway 258 of the index spring 204. The open housing 202 is coupled with the dial 205 by snapping a circumferential flange 228 of the open housing 202 to the interior surface 278 of the dial 205 by one or more engagement elements 285 of the dial 205 as illustrated in FIG. 15A. Following formation of the subassembly 201, the spool 203 can be coupled with the subassembly 201 by insertion of the latching extension 289 of the dial 205 through the distalmost keyway 235 of the spool 203 until the latching element 290 is secured with a shoulder 238 of the spool 203 as shown in FIG. 15B. The subassembly 201 and spool 203 can then be coupled with the flange 206 by snapping a first retention member 209 and an opposite second retention member 210 of the flange 206 into opposing first and second closed slots 227A and 227B of the open housing 202. In some embodiments, the flange 206 can be stitched into a shoe (not shown) or can be present on another device that requires tightening of a tensioning element such as a container.

The examples shown for rotary closure 200 in FIGS. 13, 23A and 23B from a top perspective of the dial 205 show the first rotational direction Q indicating a clockwise rotational direction and the opposite second rotational direction R indicating a counterclockwise direction. To wind the rotary closure 200, the user rotates the dial in the first rotational direction Q which is clockwise from the perspective of the assembled rotary closure 200 of FIG. 13. To release the rotary closure 200, the user rotates the dial in the opposite second rotational direction R which is counterclockwise from the perspective of the assembled rotary closure 200 of FIG. 13. In other words, for a right-handed rotary closure such as rotary closure 200 in an assembled position such that the viewer is facing the exterior side 277 (FIG. 19B) of the dial 205, first rotational direction Q=clockwise and opposite second rotational direction R=counterclockwise.

However, it should be noted that the rotary closure 200 of FIGS. 12-24B could also be in an orientation suitable for a left-handed wearer or when it is otherwise most convenient to wind the dial in a counterclockwise direction. In the case of a "left-handed" orientation, to wind the rotary closure, the user would rotate the dial in the first rotational direction Q which would be counterclockwise from the perspective of the assembled rotary closure. To release the left-handed rotary closure, the user would rotate the dial in the opposite second rotational direction R which would be clockwise from the perspective of the assembled rotary closure. In other words, for a left-handed rotary closure analogous to but mirrored from rotary closure 200 in an assembled position such that the viewer is facing the exterior side of the dial, first rotational direction Q=counterclockwise and opposite second rotational direction R=clockwise.

A left-handed rotary closure following the rotary closure 200 of FIGS. 12-24B would include the same components but completely mirrored across the vertical axis, including a flange analogous to flange 206, a dial analogous to dial 205, an index spring analogous to index spring 204, a spool analogous to spool 203, and a housing analogous to housing 202. However, given that the first and opposite second directions of rotation Q and R for a left-handed rotary closure are reversed relative to their illustrated counterparts, the components of the of the left-handed rotary closure including directions of involved teeth, springs and pawl components of the housing and index spring are mirrored across the vertical axis.

For instance, the plurality of teeth 223 of the housing 202 of the "right-handed" orientation shown in FIGS. 24A and 24B point in a first direction to "catch" and prevent rotation of the catch spring 254 of the index spring 204 in the opposite second rotational direction R, which is R=counterclockwise in the illustrated example. However, as the rotary closure 200 could hypothetically be manufactured in the opposite orientation, the plurality of teeth of the housing of a "left-handed" orientation would point in an opposite direction from the plurality of teeth 223 of FIGS. 24A and 24B to "catch" and prevent rotation of a catch spring of the index spring in the opposite second rotational direction R, which would be R=clockwise in the case of the left-handed example. The catch springs of the left-handed rotary closure would also be mirrored such that the catch spring points in the opposite direction relative to the catch spring 254 of the right-handed rotary closure 200.

This "mirrored" orientation would apply to the index spring, the housing, the dial, and the spool of the left-handed rotary closure, to enable a user to wind the left-handed rotary closure through counterclockwise revolution of the dial and to release the spool of the left-handed rotary closure through clockwise revolution of the dial; i.e. where first rotational direction Q=counterclockwise and where opposite second rotational direction R=clockwise.

In some embodiments, such as in the embodiment of FIGS. 25A-26D, an alternate dial 305 for use with components of the first embodiment of the rotary closure 100 is presented. In particular, the dial 305 and a corresponding latching extension 389 are not integral with one another and the latching extension 389 extends from an inner face 387 of a cover 307 which is configured for engagement with an exterior surface 377 of the dial 305. The dial 305 defines a keyway 379 through a center of the dial 305 which is configured for coaxial alignment with an index spring keyway 158 (FIGS. 8A-8E of rotary closure 100) and a spool keyway 135 (FIG. 7A-7D of rotary closure 100) for insertion of the latching extension 389 through the dial keyway 379. The dial 305 is further configured to receive an inner face 387 of a cover 307 and includes a plurality of cover engagement points 384 for engagement of the dial 305 with a respective plurality of tangs 388 of the cover 307. In some embodiments, the latching extension 389 extends from the inner face 387 of the cover 307 and is inserted through the coaxially aligned keyway 379 of the dial, keyway 158 of the index spring 104 and distal-most keyway 135 of the spool 103 until the latching element 390 is secured with the spool shoulder 138 of the spool 103 for partial assembly of the rotary closure 100.

In some embodiments, similar to that of the dial 105, the interior surface 378 of the dial 305 forms an island 382, which is a protrusion from the interior surface 378. The island 382 defines a first rounded end 372, a second squared end 373 and a textured outer edge 374. As the dial 305 is rotated in the first rotational direction Q, the first rounded end 372 of the island 382 contacts the proximal portion 165 of the pawl member 152 of the index spring 104 (FIGS. 8A-8E of rotary closure 100) and rotates the distal portion 166 of the pawl member 152 towards the center of the body 150 of the index spring 104. Conversely, when rotated in the opposite second rotational direction R relative to the index spring 104, the tension spring 156 rides over the textured outer edge 374 until the dead-stop element 163 of the spring 104 contacts the second squared end 373 of the island 382 and prevents further rotation of the dial 305 in the second rotational direction R. This communicates to the user when the index spring 104 has released the spool 103 for detensioning by providing tactile feedback, also allows the user to know when to stop turning the dial 305 in the second rotational direction R. Once the tension spring 156 has ridden over the textured outer edge 374 of the island 382, further rotation of the dial 305 in the second rotational direction R is prevented when the island 382 contacts the dead-stop element 163 of the index spring 104.

In a further embodiment, a dial 405 (FIG. 27) is shown for use with components of the first embodiment of the rotary closure 100 including an alternative gripping surface 483. In some embodiments of the dial 405, an exterior surface 477 of the dial 405 includes one or more engagement points to receive the gripping surface 483. In some embodiments, the gripping surface 483 is manufactured from or otherwise includes a grippable material such as rubber, silicon, or another suitable material. In some embodiments, the gripping surface 483 is removable from the dial 405.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

The invention claimed is:

1. A rotary closure, comprising:

a subassembly comprising:

an open housing defining a circular body and including:

a circular outer wall and a circular inner wall collectively forming a channel between the circular outer wall and the circular inner wall; and an open spool passage formed interior to the circular inner wall, the open spool passage being at least partially formed by a first arcuate plateau and an opposing second arcuate plateau, wherein the first and second arcuate plateaus and collectively define a first open arch and an opposing second open arch that communicate with an interior of the open spool passage and an exterior of the open housing;

an index spring disposed within the channel of the open housing; and a dial in operative association with the index spring that engages the open housing in a snap-fit engagement to encapsulate the index spring between the open housing and the dial, wherein the dial defines a latching extension that extends axially into the open spool passage of the open housing when engaged with the housing;

a spool configured for disposal within the open spool passage of the housing of the subassembly, wherein the spool operatively engages the index spring for rotation of the spool and wherein the spool includes a distal-most keyway that engages the latching extension of the dial.

2. The rotary closure of claim 1, wherein the first arcuate plateau includes a first shoulder defined at a first end of the first arcuate plateau and a second shoulder defined at a second end of the first arcuate plateau and wherein the second arcuate plateau includes a third shoulder defined at a first end of the second arcuate plateau and a fourth shoulder defined at a second end of the second arcuate plateau.

3. The rotary closure of claim 2, wherein the first arcuate plateau of the open housing defines a first closed slot for engagement with a first retention member of a flange and wherein the second arcuate plateau of the open housing defines a second closed slot for engagement with a second retention member of the flange.

4. The rotary closure of claim 1, further comprising:
a flange defining a closed body forming a flange floor that couples with the subassembly such that the spool is collectively enclosed between the subassembly and the flange when assembled.

5. The rotary closure of claim 4, wherein the flange floor forms a first seat, a second seat, a third seat and a fourth seat that each accept a respective first shoulder, second shoulder, third shoulder and fourth shoulder of the open housing.

6. The rotary closure of claim 1, wherein the open spool passage partially encapsulates the spool and permits access to a spool base of the spool while the spool is disposed within the open housing.

7. The rotary closure of claim 1, wherein the distal-most keyway of the spool defines a spool shoulder at a spool base of the spool for engagement with a latching element of the latching extension of the dial such that the latching element couples with the spool shoulder as the latching extension is inserted through the distal-most keyway during coupling of the spool with the subassembly.

8. The rotary closure of claim 1, wherein a spool flange of the spool further includes a centering ridge and wherein the open housing includes an inner centering flange that engages the centering ridge of the spool to align the spool within the open housing.

9. The rotary closure of claim 1, wherein the dial and index spring are operable to rotate the spool in a first rotational direction when the dial is rotated in the first rotational direction, and wherein the dial and index spring are operable to release the spool when the dial is rotated in the opposite second rotational direction.

10. The rotary closure of claim 9, wherein the index spring defines a dead-stop element configured to contact an island defined by an interior surface of the dial when rotated in the second rotational direction to prevent over-counter-rotation of the dial relative to the index spring.

11. The rotary closure of claim 1, wherein the circular outer wall defines a circumferential flange for coupling with one or more engagement elements in a snap-fit engagement.

12. A rotary closure, comprising:
a subassembly comprising:
an open housing defining a circular body and including:
a circular outer wall and a circular inner wall collectively forming a channel between the circular outer wall and the circular inner wall; and
an open spool passage formed interior to the circular inner wall;
an index spring disposed within the channel of the open housing for controlling a direction of rotation of a spool, the index spring defining a dead-stop element; and
a dial in operative engagement with the index spring and defining an interior surface, wherein the interior surface of the dial includes an island configured for contacting the dead-stop element of the index spring to prevent rotation of the dial in the second rotational direction when the dead-stop element is in contact with the island of the dial; and
a spool configured for disposal within the open spool passage of the open housing of the subassembly and in operative association with the index spring, the spool defining a distal-most keyway formed through the spool.

13. The rotary closure of claim 12, wherein the island of the dial comprises a second squared end configured to contact the dead-stop element of the index spring.

14. The rotary closure of claim 12, wherein the index spring further comprises a pawl member configured to receive a spool extension of the spool such that the pawl member rotates the spool when the dial is rotated in a first rotational direction.

15. The rotary closure of claim 14, wherein the island of the dial comprises a first rounded end configured for contacting a proximal end of a pawl member of the index spring when rotated in a first rotational direction.

16. The rotary closure of claim 14, wherein the pawl member of the index spring contacts a post of the dial and is rotated away from the extension of the spool such that the extension of the spool is disengaged from the pawl member when the dial is rotated in the second rotational direction.

17. The rotary closure of claim 12, wherein the index spring comprises a tension spring and wherein the tension spring is associated with the dead-stop element such that as the dead-stop element contacts the island of the dial, the tension spring is caused to ride over a textured outer edge of the island of the dial.

18. The rotary closure of claim 12, wherein the island of the dial comprises a textured outer edge, wherein the textured outer edge is textured such that tactile feedback is provided as the tension spring rides over the textured outer edge of the island of the dial.

19. The rotary closure of claim 12, further comprising a latching extension defining a latching element associated with the dial and configured for insertion through the distal-most keyway of the spool such that the latching element engages a shoulder of the distal-most keyway of the spool.

20. A method of assembling a rotary closure, comprising:
forming a subassembly, the method of forming a subassembly comprising:
providing an open housing defining a circular body including:
a circular outer wall and a circular inner wall collectively forming a channel between the circular outer wall and the circular inner wall;
an open spool passage formed interior to the circular inner wall; and
a circumferential flange formed exterior to the circular outer wall;
encapsulating an index spring within the channel of the open housing;
coupling a dial to the open housing in a snap-fit engagement to encapsulate the index spring between the dial and the open housing, wherein the dial defines one or more engagement elements that couple with the circumferential flange of the circular outer wall of the housing and wherein the dial further defines a latching extension that extends axially into the open spool passage of the housing; and
disposing a spool within the open spool passage of the housing of the subassembly, wherein the spool includes a distal-most keyway that engages the latching extension of the dial of the subassembly.

21. The method of claim 20, further comprising:
coupling a flange to the subassembly of the housing such that the spool is collectively enclosed between the subassembly and the flange when assembled.

* * * * *